US007044397B2

(12) United States Patent
Bartlett et al.

(10) Patent No.: US 7,044,397 B2
(45) Date of Patent: May 16, 2006

(54) FRESH AIR VENTILATION CONTROL METHODS AND SYSTEMS

(76) Inventors: Charles E. Bartlett, 7400 Highway 7, Apt. 215, St. Louis Park, MN (US) 55426; Stephen J. Kemp, 544 Coventry Pkwy., Eagan, MN (US) 55123; Leisha J. Rotering, 5641 Vincent Ave. South, Minneapolis, MN (US) 55410

( * ) Notice: Subject to any disclaimer, the term of this patent is extended or adjusted under 35 U.S.C. 154(b) by 191 days.

(21) Appl. No.: 10/758,838

(22) Filed: Jan. 16, 2004

(65) Prior Publication Data

US 2005/0156052 A1 Jul. 21, 2005

(51) Int. Cl.
*F24F 7/00* (2006.01)
*F24F 11/02* (2006.01)
*F23N 5/20* (2006.01)

(52) U.S. Cl. ..... 236/49.3; 236/46 R; 454/229

(58) Field of Classification Search ..... 236/49.3, 236/46 R; 454/229, 236, 233, 258; 62/231; 165/238, 244

See application file for complete search history.

(56) References Cited

U.S. PATENT DOCUMENTS

| | | | |
|---|---|---|---|
| 2,495,861 | A | 1/1950 | Newton |
| 2,882,383 | A | 4/1959 | Boyd, Jr. et al. |
| 3,454,078 | A | 7/1969 | Elwart |
| 3,635,044 | A | 1/1972 | Heth |
| 3,948,438 | A | 4/1976 | Vlasak |
| 4,011,735 | A | 3/1977 | Martz et al. |
| 4,075,864 | A | 2/1978 | Schrader |
| 4,136,822 | A | 1/1979 | Felter |
| 4,267,967 | A | 5/1981 | Beck et al. |
| 4,356,962 | A | 11/1982 | Levine |
| 4,369,916 | A | 1/1983 | Abbey |
| 4,408,711 | A | 10/1983 | Levine |
| 4,452,391 | A | 6/1984 | Chow |
| 4,467,617 | A | 8/1984 | Morgan, Jr. et al. |
| 4,502,625 | A | 3/1985 | Mueller |
| 4,571,950 | A | 2/1986 | Nariai et al. |

(Continued)

FOREIGN PATENT DOCUMENTS

WO WO 02/061344 9/2002

OTHER PUBLICATIONS

Honeywell Inc., "Residential Ventilation Control," EPRI Research Project 2034-44, May 1993.

(Continued)

*Primary Examiner*—Chen Wen Jiang
(74) *Attorney, Agent, or Firm*—Gregory M. Ansems

(57) ABSTRACT

Methods and systems are disclosed for meeting a fresh air ventilation threshold in a controlled space. In particular, and in some embodiments, a minimum ventilation threshold is met by using normal air handler fan cycles to minimize the energy cost of supplying the ventilation. Prediction methods may be employed to determine whether the air handler and damper need to be activated to meet a minimum ventilation threshold, even when the HVAC system is not currently calling for normal air handler fan cycles. In some cases, the past history of air handler fan run cycles is used to determine whether a fan should be operated now to provide additional fresh air ventilation. Alternatively, or in addition, predictions of future air handler cycles are used to determine whether a fan should be operated now to provide additional fresh air ventilation. In some cases, the past history of air handler fan run cycles may be used to predict future air handler cycles to determine whether to open or close a selectable fresh air source damper.

6 Claims, 68 Drawing Sheets

U.S. PATENT DOCUMENTS

| | | | |
|---|---|---|---|
| 4,595,139 | A | 6/1986 | Levine |
| 4,684,060 | A | 8/1987 | Adams et al. |
| 4,718,021 | A | 1/1988 | Timblin |
| 4,773,587 | A | 9/1988 | Lipman |
| 4,776,385 | A | 10/1988 | Dean |
| 4,838,482 | A | 6/1989 | Vogelzang |
| 4,930,460 | A | 6/1990 | Aihara et al. |
| 4,941,325 | A | 7/1990 | Nuding |
| 4,951,473 | A | 8/1990 | Levine et al. |
| 5,020,332 | A | 6/1991 | Nakatsuno et al. |
| 5,131,236 | A | 7/1992 | Wruck et al. |
| 5,142,880 | A | 9/1992 | Bellis |
| 5,179,524 | A | 1/1993 | Parker et al. |
| 5,239,834 | A | 8/1993 | Travers |
| 5,241,253 | A | 8/1993 | Schlagen |
| 5,282,770 | A | 2/1994 | Shibata |
| 5,325,286 | A | 6/1994 | Weng et al. |
| 5,415,617 | A | 5/1995 | Kraus |
| 5,433,377 | A | 7/1995 | Sodo et al. |
| 5,492,273 | A | 2/1996 | Shah |
| 5,547,017 | A | 8/1996 | Rudd |
| 5,579,993 | A | 12/1996 | Ahmed et al. |
| 5,707,005 | A | 1/1998 | Kettler et al. |
| 5,727,887 | A | 3/1998 | Webster et al. |
| 5,742,516 | A | 4/1998 | Olcerst |
| 5,791,408 | A | 8/1998 | Seem |
| 5,803,804 | A | 9/1998 | Meier et al. |
| 5,862,982 | A | 1/1999 | Federspiel |
| 5,881,806 | A | 3/1999 | Rudd |
| 5,884,806 | A | 3/1999 | Boyer et al. |
| 5,971,846 | A | 10/1999 | Cho et al. |
| 6,079,627 | A | 6/2000 | Ketter |
| 6,161,764 | A | 12/2000 | Jatnicks |
| 6,170,271 | B1 | 1/2001 | Sullivan |
| 6,179,627 | B1 | 1/2001 | Daly et al. |
| 6,318,639 | B1 | 11/2001 | Toth |
| 6,415,617 | B1 | 7/2002 | Seem |
| 6,431,268 | B1 | 8/2002 | Rudd |
| 6,467,695 | B1 | 10/2002 | Riley et al. |
| 6,514,138 | B1 | 2/2003 | Estepp |
| 2002/0072322 | A1 | 6/2002 | Sharp et al. |
| 2002/0090908 | A1 | 7/2002 | Estepp |
| 2003/0146289 | A1 | 8/2003 | Sekhar et al. |
| 2004/0222307 | A1 | 11/2004 | DeLuca |

OTHER PUBLICATIONS

Honeywell Inc., "Field Demonstration of a Residential Ventilation Controller," EPRI Research Project 3512-04, Final Report, Mar. 1995.

Nutech Energy Systems Inc., "Lifebreath Clean Air Furnace "Electric" Clean Air Furnace Manual Model 60ELE" pp. 1-18, downloaded Feb. 5, 2004.

http://content.honeywell.com/yourhome/ptc-thermostats/PC8900faq.htm, Honeywell, Your Home Expert—Programmable Thermostats: FAQ, 10 pages, printed Feb. 4, 2004.

Honeywell, "Perfect Climate Comfort Center," Quick Guide, 6 pages, 1996.

http://www.aricycler.com/frv.html, "AriCycler—The Indoor Air Quality Solution," 2 pages, printed Feb. 4, 2004.

http://www.aircycler.com/instfrv.htm, "AirCycler FR-V Installation," 2 pages, printed Feb. 4, 2004.

http://www.aircycler.com/instfrv.htm, "FR—Installation," 3 pages, printed Feb. 4, 2004.

Ashrae Standard, "Ventilation and Acceptable Indoor Air Quality in Low-Rise Residential Buildings," BSR/ASRAE Standard 62.2P, Fourth Public Review, Nov. 2002.

Lipidex Corporation, "AirCycler, Improving Indoor Air Quality," 23 pages, printed Sep. 8, 2003.

Aprilaire, "Choose a better ventilation solution for today's tight homes," Ventilation Control System Model 8126, 6 pages, 2003.

Lifebreath, "Current Events Fall Edition," 4 pages, Sep. 1999.

Nutech Energy Systems Inc., "Programmable ventilation Controller 99-105," Operation and Installation Manual, 6 pages, downloaded Feb. 4, 2004.

Honeywell Inc., "Perfect Climate Comfort Center," Owners Guide, 44 pages, 1998.

Aprilaire, "Ventilation Controller," Model 8120 Ventilation Controller, Owner's Manual, 2 pages, downloaded Feb. 4, 2004.

Nutech Energy Systems Inc., "Operating Your Ventilation Dehumidistat," Operating the 99-250 Ventilation Dehumidistat, 2 pages, downloaded Feb. 4, 2004.

Honeywell, Inc., "Residential Ventilation Control," Project Report, 32 pages, May 1993.

VARIABLE KEY

A - user input, conditioned floor area (ft. sq)
N - user input, number of bedrooms
Q - user input, ventilation rate with fan on (CFM)
f_des - desired percent on time to meet ASHRAE 62.2P
f_req - required ventilation rate control will meet
bin(i) - set of 24 bins to keep track of ventilation run time per hour
fanbin(i) - set of 24 bins to track ventilation run time when thermostat is not on
hourtimer - variable to keep track of time in program
smooth - time in hour control must run to prevent long fan cycles
V_Gt - voltage on thermostat fan terminal
V_w - voltage on thermostat heat terminal
statfan - indicates thermostat has the fan on or off (0=fan off)
V_R - remote terminal voltage, indicates homeowner remote ventilation call
fan - indicates control algorithm wants fan off or on for ventilation (0 = off)
fanrelay - indicates that the ventilation control relay is energized, control actually has fan on/off (0=off)
offtime - variable keeps track of time fan has been off
ontime - variable keeps track of time fan has been on
remote - this is a timer to keep track of amount of time per hour remote control is on
thermo - this is the ventilation time due to the thermostat, necessary to correct fanbin run time
undervent_error - indicates that the control will underventilate (0= will not underventilate, 1 = will underventilate)
DIP_1 - user input, ventialtion method ( OPEN = ASHRAE 62.2, CLOSED = MN MEC (ASHRAE 62-2001))
DIP_2 - user input, maximum percent on time (OPEN = 60% limit, CLOSED = No Limit [100%]) enterd using DIP switch
TEST - user input, momentary test mode button (1 = button pushed, 0 = button not pushed)
Test_mode - indicates whether unit is in test mode (1= in test mode)
test_timer - timer to track amount of time unit is in test mode, used to exit test mode after 180 sec. automatically
W_status - indicates that there is a W call from the thermostat (0 = no W call, 1 = W call)
pre_purge - timer used to make sure control accounts for 30 second pre-purge at start of heat call
post_purge - timer used to make sure system accounts for 90 second post- purge after heat call
G_status - indicates that there is a G call from the thermostat (0 = no G call, 1 = G call)
SWITCH - user input, position of main control switch (REMOTE ONLY, AUTO, or CONTINUOUS)

*FIG. 11P*

VARIABLE KEY

A - user input, conditioned floor area (ft. sq)
N - user input, number of bedrooms
Q - user input, ventilation rate with fan on (CFM)
f_des - desired percent on time (greater of f_des1 and f_des2)
f_des1 - desired percent on time to meet ASHRAE 62.1 (62-2001) using number of bedrooms
f_des2 - desired percent on time to meet ASHRAE 62.1 (62-2001) using floor area
f_req - required ventilation rate control will meet
bin(i) - set of 24 bins to keep track of ventilation run time per hour
hourtimer - variable to keep track of time in program
V_Gt - voltage on thermostat fan terminal
V_w - voltage on thermostat heat terminal
V_E - voltage on control that determines if the control is "enabled"
statfan - indicates thermostat has the fan on or off (0=fan off)
V_R - remote terminal voltage, indicates homeowner remote ventilation call
fan - indicates control algorithm wants fan off or on for ventilation (0 = off)
fanrelay - indicates that the ventilation control relay is energized, control actually has fan on/off (0=off)
offtime - variable keeps track of time fan has been off
ontime - variable keeps track of time fan has been on
remote - this is a timer to keep track of amount of time per hour remote control is on
undervent_error - indicates that the control will underventilate (0= will not underventilate, 1 = will underventilate)
DIP_1 - user input, ventialtion method ( OPEN = ASHRAE 62.2, CLOSED = MN MEC (ASHRAE 62-2001))
DIP_2 - user input, maximum percent on time (OPEN = 60% limit, CLOSED = No Limit [100%]) enterd using DIP switch
TEST - user input, momentary test mode button (1 = button pushed, 0 = button not pushed)
Test_mode - indicates whether unit is in test mode (1= in test mode)
test_timer - timer to track amount of time unit is in test mode, used to exit test mode after 180 sec. automatically
W_status - indicates that there is a W call from the thermostat (0 = no W call, 1 = W call)
pre_purge - timer used to make sure control accounts for 30 second pre-purge at start of heat call
post_purge - timer used to make sure system accounts for 90 second post- purge after heat call
G_status - indicates that there is a G call from the thermostat (0 = no G call, 1 = G call)
SWITCH - user input, position of main control switch (REMOTE ONLY, AUTO, or CONTINUOUS)

*FIG. 12R*

FRESH AIR VENTILATION CONTROL METHODS AND SYSTEMS

FIELD

The present invention is related to the field of heating, ventilation, and air conditioning (HVAC). More particularly, the present invention is related to methods and systems for controlling fresh air ventilation.

BACKGROUND

The American Society of Heating, Refrigerating and Air-Conditioning Engineers (ASHRAE®) suggests a ventilation and acceptable indoor air quality in low-rise residential buildings standard in ASHRAE® Standard 62.2. ASHRAE® Standard 62.2 is hereby incorporated by reference as providing informational background to the present invention.

Standard 62.2 establishes a number of minimum ventilation standards for residential buildings, with various standards suggested over relatively short to relatively long time periods (i.e. from one to twenty four hour periods). These standards call for fresh air to be ventilated into a house or other low rise residential building to at least a minimum level.

FIG. 1 shows a schematic view of a building 20 that includes an HVAC system shown generally at 10. The illustrative HVAC system includes a heating device 12, a cooling device 14, a heat exchanger 16, and a fan 18. Ductwork connects the system 10 to various rooms in the building 20. A controller 22 receives indoor environment information from one or more sensors 24 (which may be, for example, a thermostat or humidistat), and controls various elements of the system 10.

The illustrative HVAC system 10 also includes a fresh air vent 26 that is coupled to the system 10 via a selectively openable damper 28. The inclusion of the fresh air vent 26 and selectively openable damper 28 allows for a controllable infusion of fresh air into the interior of the building 20. For air to enter, the damper 28 can be opened and the fan 18 can be operated, so that fresh air is sucked into the building 20 by the action of the fan 18.

The addition of fresh air to the interior of the building 20 can be used to meet a desired threshold of fresh air ventilation, such as that suggested in Standard 62.2. However, over ventilation of the building 20 can be undesirable in some cases because it can increase the cost of operating the building 20. For example, operating the fan 18 for the sole purpose of drawing fresh air into the building 20 can increase the power consumed by the fan 18, and thus increase the cost of operating the building 20. Also, the fresh air that is drawn into the building 20 may be at a different temperature and/or humidity than that which is desired, and thus may require additional conditioning (i.e. heating, cooling, drying, humidifying, etc.), which can increase the cost of operating the HVAC system. Because the desired ventilation strategy for different buildings can vary considerably depending on the circumstances, it may be desirable to provide added flexibility to a user or installer to choose an appropriate ventilation control strategy.

SUMMARY

The present invention includes systems and methods for controlling fresh air ventilation of a building or other structure, and more specifically, for meeting one or more desired fresh air ventilation thresholds in an efficient manner. In one illustrative embodiment, a minimum ventilation threshold is met by using normal air handler fan cycles to minimize the energy cost associated with supplying the ventilation. In some embodiments, prediction methods may be employed to determine whether the air handler and damper should be activated to meet a minimum ventilation threshold, even when the HVAC system is not currently calling for normal air handler fan cycles. Past history of air handler fan run cycles may be used to determine whether a fan should be operated now to provide additional fresh air ventilation. Alternatively, or in addition, predictions of future air handler cycles may be used to determine whether a fan should be operated now to provide additional fresh air ventilation. The past history of air handler fan run cycles, in some cases, may be used to predict or anticipate future air handler cycles to help determine whether a fan should be operated now to provide additional fresh air ventilation. Also, in some embodiments, additional fresh air ventilation cycles may be smoothed out over time, so that more even ventilation is achieved.

In some cases, more than one ventilation control method may be implemented within a single HVAC controller. When so provided, a user or installer may select which of the ventilation control methods is used. For example, one ventilation control method may allow over-ventilation and/or optimization, while another may not. The user or installer may then select which of the ventilation control methods to use, depending on the circumstances.

Also, and in some embodiments, it is contemplated that the ventilation control method may be implemented, at least in part, on a fan board of an HVAC system. When so provided, the furnace manufacturer may program the furnace fan board to monitor and meet FAV requirements, thereby reducing or eliminating the need for separate ventilation control hardware. Because the furnace fan board is typically already adapted to monitor and distinguish a variety of calls from a thermostat or other related controller, the incorporation of FAV requirement programming to the furnace fan controller can reduce the costs of implementing such FAV requirements. Further, a number of wiring concerns that may accompany separate FAV control can be reduced or eliminated.

BRIEF DESCRIPTION OF THE DRAWINGS

FIGS. 11A–11H, 11J–11N, and 11P, and 12A–12H, 12J–12N and 12P–12R show a flow chart of another illustrative method in accordance with the present invention.

DETAILED DESCRIPTION

The following detailed description should be read with reference to the drawings. The drawings, which are not necessarily to scale, depict illustrative embodiments and are not intended to limit the scope of the invention. The following detailed description excludes Figure numbers "5I", "11I", "11O", "12I", and "12O" to avoid confusion.

As used herein, and unless otherwise noted, the term selective fresh air source means a source of fresh air which, when selected, provides access to fresh air, and when deselected, does not provide access to fresh air. For example, a fresh air source may include a fresh air vent including a mechanical damper such that, when selected, the fresh air source provides access to fresh air by opening the mechanical damper and, when deselected, the fresh air source does not provide access to fresh air by closing the mechanical damper. If desired, a fresh air source may include a mechanical damper having multiple settings, for example, closed, one-third open, two-thirds open, and completely open. A source of fresh air may be a selective fresh air source or a fixed source such as an open vent or other orifice.

Figure 2:
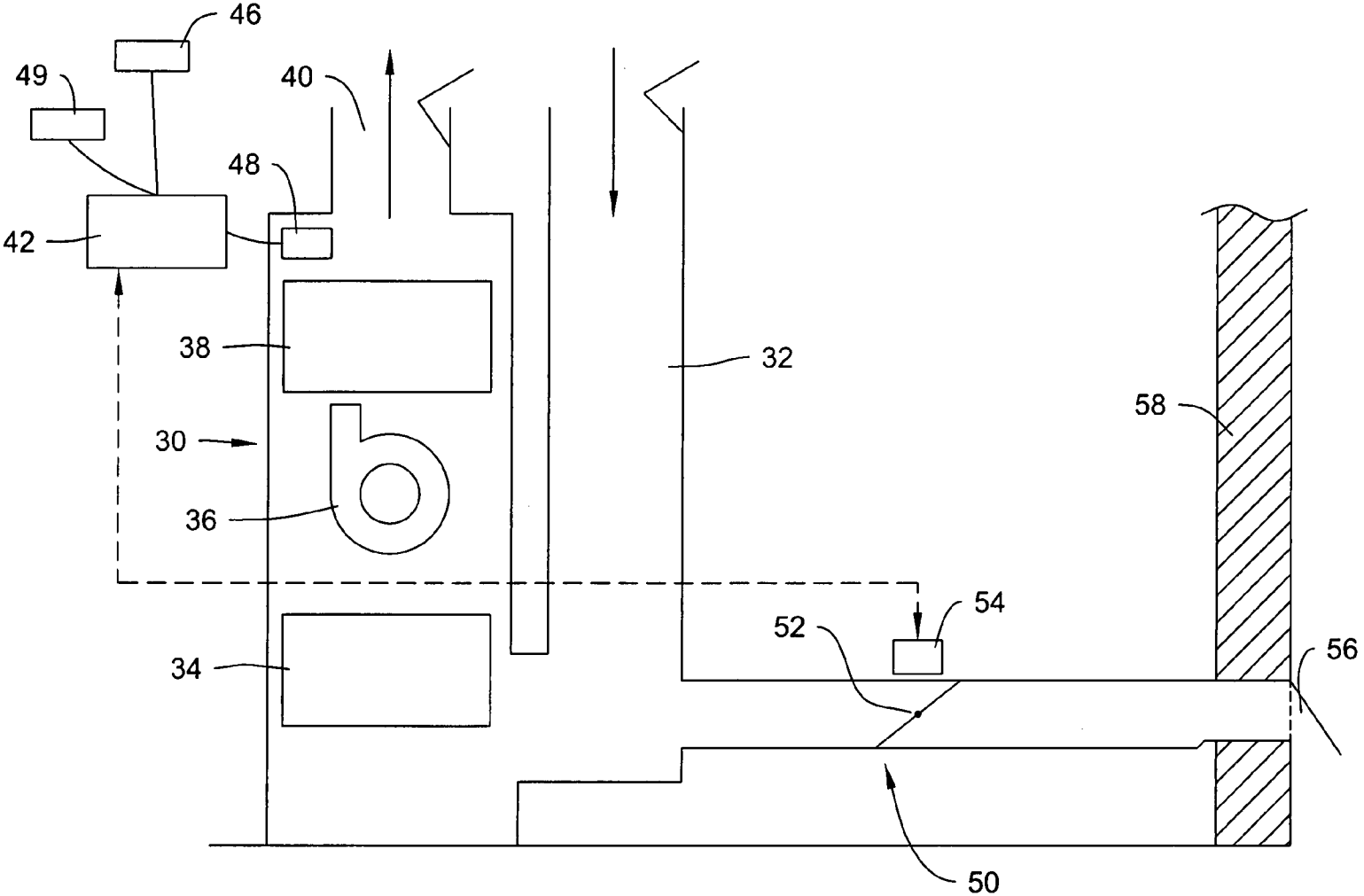
FIG. 2 is a schematic view of an illustrative air handling and fresh air infusion system.

FIG. 2 is a schematic view of an illustrative air handling and fresh air infusion system. The system includes an air handler 30. The illustrative air handler 30 is designed to pull air in from an air return 32, past a cooling device 34, into a fan 36, past a heating device 38, and out to a conditioned air output 40. The operation of the air handler 30 is controlled by a controller 42 that is connected to one or more thermostats 49 and/or humidistats 46. The illustrative controller 42 provides signals to an air handler wiring terminal or fan board 48 that in turn distributes control signals to the various elements 34, 36, 38 of the air handler 30. It should be recognized that this is just one illustrative air handler system, and that numerous other configurations may be employed.

A fresh air ventilation (FAV) source 50 is also illustrated. In some embodiments, the FAV source 50 includes a damper 52, which is controlled by a damper control 54. In other embodiments, however, the FAV source 50 may not include a damper 52 that is controlled by a damper control 54. That is, the FAV source 50 may just provide access to a fresh air source, with no damper control. The ductwork associated with the FAV source 50 extends to an outside vent 56, past/through an exterior wall 58 of the building. The outside vent 56 may include a screen, trap, or other devices to prevent animals or insects from getting into the structure.

A number of embodiments can operate with a system similar to that illustrated in FIG. 2. For retrofit methods and systems, an additional controller may be placed to provide new functionality by controlling the fan 36 and damper 52. Some such embodiments may be wired together, for example, as illustrated in FIGS. 9A to 9D below. For example, a retrofit controller may be placed between the sensing devices (i.e. the thermostat 44 and/or humidistat 46) and the controller 42 to provide additional calls for activation of the fan 36 through the controller 42.

Other embodiments may include the replacement of the controller 42 or adaptation of the controller 42 (i.e. by updating a printed circuit board or software of the controller 42). For a non-retrofit method or system, the controller 42 may itself be adapted to provide desired functionality. Alternatively, a furnace fan board may be replaced or designed such that the furnace fan board includes the desired functionality and can directly control the damper 52 or damper motor 54. A number of configurations including retrofit controllers, adaptations of thermostats, and new furnace fan board configurations are illustrated below in FIGS. 9A–9E and 10.

Figure 3:
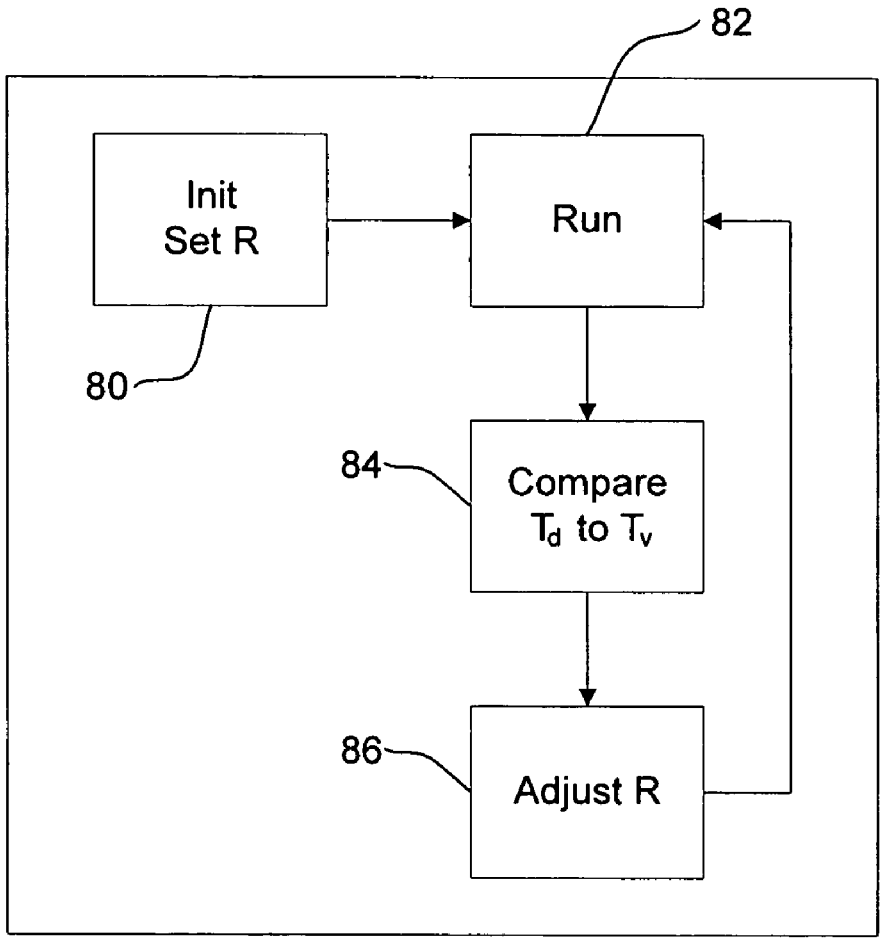
FIG. 3 is a flow chart showing an illustrative method in accordance with the present invention.

FIG. 3 is a flow chart showing an illustrative method in accordance with the present invention. In the illustrative method, and during an initialization step, an amount of information may be input or manipulated to allow the system to determine a desired amount of ventilation for a particular structure. For example, the information may include such items as total space volume, floor space, HVAC system capacities, and/or other information including user preferences. During initialization, a desired ventilation rate is selected. The desired ventilation rate may be, for example, 10 minutes per hour. In order to achieve the desired ventilation rate, an estimated ratio R is selected. The ratio R is equal to the amount of ventilation desired divided by the amount of circulation expected, where circulation occurs whenever there is a call for operation of a circulation fan for non-fresh-air-ventilation reasons.

In extreme locations such as very humid or very cold places, the HVAC system duty rate may be relatively high. With the system operating quite often, it may be possible to meet a desired FAV threshold by opening and closing a damper during normal HVAC system calls, such as humidistat or thermostat calls. To prevent over-ventilation, R may be used to keep the damper open (or partially open) only a percentage of the normal system on time. When damper control is not provided, over-ventilation may occur under some circumstances. Under other conditions, the ventilation rate may not be able to be met during normal HVAC system calls. Under these conditions, special FAV calls may have to be made to meet the desired ventilation rate. However, as indicated above, it is often desirable to limit the number of FAV calls that are required.

To prevent unnecessary start-up and shut-down of the circulation fan and excessive opening/closing of a ventilation damper (if provided), R can be used to extend a circulation fan call. For example, if R is 1.2, and a non-ventilation call for circulation fan operation lasts for ten minutes, then the method may use R to extend the operation of the circulation fan out to twelve minutes:

$$\frac{T_D}{T_E} = R = \frac{T_V}{T_C} = \frac{12}{10} = 1.2$$

Where $T_D$ is the desired ventilation time, $T_E$ is the expected circulation time, $T_V$ is the time during which ventilation occurs in fact (time when an FAV source is used and the circulation fan is on), and $T_C$ is the time in which circulation occurs as a result of HVAC system calls. R is used to control the variable $T_V$ by either opening and closing a FAV damper during circulation, or by extending HVAC system calls beyond their ordinary ends to increase $T_V$. As an alternative, if R is 0.8, then the FAV source may be disabled or closed prior to the end of an HVAC system call. For example, if the call is a ten minute HVAC call, then $T_V$ is the time during which the FAV damper (if provided) is enabled and is calculated as follows:

$$T_V = R*T_C = 10*0.8 = 8$$

In a predictive step, the method may estimate that $T_C$ for a given HVAC call will be equal to $T_C$ for a most recent HVAC call. For example, if a first HVAC system call for heating requires ten minutes of fan operation to achieve the desired temperature output, then $T_C$ for that system call would be ten minutes, and $T_C$ for the next HVAC system call could be estimated or predicted to be ten minutes. If R=0.8 and the system predicts $T_C$ as ten minutes, then the FAV damper (if provided) would be closed after eight minutes. If no damper control is provided, over ventilation may occur. In a further embodiment, the estimated $T_C$ could be modified during operation by observing temperature changes sensed by a thermostat, which could include constructing a temperature curve during HVAC operation to estimate when the temperature will rise above a (or drop below) predefined level at which HVAC operation ceases.

After the initialization shown at 80, a run state 82 is entered for a predetermined period of time, such as one hour. During the run state 82, the method operates an FAV damper (if provided) while the HVAC system responds to normal system calls. For example, the method may run for an hour or some other period of time, where the ratio R is used to open and close an FAV damper (if provided) during normal HVAC system operation. During normal HVAC system operation, there will typically be a number of HVAC cycles. Each HVAC cycle will typically begin with an HVAC system call, and end when the HVAC system has satisfied the HVAC system call. During each HVAC cycle, the HVAC fan is typically on, which can be used in conjunction with the FAV damper (if provided) to provide ventilation during these periods. The method records the actual ventilation time $T_V$ while in the run state 82.

At the end of the predetermined period of time, the method of FIG. 3 compares $T_D$, the desired ventilation time, to $T_V$, the actual ventilation time, as shown at 84. Under some conditions, the desired ventilation time $T_D$, will not equal the actual ventilation time $T_V$. For example, if there was a very light load on the HVAC system, the HVAC system may not have been run a sufficient time to achieve the desired ventilation time $T_D$.

Depending on whether $T_V$ is greater than, less than, or equal to $T_D$, R may be adjusted down, left the same, or adjusted upward, as shown at 86, to modify (if needed) the actual ventilation time $T_V$ during subsequent HVAC system operation. In some embodiments, the step of adjusting R may also include taking into account the time of day (usually evenings are cooler than daytime, so the HVAC system duty rates may rise for heating and fall for cooling), exterior conditions (i.e. humidity or temperature), occupancy, expected activities (i.e. cooking or showering), or changes to the set point, or the like.

Other factors may also be taken into account in adjusting R. For example, many houses include alarm systems that monitor whether windows or doors are open or closed. If it is determined by observing signals generated by alarm system components that windows or doors have been left open for some period of time, R may be adjusted down to reduce over-ventilation. In yet a further embodiment, R may be adjusted by the use of signals received from outside of the house that may indicate predicted or existing environmental conditions including temperature and/or humidity, as in signals sent from a radio tower that may communicate with a number of such systems. In a still further embodiment, additional information about air quality conditions outside of the house may be received by a controller and used to modify R, for example, if exterior pollen counts are high it may be desirable to reduce R.

It may be noted that R can be achieved by numerous methods. For example, the FAV damper (if provided) may be opened and closed as needed, or a hysteresis zone may be defined around R, particularly if R is less than one. For example, if R is initially set to 0.4, the hysteresis zone may include a range from 0.33 to 0.47, where the FAV damper (if provided) is opened when R gets down to 0.33 and closed when R reaches 0.47, keeping the actual ventilation within a defined range without requiring over-actuation of the FAV damper motor. Alternatively, or in addition, the FAV damper (if provided) may be opened only partially, and the amount that the FAV damper is opened may be dependent on the desired ventilation rate R. When R is greater than one, then there is less need for a hysteresis zone because the ventilation goal may be met simply by extending a circulation fan cycle.

The adjustment of R at 86 may be a type of predictive adjustment. Given the amount of HVAC operation which occurred in the previous time block (which is noted during the step of comparing $T_d$ to $T_v$ shown at 84), and modifying R accordingly, the method may predict that the HVAC duty cycle will be similar to that which just occurred, and adjusts R to account for such a prediction. Adding in information relating to the time of day or other factors such as outdoor temperature may provide additional precision to the prediction. For example, if R is given a value of 0.40, and $T_D$ is equal to eight minutes per hour, then the method is in effect predicting that the HVAC system will operate for twenty minutes in the next hour. For another example, if R is equal to 1.4, and $T_D$ is equal to fourteen minutes per hour, then the method is predicting that the HVAC system will circulate air for ten minutes in the next hour.

In further embodiments, the system may continually monitor $T_V$ during the given time block (which is presented herein as an hour to simplify the process of explanation, while other times may be used) and may compare $T_V$ to the time remaining in the present time block. If $T_D$ minus $T_V$ is equal to or greater than the amount of time remaining in the present time block, then it may become necessary to operate the fan and open the FAV damper (if provided) during a special FAV call in order to help assure sufficient ventilation. Therefore the method may include causing the HVAC system fan to activate and opening the FAV damper (if provided). Likewise, if $T_V$ exceeds $T_D$, the method may include closing the FAV damper (if provided) until the end of the time block to avoid over-ventilation. If FAV damper control is not provided, over ventilation may occur. After R is adjusted at 86, the method returns to the run state 82, and the method is repeated.

In summary, at least two methods of meeting an FAV goal are contained in the method of FIG. 3. First, an FAV goal may be met by using a ratio factor R. When R is less than one, R is used to open and close an FAV damper (if provided) during ordinary HVAC circulation fan operation. If R is one, then the FAV damper (if provided) is opened during all circulation fan operations. If R is greater than one, the method includes extending ordinary circulation cycles by keeping the circulation fan on while keeping the FAV damper open, where the circulation cycles are extended by a ratio of R. Second, in further embodiments, the FAV goal may be met by observing the value of $T_V$ as time passes. If $T_V$ exceeds $T_D$, then the FAV damper (if provided) is closed until the end of the time block. If the difference between $T_V$ and $T_D$ exceeds the amount of time remaining in the time block, then the FAV damper (if provided) is opened and the circulation fan activated for the remainder of the time block.

Figure 4A:
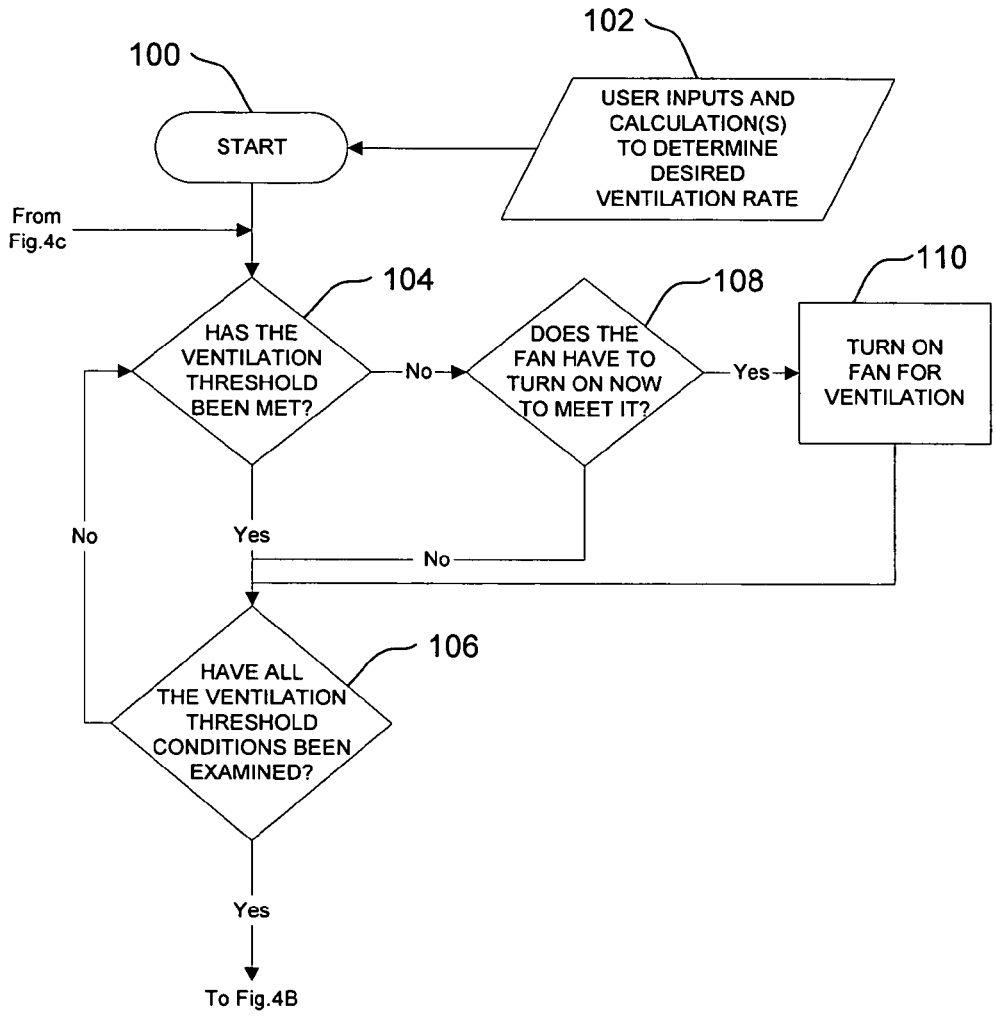
FIGS. 4A–4C show a flow chart of another illustrative method in accordance with the present invention.
Figure 4B:
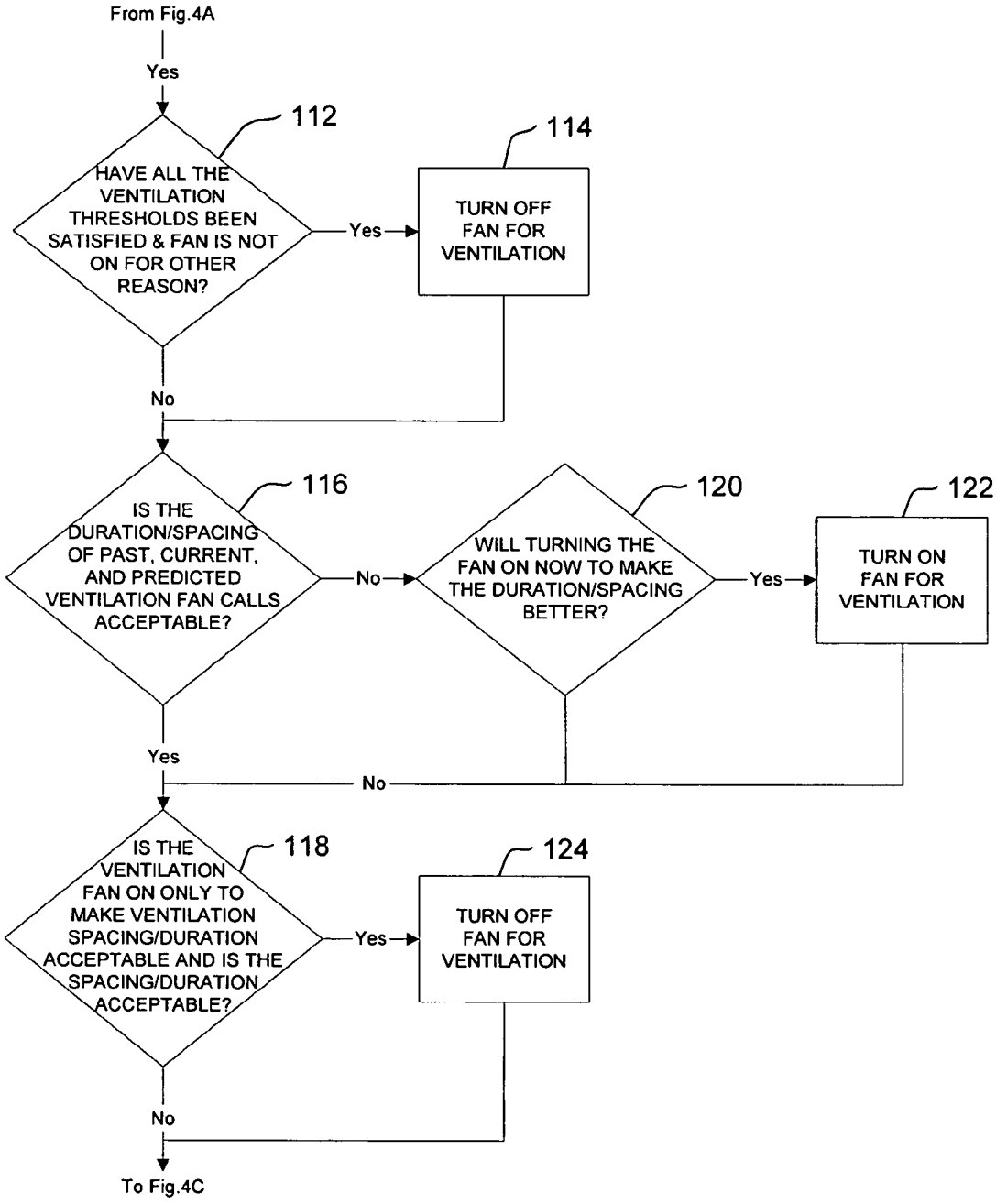
Figure 4C:
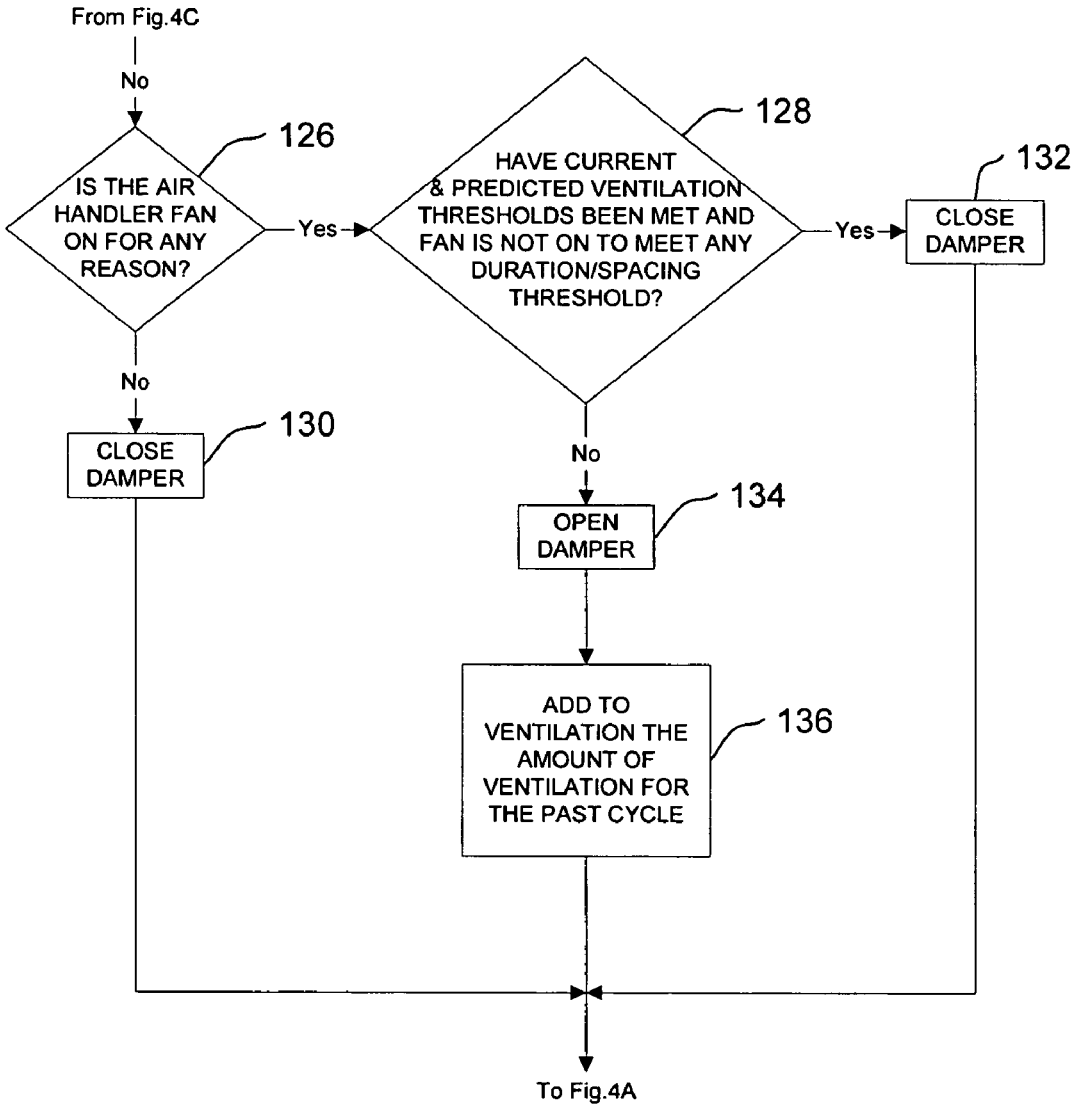

FIGS. 4A–4C show a flow chart of another illustrative method in accordance with the present invention. The illustrative method begins at a start block 100 after a user input 102 occurs. The user input 102 may include information enabling a computing device (i.e. a microcontroller or the like) to determine a required ventilation rate. For example, if ASHRAE® Standard 62.2 is to be met, information such as the number and size of rooms in a dwelling, number of occupants, floor square footage, and a number of miscellaneous factors (such as the presence of kitchen or bathroom exhaust fans, or known air infiltration) may be input. Alternatively, a user may calculate one or more required or desired ventilation rate(s), and input them into the system.

From the start block 100, the illustrative method includes determining whether a desired ventilation threshold has been meet 104 for a particular time period. In some cases, a number of ventilation thresholds may exist, such as so much ventilation per hour, so much ventilation per three hour period, and so much ventilation per day. If the desired ventilation threshold has been met, the method continues by determining whether all of a number of ventilation thresholds have been examined, as shown in block 106. If all of the ventilation thresholds have not been examined, control is passed back to block 104.

Returning to block 104, if the desired ventilation threshold has not been met, control is passed to block 108, which determines whether the fan has to be turned on to meet the ventilation threshold, and if so, the method includes turning on the fan for ventilation at block 110. For example, it may be determined that the desired ventilation threshold requires ten minutes of ventilation in an hour. If there are fifteen minutes left in the hour, then the fan may not need to be turned on to meet the threshold while if there are only ten minutes left in the hour, the fan should be turn on at ventilation block 110, otherwise the threshold cannot be met for that hour.

After all of the ventilation thresholds have been examined at 106, control is passed to block 112 of FIG. 4B. Note that the ventilation thresholds need not be met in order to be examined at 106. Block 112 determines whether all the ventilation thresholds have been satisfied, and there is no other reason for the fan to be on. If so, control is passed to block 114, wherein the fan is turned off. For example, if the fan is on due to a call for heating, cooling, drying, or humidification, then the fan is left on for an "other" reason, and would not be turned off at block 114. If the fan is turned on only for ventilation, which may occur for example at the start of a new time period due to the fan being on during the end of a previous time period for ventilation only, then the fan may be turned off. As detailed below, operation of a smoothing function, which may change the duration and/or spacing of ventilation calls, may also serve as an "other" reason, and control may not be passed to block 114.

If all of the ventilation thresholds have been satisfied, and the fan is not on for any other reason, then control is passed to block 116. Block 116 determines whether the duration/spacing of past, current, and predicted ventilation fan calls are acceptable. If so, control is passed to block 118. If the duration/spacing of past, current, and predicted ventilation fan calls is not acceptable, control is passed to step 120, which determines if turning the fan on at the present time will make the duration/spacing better. If turning the fan on at the present time will make the duration/spacing better, the fan is turned on for ventilation (e.g. special FAV call), and control is passed to block 118. If turning the fan on at the present time will not make the duration/spacing better, control is passed to block 118 without turning the fan on.

Block 118 determines whether the ventilation fan is on only to make the ventilation/duration acceptable, and if so, determines whether the duration/spacing is now acceptable. If the ventilation fan is on only to make the ventilation/duration acceptable and the duration/spacing is now acceptable, control is passed to block 124. Block 124 turns the fan off, and control is passed to block 126 of FIG. 4C. If the ventilation fan is not on only to make the ventilation/duration acceptable or the duration/spacing is not acceptable, control is passed to block 126 of FIG. 4C.

FIG. 4C continues the method from FIGS. 4A and 4B by observing and controlling the damper operation for a damper (if provided) that connects to a FAV source such as that shown in FIG. 2. Block 126 determines whether the air handler fan is on. If the air handler fan is off, control is passed to block 130, which closes the damper (if provided).

If the air handler fan is on, control is passed to block 128. Block 128 determines if current and predicted ventilation thresholds have been met and that the fan is not on to meet any duration/spacing thresholds. If current and predicted ventilation thresholds have been met and that the fan is not on to meet any duration/spacing thresholds, control is passed to block 132, which closes the damper (if provided). If current and predicted ventilation thresholds have not been met or the fan is on to meet any duration/spacing thresholds, control is passed to block 134, which opens the damper (or allows the damper to remain open if provided). With the damper open, block 134 transfers control to block 136. Block 136 adds the ventilation time occurring to the total ventilation.

With the ventilation information updated and decisions regarding whether to turn on the air handler fan to meet a ventilation threshold (FIG. 4A), whether to invoke a smoothing function to improve ventilation duration/spacing (FIG. 4B), and whether to open the FAV damper if provided (FIG. 4C), the method returns to block 104 of FIG. 4A as indicated.

Figure 5A:
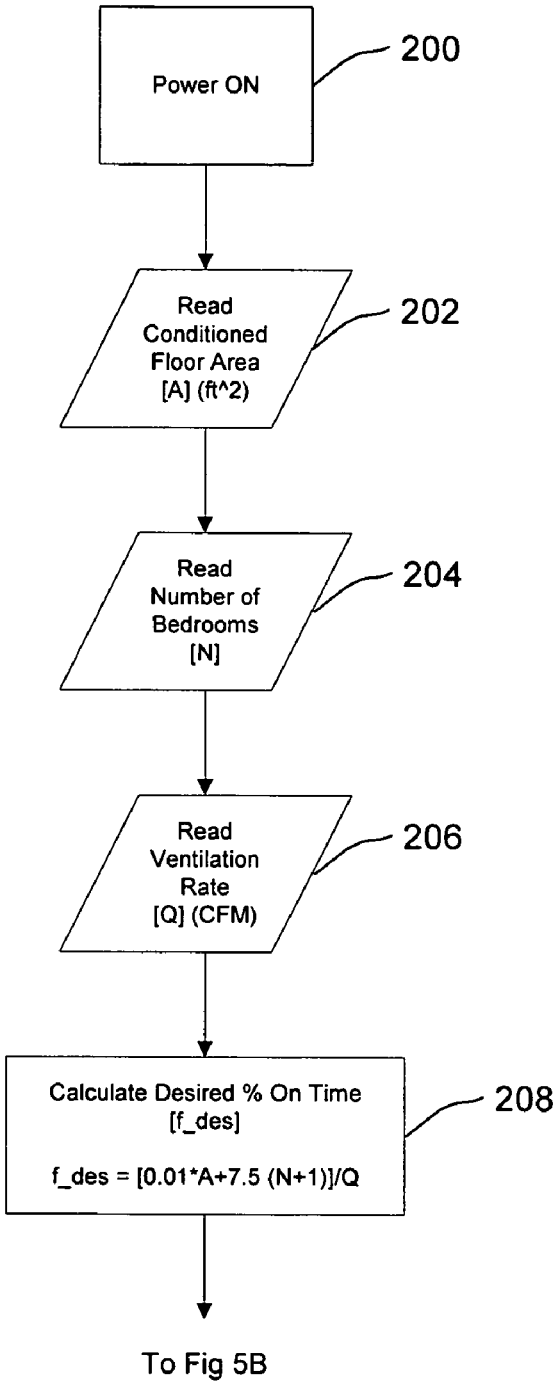
FIGS. 5A–5H and 5J–5N show a flow chart of another illustrative method in accordance with the present invention.
Figure 5B:
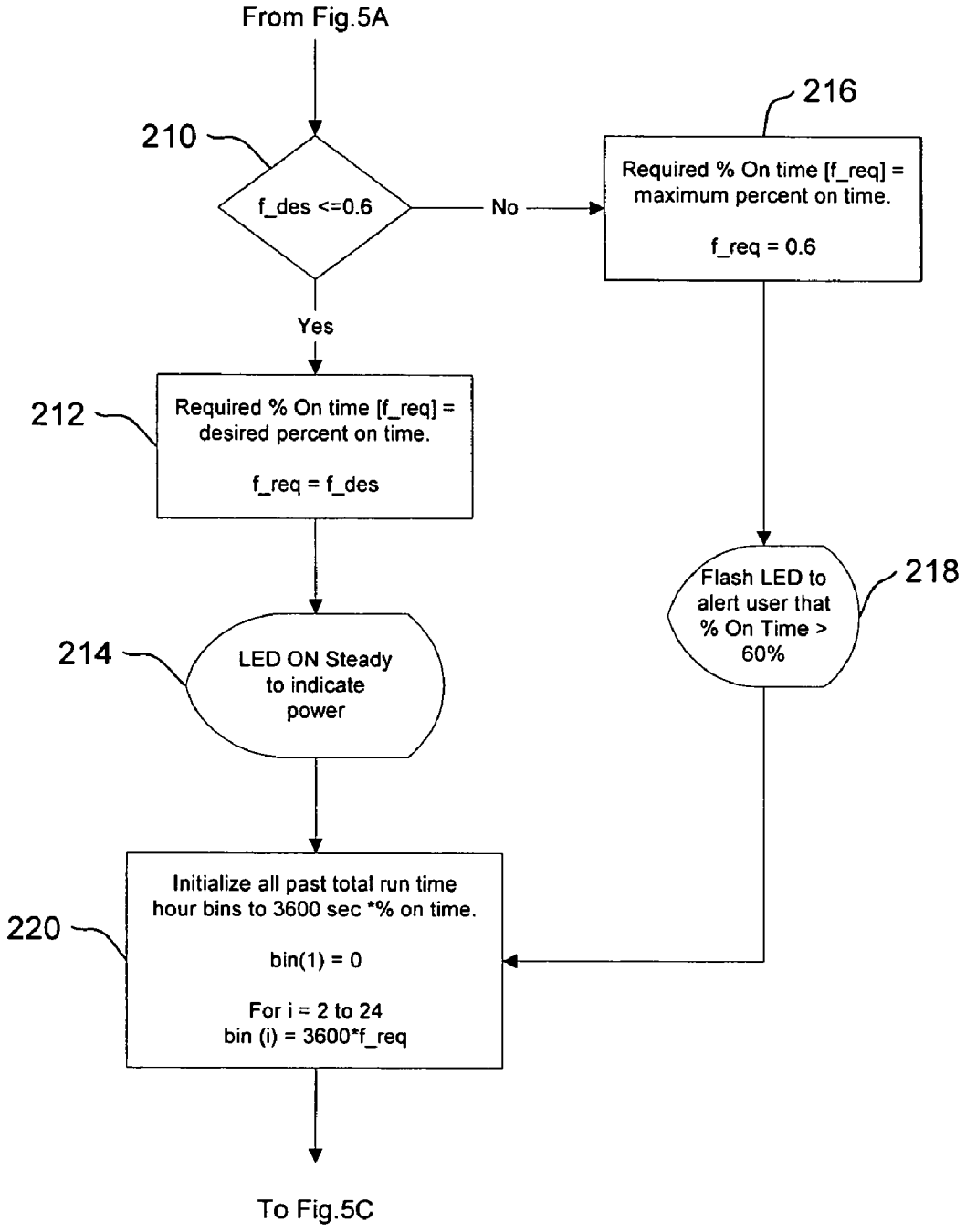
Figure 5C:
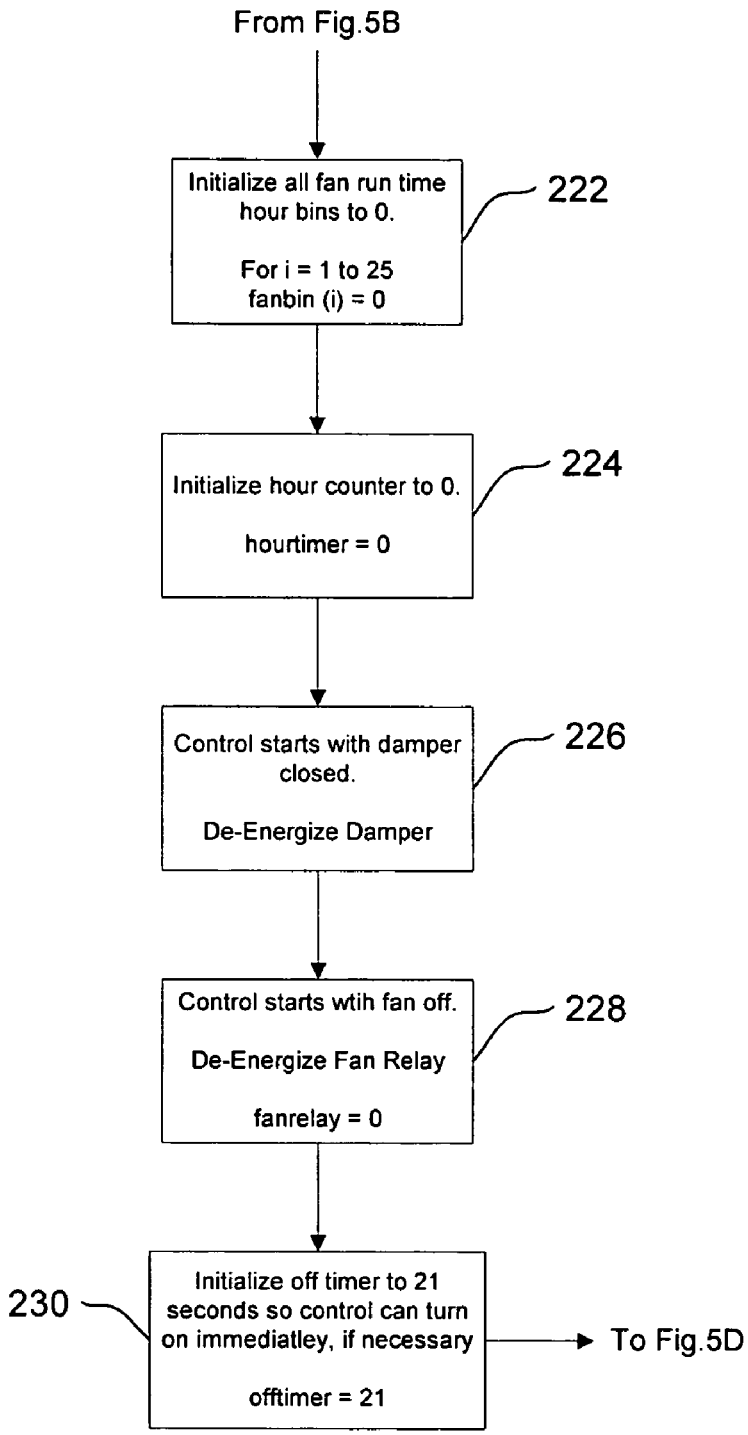
Figure 5D:
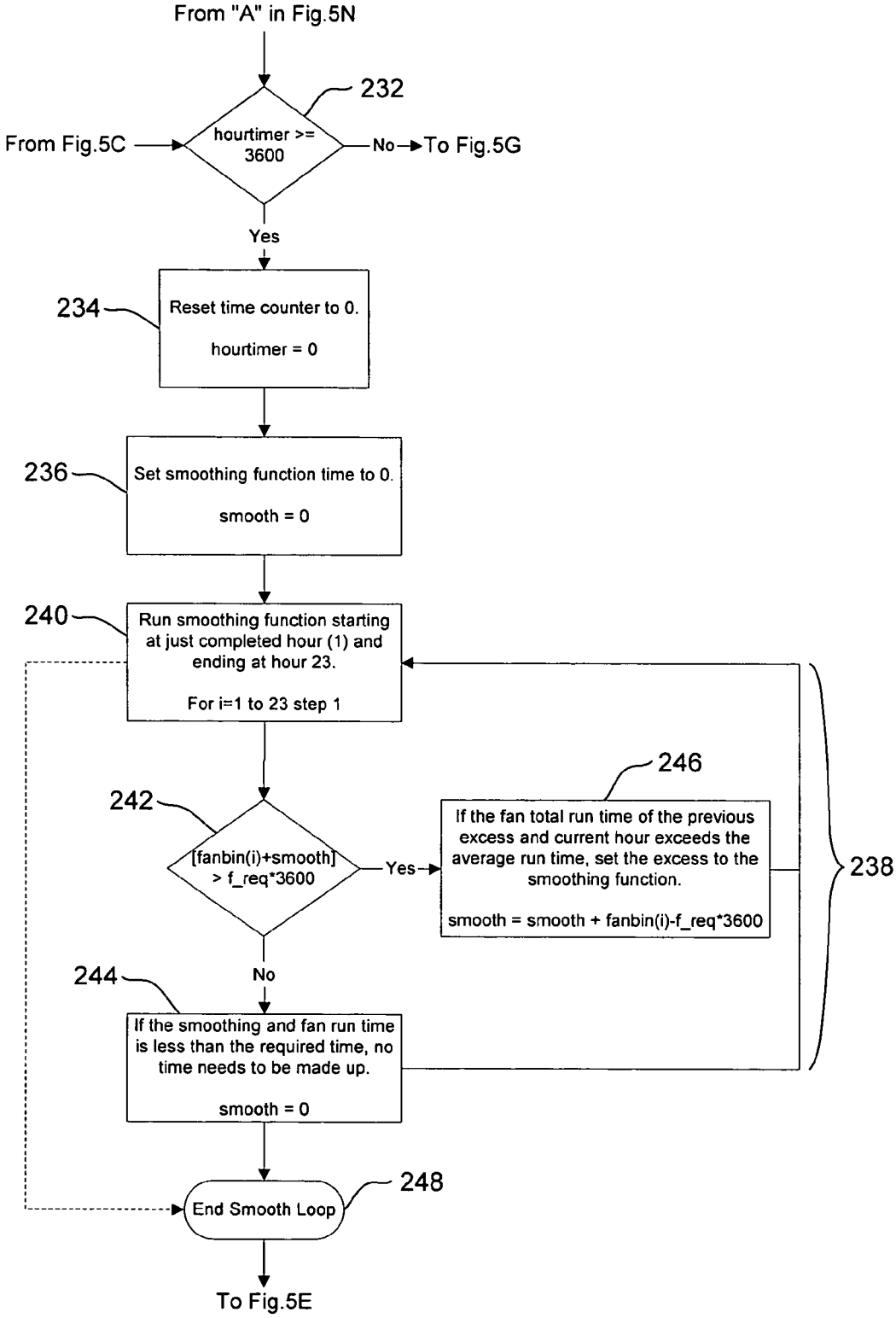
Figure 5E:
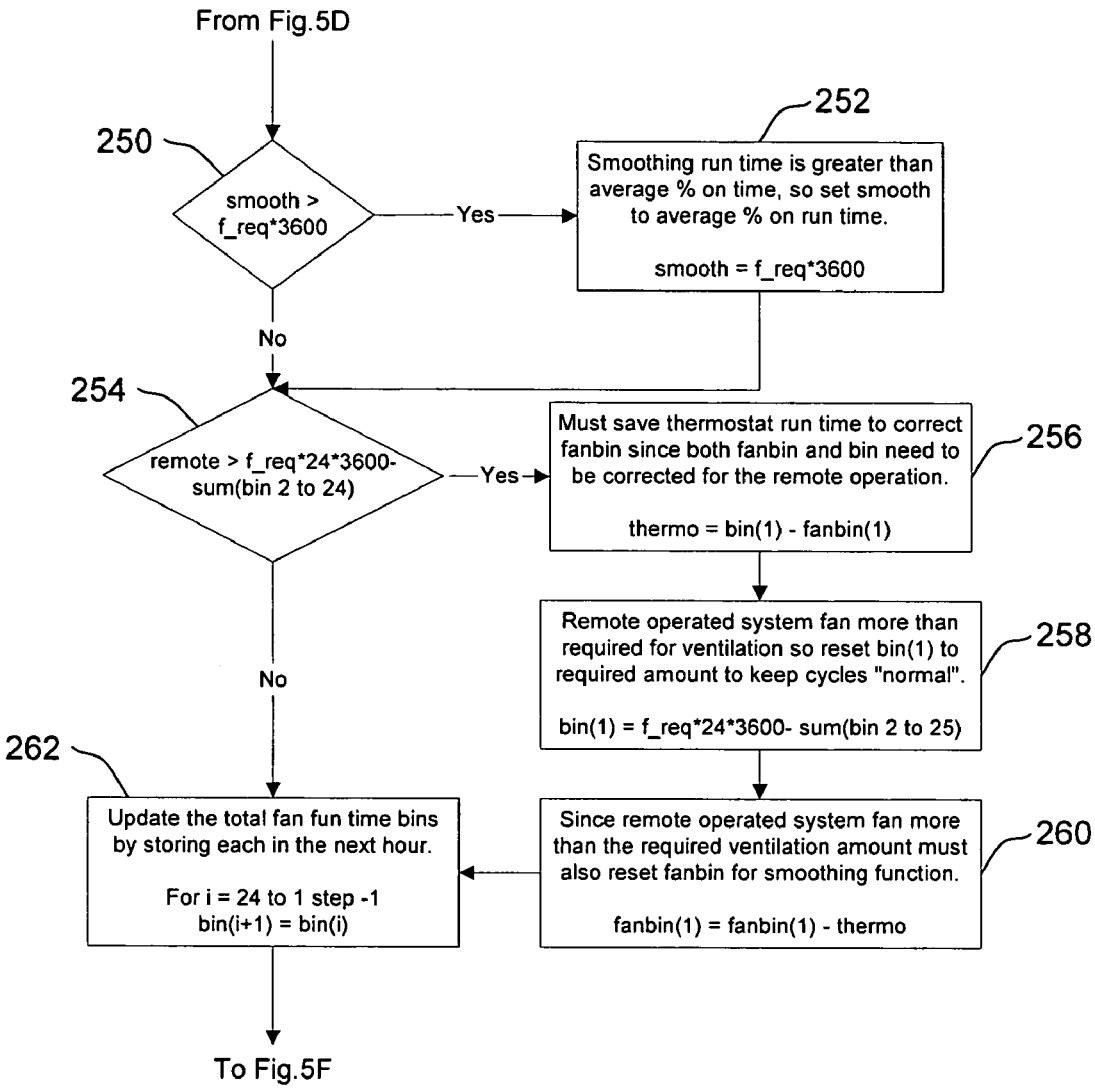
Figure 5F:
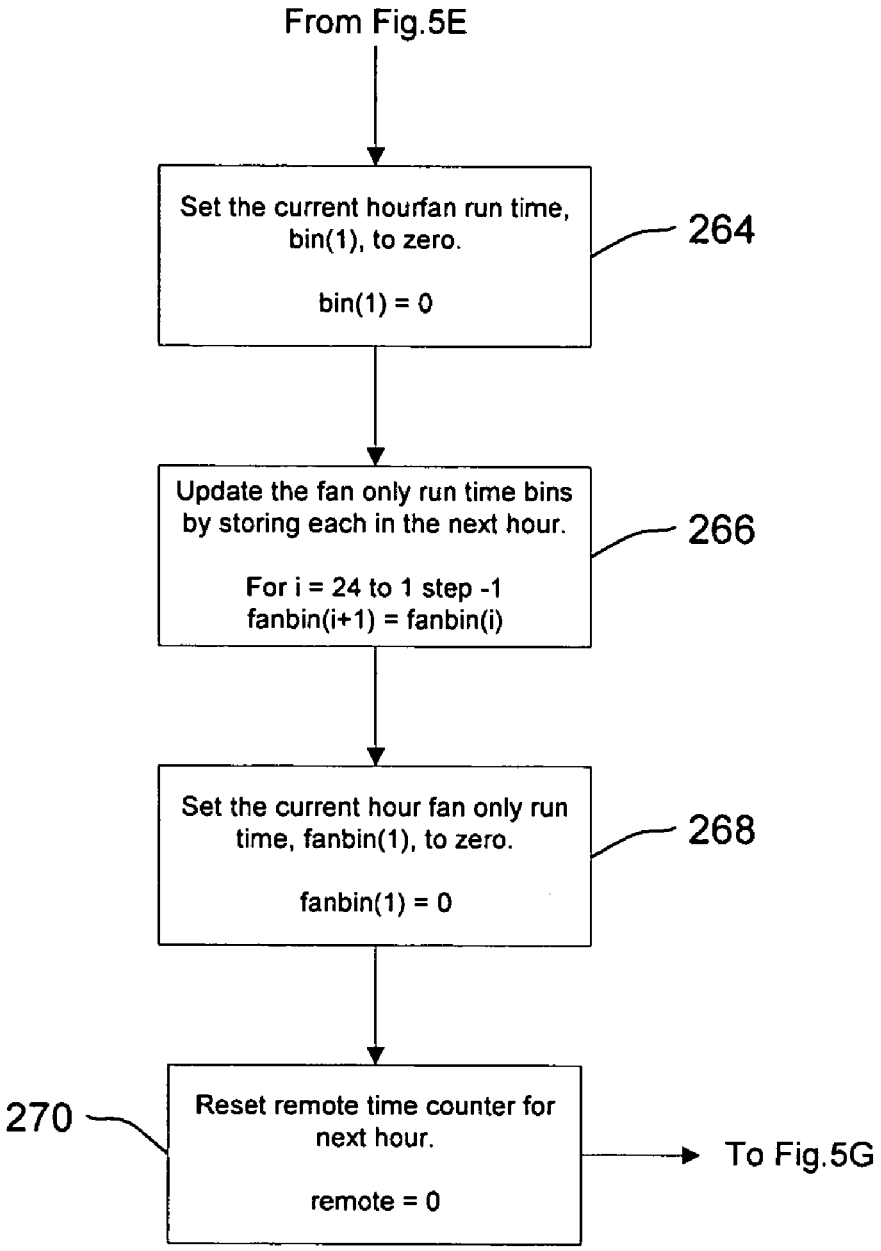
Figure 5G:
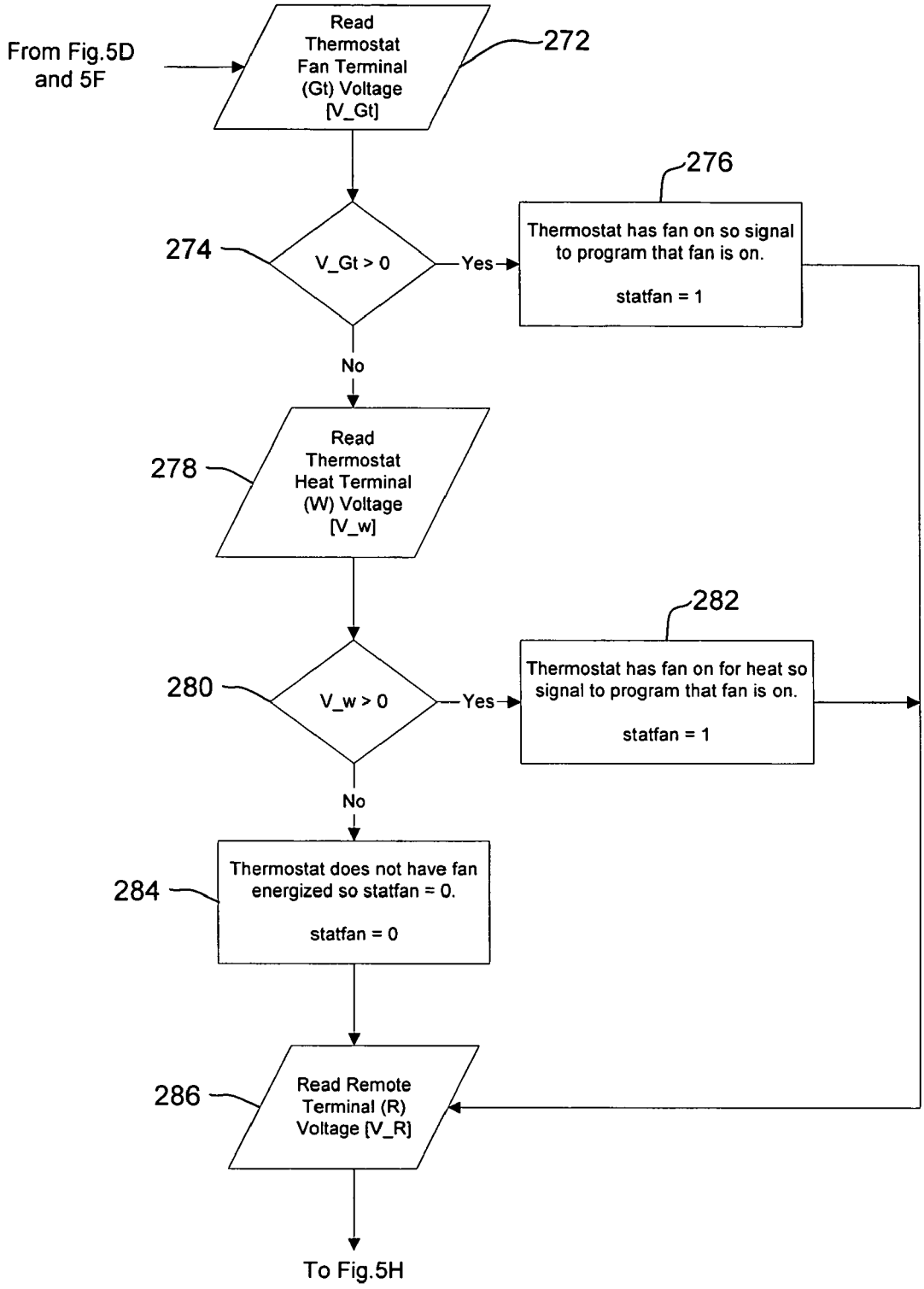
Figure 5H:
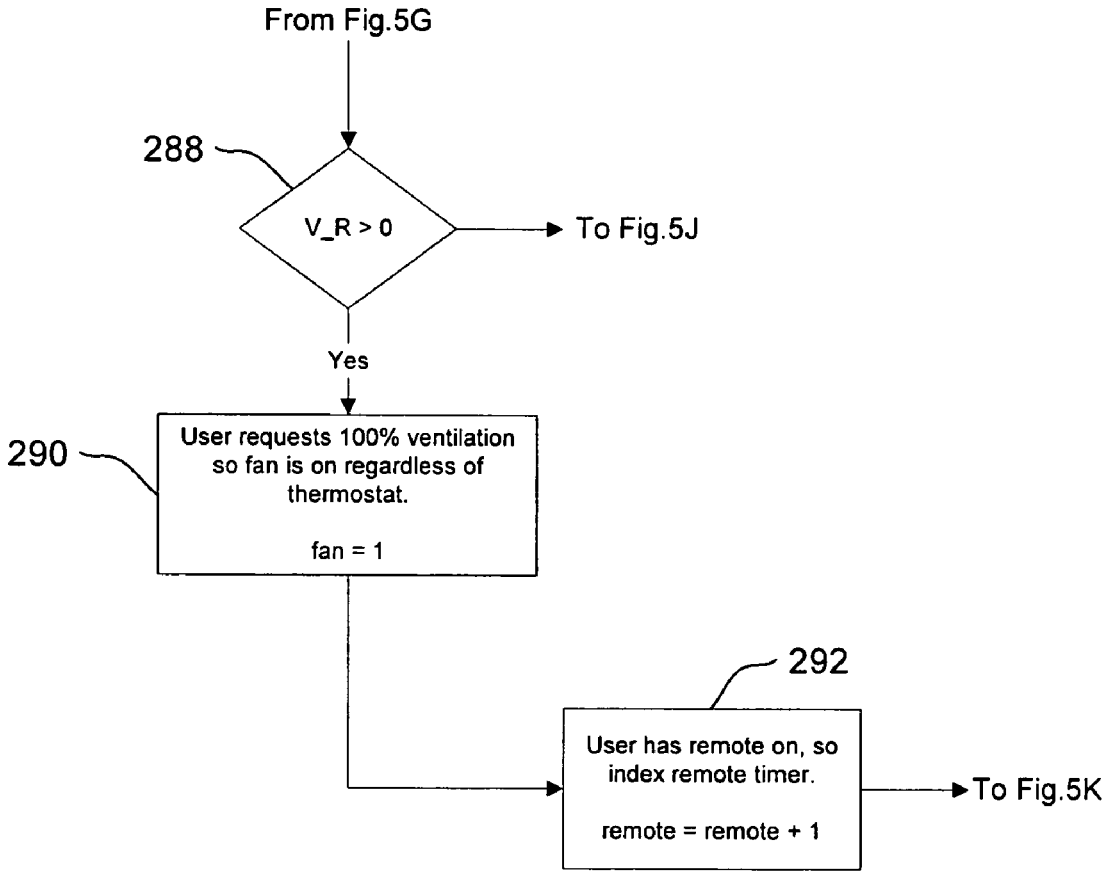
Figure 5J:
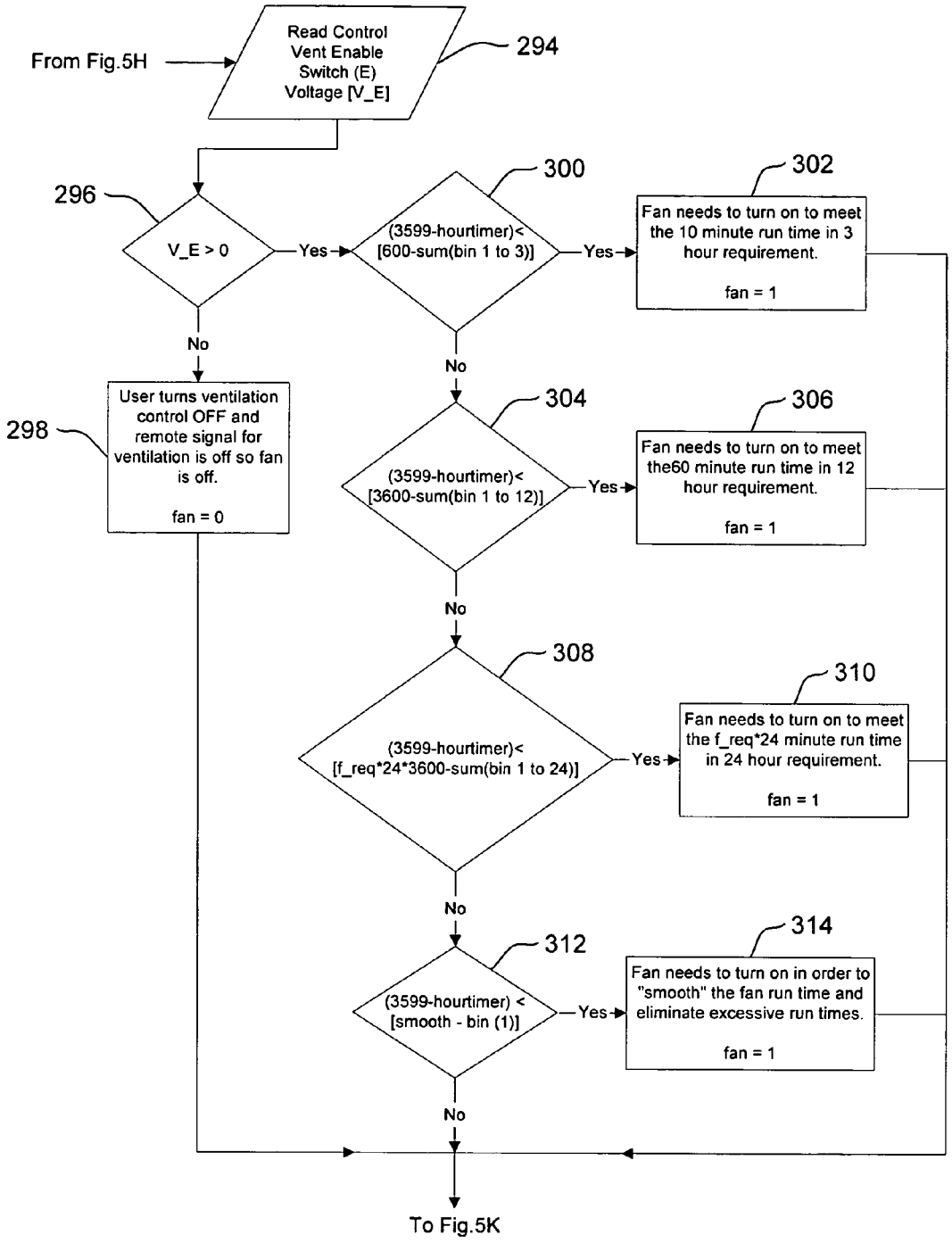
Figure 5K:
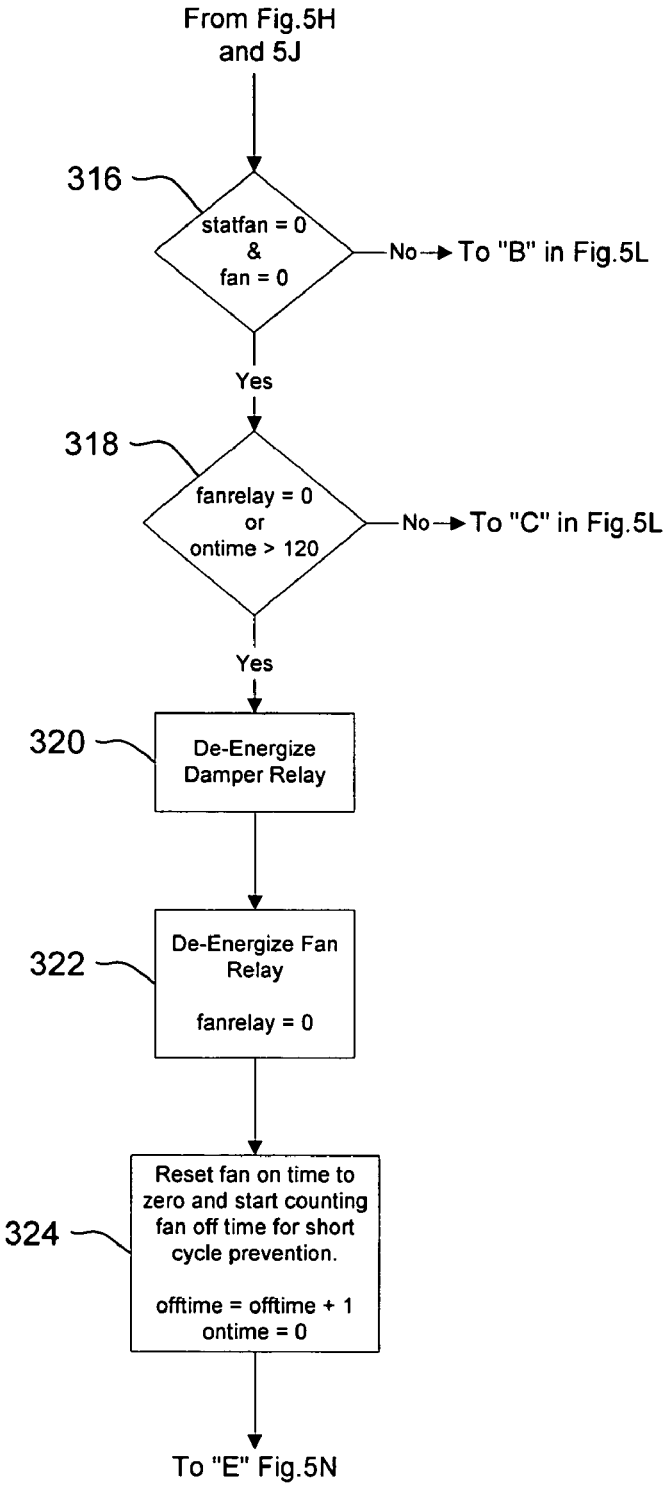
Figure 5L:
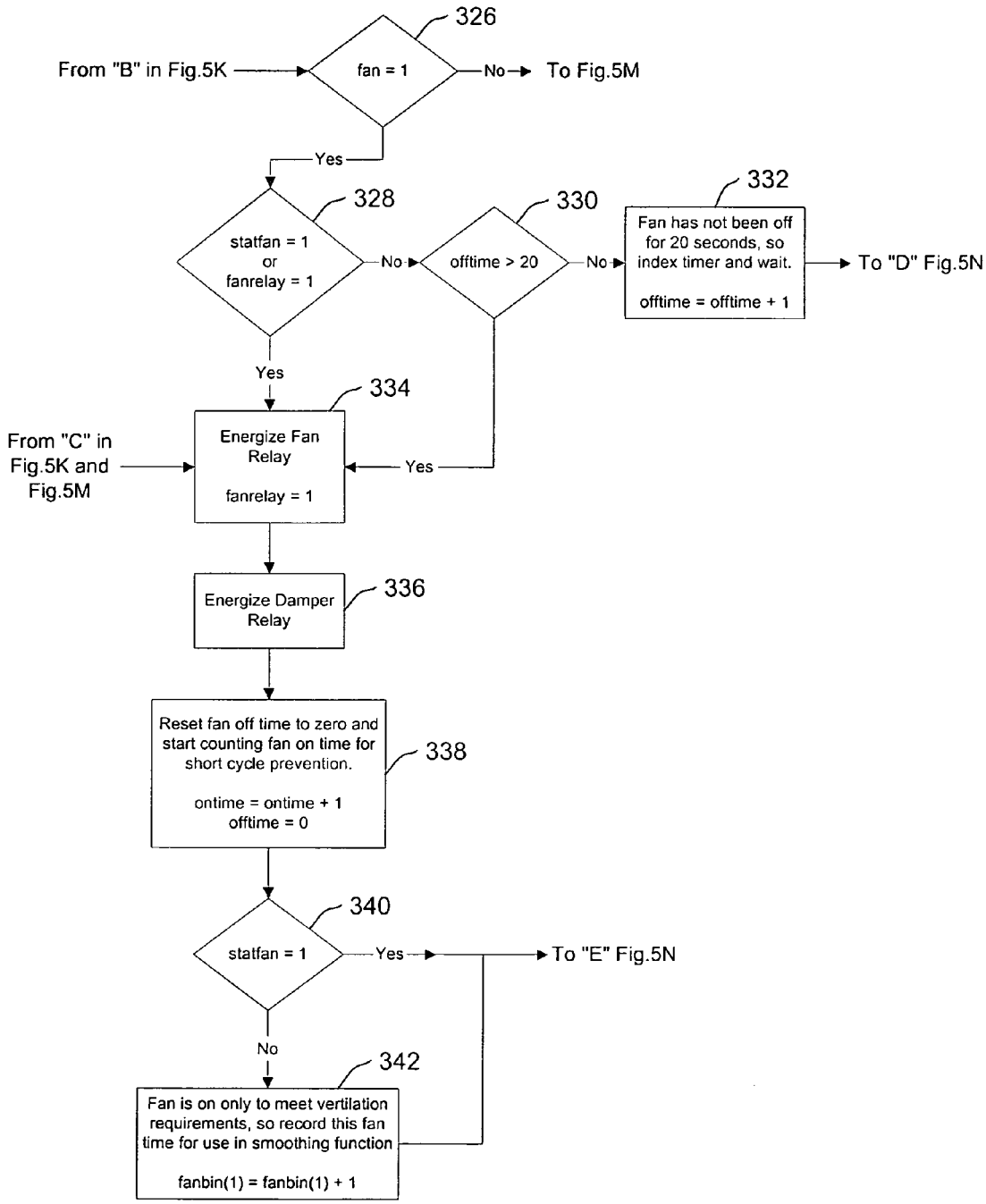
Figure 5M:
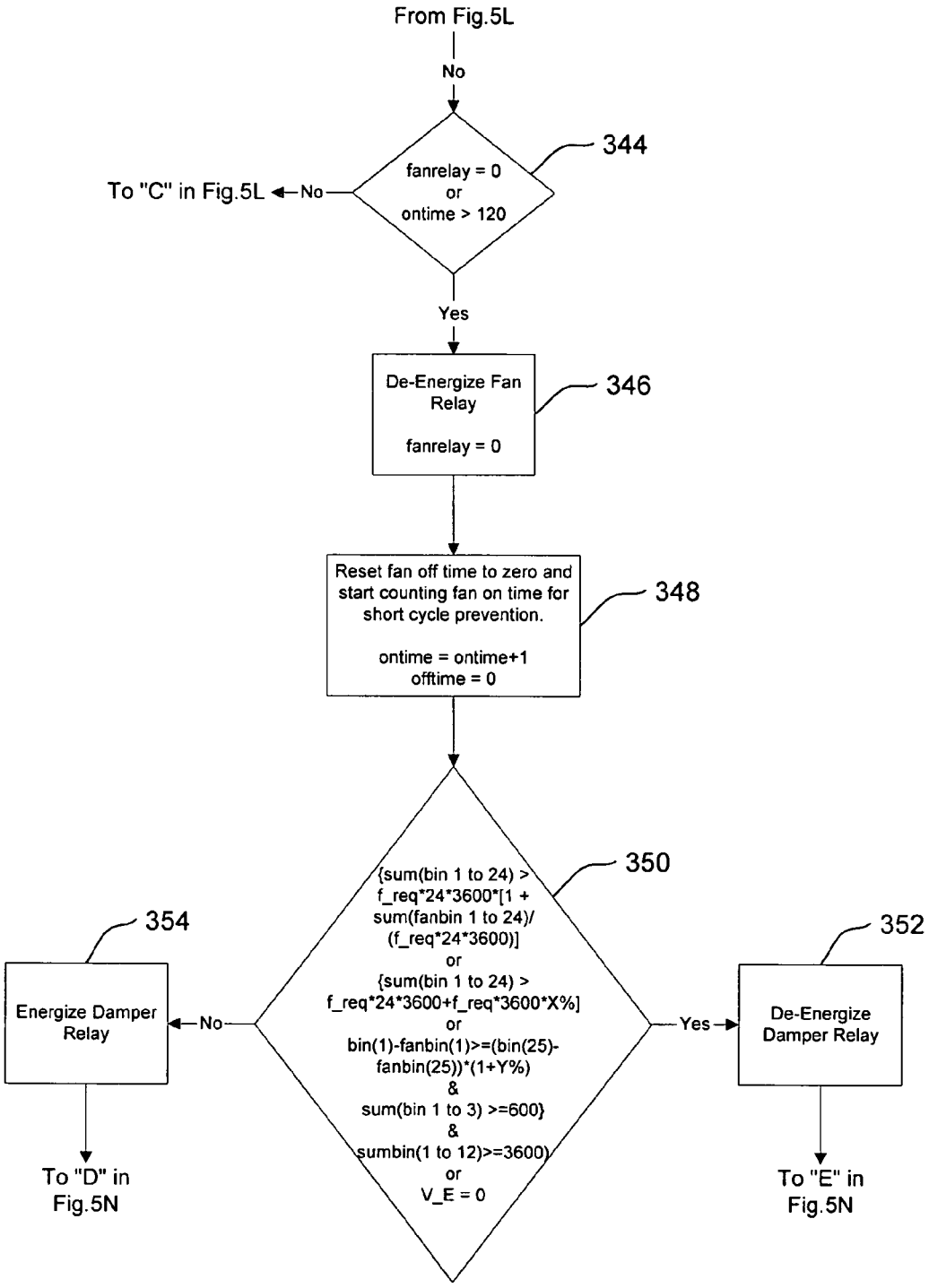
Figure 5N:
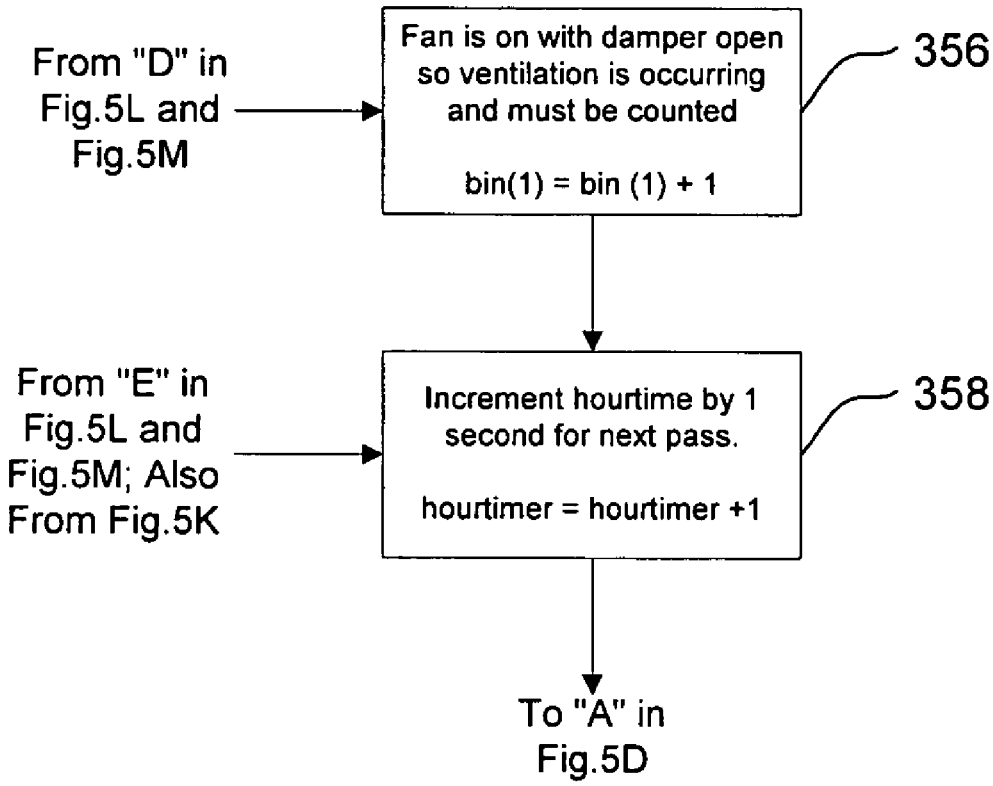

FIGS. 5A–5N show a flow chart of another illustrative method in accordance with the present invention. The illustrative method of FIGS. 5A–5N is a relatively detailed embodiment and includes calculations designed to meet the standards of ASHRAE® Standard 62.2. The values used in the illustrative method of FIGS. 5A–5N correspond to the use of hourly blocks of time and make use of one second sub-blocks of time to perform analysis. Larger and smaller blocks and sub-blocks may be used as desired or needed in different embodiments, and the values shown are merely included for the purpose of illustration.

As shown in FIG. 5A, the method begins when the power is ON. To begin, several input conditions are entered, including the conditioned floor area as shown at 202, the number of bedrooms as shown at 204, and the ventilation rate as shown at 206. The ventilation rate can be input, for example, from a chart or through the use of calculations relating to the particular fan and system, as well as the characteristics of ventilation ducts and the FAV source. The ventilation rate may be in terms of cubic feet of air per minute, for example, though any other suitable measure or units may also be used. For the illustrative embodiment, the desired percent (%) on time (f_des) is calculated from the formula:

$$\text{f_des} = \frac{0.01 * A + 7.5(N + 1)}{Q}$$

Where Q is the ventilation rate in cubic feet per minute, N is the number of bedrooms, and A is the conditioned floor area given in square feet. This formula is used and the result is calculated as shown at block 208.

While f_des is the desired percent on-time, f_req is a required percent on-time for the system operation, as calculated below. Referring now to FIG. 5B, a maximum f_req may be chosen or calculated to prevent overuse or overcycling of an air handler fan, which can reduce the life of the fan. For the illustrative example of FIGS. 5A–5N, a maximum f_req is set to 0.6. As shown at 210, if f_des is less than or equal to 0.6, then f_req is set equal to the calculated f_des at 212 and an LED is set on to indicate power 214. If, instead, f_des is not less than or equal to 0.6, then f_req is set to the maximum allowed value of 0.6 as shown at 216, and the LED flashes to indicate that the desired percent on time is greater than the maximum of 0.6 as shown at 218.

After f_req is set, the system initializes as shown at 220. The initialization step includes providing values for a number of runtime bins (bins). Each runtime bin represents a block of time, for example, an hour of time. In one example, bin(1) represents the total ventilation runtime during a current block of time, and bin(2) represents the total ventilation runtime during the block of time that ended just before the current block of time. If the blocks of time are hours, then bin(1) corresponds to the current hour, bin(2) corresponds to the previous hour, and so on. The twenty-five bins correspond to twenty four completed blocks of time and one incomplete block of time (the current block of time).

Each runtime bin stores a value that represents the total amount of ventilation time occurring during the corresponding block of time. For the illustrative example of FIGS. 5A–5N, hourly blocks of time are used, and the ventilation time is stored in terms of seconds. In order to prevent over-cycling of the system during start up and to give a clean start for the current time block, the bins may be initialized with a value of:

bin(1)=0 for $i$=2 to 25, bin($i$)=3600*$f$_req

By filling the past bins with a value corresponding to the average required value, initial over-cycling is reduced, and a relatively steady state initialization may be achieved.

Referring now to FIG. 5C, a number of fan runtime bins (fanbins) are initialized to zero as shown at 222. The fanbins represent the time that ventilation occurs without any external fan during the block of time corresponding to each fanbin. As with the bins above, there are twenty-five fanbins which, in the illustrative example, each correspond to a one hour block of time. Next, the hour counter is set to zero as shown at 224.

Control starts with the damper closed (if provided) as shown at 226. The "damper" in this case means the FAV damper that controls whether fresh air enters the ventilation system as part of the return air stream (such as, for example, damper 52 shown in FIG. 2). Though any type of damper may be used, in the illustrative embodiment, a damper which closes when the power is turned off is used.

In some embodiments, no damper and/or damper control is provided. In these embodiments, the methods disclosed herein may still provide ventilation control, but over ventilation may occur under some conditions because the fresh air source cannot be selectively closed. In some cases, the controller may still provide damper control signals, but when no damper control is provided, these signals would not be connected to a damper controller. In other embodiments, the controller may simply not provide damper control signals if no damper control is provided.

The control also starts with the fan off as shown at 228. An offtimer is then set to a twenty-one second time period, allowing control to turn on quickly if necessary, as shown at 230. The offtimer is used to indicate how long the fan has been off, and is checked before the fan is activated to prevent short-cycling of the fan.

Referring now to FIG. 5D, the method continues with a determination of whether the hourtimer is greater than or equal to 3600 as shown at 232. This step shown at 232 is simply a determination of whether 3600 seconds, or one hour, have passed in the present analysis. This determination shown at 232 will be false following initialization (In FIG. 5C hourtimer is initialized to zero as shown at 224). When returning from "A" in FIG. 5N, the hourtimer will have been incremented as shown at 358 (FIG. 5N). If hourtimer is less than 3600, the method proceeds to FIG. 5G, as further explained below. It should be noted that the methods illustrated herein are generally designed to operate on controllers having sufficient processing speed to finish each step of a method in less than a second so that the method may be performed once every second, so that the 3600 second time limit for an hour is effective.

Whenever the hourtimer is greater than or equal to 3600, the method resets the time counter, and increments the moving binned information to a new time block. A first step in the time block increment is to reset the time counter to zero by setting hourtimer to zero, as shown at 234. Then the smoothing function time, which is also further explained below, is set to zero as well, as shown at 236. Having set the smoothing function time to zero, a new smoothing function is determined using a number of blocks together in the smoothing process 238. In the illustrative embodiment, the smoothing process 238 begins with a step of running the smoothing function starting at the just completed hour and ending at hour twenty-three, as shown at 240, which increments from i=one to twenty-three by steps of one.

The illustrative smoothing function calculation operates as follows. For each fanbin(i), if the value of the fanbin(i) plus the present smooth value is greater than the average required ventilation time (determined by multiplying f_req by thirty-six-hundred seconds), as shown at 242, then the value of the smooth function time is set to the difference between the smooth function time plus fanbin(i) minus the average required ventilation time, as shown at 246, otherwise the value of the smooth function time is set to zero as shown at 244. This process is summarized as follows:

for $i$=1 to 23, step 1, if [fanbin($i$)+smooth]>$f$_req*3600, then smooth=smooth+fanbin($i$)−($f$_req*3600)

else smooth=0

Figure 8A:
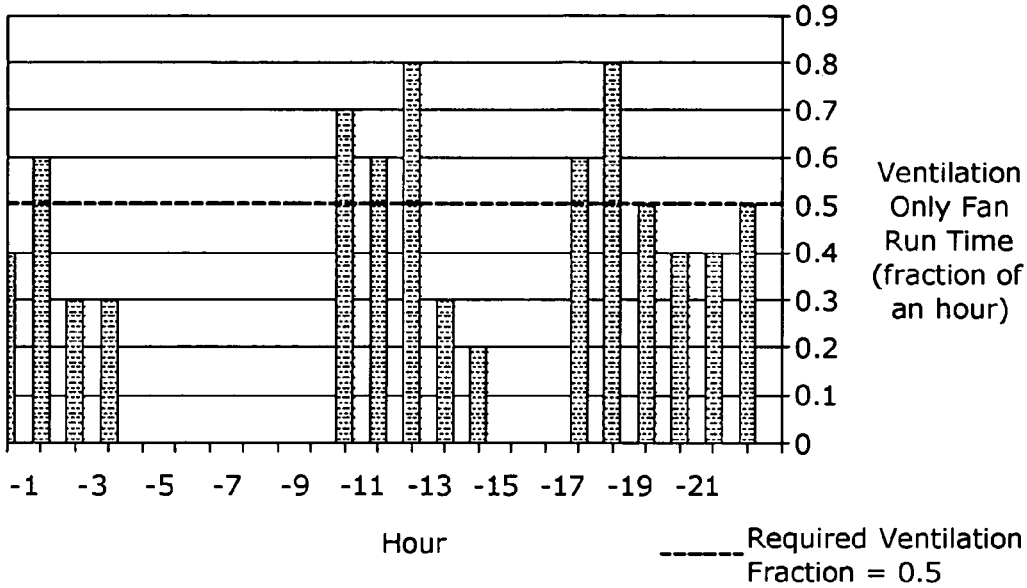
FIGS. 8A–8B are charts showing an illustrative smoothing function in accordance with the present invention.
Figure 8B:
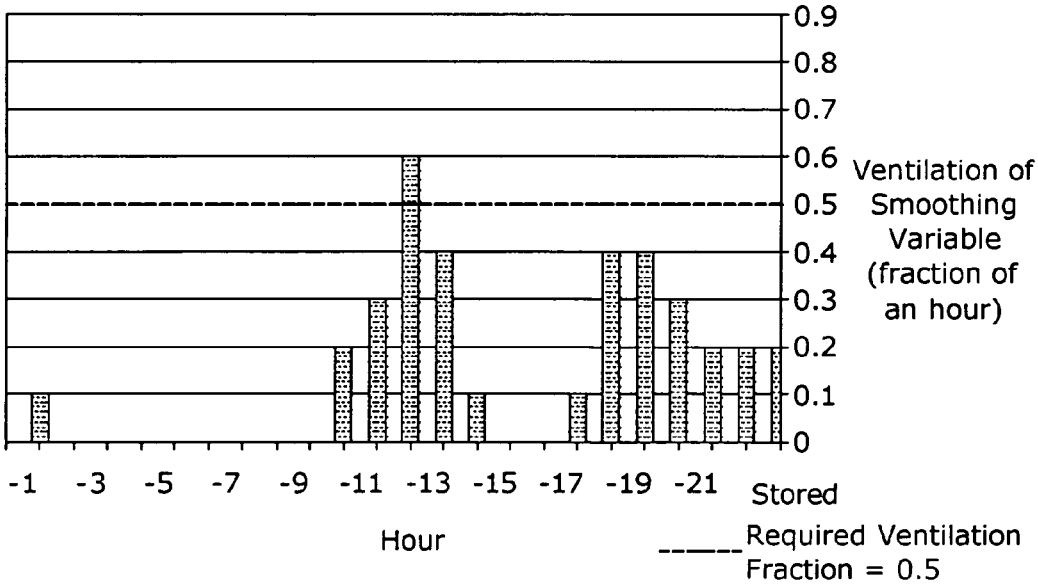

The process repeats until each of the previous twenty-three time blocks are analyzed for the smoothing function calculation, and the smooth loop ends as shown at 248. FIGS. 8A and 8B illustrate another example smoothing function.

Referring now to FIG. 5E, as shown at 250, there is a determination of whether the smoothing function time is greater than the required average ventilation time. If so, as shown at 252, the smoothing function time is set equal to the required average ventilation time to prevent the smoothing function from overcompensating.

Next, the use of a remote ventilation feature that may be included in some embodiments is illustrated. The remote ventilation feature may be a button or switch that enables a user/operator to choose to have the HVAC system operate in a fresh air ventilation mode, regardless of the HVAC or FAV control. For example, a user may turn on the remote ventilation feature and cause fresh air ventilation to occur until the user turns off the remote ventilation feature.

As shown at 254, the remote operation time is compared to the amount of time needed in the previous hour to meet the long term ventilation needs. To determine what ventilation time was needed, first the total ventilation time is determined by adding together the sum of bins two to twenty four. This sum is subtracted from the product of the average ventilation requirement times the number of seconds in an hour and the number of hours in a day. In short, the time required=f_req*24*3600−sum(bin 2 to 24).

If the remote ventilation feature is on longer than was necessary to meet the ventilation requirements in that time period or hour, the values stored in bin(1) and fanbin(1) will be reset to what those values would have been had the remote not been activated. The thermostat run time is first calculated as shown at 256, as in thermo=bin(1)−fanbin(1), where thermostat run time is the total ventilation time minus the non-thermostat call ventilation time (fanbin(1)) for the hour. Then, as shown at 258, bin(1) can be reset to be the amount of total ventilation needed to meet ventilation requirements. Finally the value stored in fanbin(1) is corrected as shown at 260 by reducing the total time in fanbin(1) by the amount of thermostat call time which was calculated as shown at 256.

Having corrected for any remote terminal usage of the fan, the method proceeds to update the total fan run time bins by moving the data from each bin into the next bin so that bin(1) can be used for the next time block, as shown at 262. Turning to FIG. 5F, the method then sets the current bin to zero, preparing for the start of a new hour, as shown at 264. Next, the stored fan only runtimes are shifted to the next bin as shown at 266, and the current fan only runtime bin is set to zero to prepare for the new hour, as shown at 268. Finally, the remote time counter is reset to zero as shown at 270, and the method continues in FIG. 5G.

Turning now to FIG. 5G, the method begins analysis of the present conditions by determining whether the thermostat is calling for fan operation, reading the thermostat fan terminal voltage (V_Gt) at 272 and determining whether V_Gt is greater than zero at 274. If V_Gt is greater than zero, then the thermostat has the fan on so the variable statfan is set to one at 276, indicating that the fan status is on. Otherwise, the method goes on to read the thermostat heat terminal voltage (V_w) at 278 and determines whether V_w is greater than zero at 280. If V_w is greater than zero, then the thermostat has the fan on for heat so, again, statfan is set to one at 282 indicating the fan status is on.

If both voltages are zero, then the thermostat does not have the fan energized and statfan is set to zero at 284. Next, the method reads the remote terminal voltage V_R at 286. The remote terminal is provided to allow a user to select a mode where full ventilation occurs indefinitely, until the user deselects the remote terminal. This allows the user to choose to ventilate the dwelling or other interior space.

Referring now to FIG. 5H, the method continues by determining whether V_R is greater than zero at 288, which would indicate that the remote terminal is activated or selected. If not, the method goes to FIG. 5J; if so, the method continues at 290. With the remote terminal activated, the user has requested ventilation so that the fan is on regardless of the thermostat. Therefore the method sets fan equal to one to indicate the control program wants the fan on, as shown at 290, though it does not change statfan from its zero value because statfan only indicates whether the thermostat is calling for the fan to be on. Because the user has the remote on, the remote time must be indexed at 292. The method then moves to FIG. 5K, as indicated.

Referring now to FIG. 5J, coming from block 288 in FIG. 5H (V_R not greater than zero, so the remote terminal is off), the method moves to reading the control vent enable switch voltage (V_E) at 294 and observing whether V_E is greater than zero. The control vent enable switch is provided to allow the user to choose to turn ventilation control off and prevent ventilation. If V_E is not greater than zero, this indicates that the user has turned ventilation control off and, since V_R is also off, the remote signal is also off, therefore the control program does not want the fan on. To indicate that the control program does not want the fan on, fan is set to zero as shown at 298.

If V_E is greater than zero, ventilation control is enabled and the method moves to determining whether the fan needs to be turned on for ventilation purposes. The illustrative example, as shown in FIG. 5J, makes use of ASHRAE® Standard 62.2 to provide illustrative requirements for the three, twelve and twenty four hour requirements. In every three hours, there is to be at least ten minutes of ventilation, in every twelve hours there is to be sixty minutes of ventilation, and in every twenty-four hours there is to be a ratio of ventilation as calculated in block 208 of FIG. 5A.

As shown at 300, the first step is to determine if the number of seconds left in the present time period is less than the remaining required runtime to meet the three hour requirement. This is determined by subtracting the hour-timer (which has not yet incremented to the next second) from 3599 (the number of seconds in an hour less one to account for the present second). The result is compared to the result of subtracting the total ventilation time for the present hour and the previous two (bin(1)+bin(2)+bin(3)) from the number of seconds of operation that is required for the three hour time period (ten minutes=six hundred seconds). If the comparison shown at 300 results in a yes, then the fan needs to turn on to meet the ten minute run time in three hour requirement, and fan is set to one as shown at 302 to indicate that control wants the fan turned on.

Next, if the three hour requirement is met, and as shown at 304, the method determines if the number of seconds left in the present time period is less than the remaining required runtime to meet the twelve hour requirement. This is determined by calculating the remaining time in the same way as in block 300, and by comparing the result to the difference between one hour (3600 seconds) and the total ventilation time for the present hour and the previous eleven (bins one to twelve). If the comparison at 304 results in a yes, then the fan needs to turn on to meet the one hour run time in twelve hour requirement, and fan is set to one as shown at 306 to indicate the control wants the fan turned on.

Third, if the three and twelve hour requirements are met, and as shown at 308, the method determines if the number of seconds left in the present time period is less than the remaining required runtime to meet the twenty-four hour requirement. This is determined by comparing the remaining time to the difference between the required time (f_req*24*3600) and the sum of bins one through twenty four, as shown at 308. If the remaining time is exceeded by the sum, then the fan needs to turn on to meet the run time in twenty four hour period requirement, and fan is set equal to one, as shown at 310.

Fourth, if the ventilation requirements are met, the remaining time in the present time period is compared to the difference between the smoothing function time value (smooth) and the amount of actual ventilation time in the current time period (bin(1)) as shown at 312. If the time remaining is less than smooth minus bin(1), then the fan needs to turn on in order to smooth the fan run time and eliminate excessive run times, so fan is set to one as shown at 314.

Regardless of the internal steps taken in FIG. 5J, all of these steps lead to the same point, moving the method to FIG. 5K, which also picks up from FIG. 5H as indicated above. First it is determined whether the thermostat has not called for fan operation and the FAV control program has not called for fan operation (statfan=0 AND fan=0) as shown at 316. If either or both condition is a one, the method moves to "B" in FIG. 5L as indicated. Otherwise, the method determines if the FAV is controlling the fan or the fan has been on for at least one-hundred and twenty seconds (fanrelay=0 OR ontime>120) as shown at 318. If the OR function is not true, the method moves to "C" in FIG. 5L as indicated. It should be noted that the value of fanrelay indicates whether the FAV control is allowing thermostat calls for the fan to pass through (fanrelay=0) or the FAV has called for fan operation regardless of thermostat calls (fanrelay=1).

If the OR function returns a true result at 318, the method de-energizes the damper relay (if provided) as shown at 320. This causes the FAV damper (if provided) to close, preventing fresh air from entering. Then, because the FAV control has no need for the fan to be on, the method de-energizes the fan relay (fanrelay=0), which, because statfan=0 meaning the thermostat is not calling for fan operation as shown at 316, turns off the fan. The fan can be turned off without short-cycling because, as shown at 318, the fan ontime is more than two minutes (ontime>120). With the fan now turned off (or already off), the method resets the fan ontime to zero and increments the fan offtime function by one as shown at 324.

Referring now to FIG. 5L, coming from "B", the method determines whether the FAV control program has called for fan operation (fan=1) as shown at 326. If not, the method continues to FIG. 5M. If the FAV control program has called for fan operation, the method continues by determining if either the thermostat has called for fan operation (statfan=1) or the fan is already on (fanrelay=1) as shown at 328. If neither condition is true, the method continues to determine whether the fan has been off for a minimum time of twenty seconds (offtime>20) as shown at 330. If not, the fan has not been off long enough, so the offtime timer is indexed by one as shown at 332 and method moves to "D" in FIG. 5N. This limits short-cycling of the fan.

If the fan has been off long enough or if the OR condition shown at 328 is satisfied, the method energizes the fan relay by setting fanrelay=1 as shown at 334. The fan is also turned on if the method is coming from "C". If the fan was already on, then setting fanrelay=1 at 334 leaves the system operating in the same state it was in. Then the method moves on to energize the damper relay (if provided) as shown at 336.

After the damper relay (if provided) is energized as indicated at 336, the method continues by resetting the fan offtime (the fan is now on, so offtime=0 is set) and indexing or incrementing the fan ontime, as shown at 338. Next the method determines whether there is a thermostat call for the fan (statfan=1) as shown at 340. If so, the method continues to "E" in FIG. 5N. Otherwise, the fan is only on to meet ventilation requirements, so the present fan time should be recorded for use in a smoothing function. Therefore, as shown at 342, the fanbin(1) (the fan bin for the present hour) is incremented.

Referring now to FIG. 5M, coming from FIG. 5L where it is determined at 326 (FIG. 5L) that the FAV control has not requested the fan be on (fan=0), the method determines whether the fan relay is off or the fan has been on for at least a minimum time (fanrelay=0 or ontime>120), as shown at 344. At this point, note that statfan=1 (in 326 (FIG. 5L), fan=0 to get to 344 (FIG. 5M), but to get to 326 (FIG. 5L) the condition in 316 (FIG. 5K) must be false. If the fan relay is on (meaning the fan is on due to FAV control) but has not been on for at least the minimum time period (i.e. both conditions shown at 344 fail), the method continues to "C" in FIG. 5L. If the fan relay is off or has been on for at least the minimum amount of time, the method continues to setting fanrelay to zero as shown at 346, passing fan control to the thermostat. Then, the method resets the fan off time to zero and indexes the fan ontime, as shown at 348.

Coming out of 348, the thermostat has the fan on while the FAV control does not require ventilation. Given that the ventilation requirements are not being broken or violated, it would be possible to simply close the damper (if provided). However, that would fail to take advantage of the fact that the fan is on, which is necessary to actually provide ventilation.

Instead of simply closing the damper (if provided), the method moves to a determination of whether the FAV damper (if provided) should be opened to allow ventilation or closed to prevent overventilation. Overventilation may lead to inefficient heating, cooling, humidification, or drying, because the outside or fresh air may not be at the same temperature or humidity as that desired inside and may require conditioning. As shown at 350, there are four conditions that may lead to the damper (if provided) being closed, and if all four conditions fail, the damper is opened.

The first condition is:

$$\text{sum}(bin(1.\ \text{to}\ .24)) > \text{f_req} * 24 * 3600 * \left[1 + \frac{\text{sum}(fanbin(1.\ \text{to}\ .24))}{\text{f_req} * 24 * 3600}\right]$$

The first condition thus compares the ventilation during the previous twenty-four time blocks to the product of the required ventilation and a predictive over-ventilation number. The predictive over-ventilation is calculated by dividing the sum of the FAV controlled ventilation (i.e. ventilation occurring without a thermostat call) by the required total ventilation. The FAV controlled ventilation from the previous twenty four time blocks provides an indication of whether extra ventilation in the present time block may reduce the need for FAV controlled ventilation, which is inherently inefficient because the fan is on only for ventilation.

The second condition is:

$$\text{sum}(\text{bin}(1.\text{to}.24)) > f_\text{req}*24*3600 + f_\text{req}*3600*X\%$$

This condition provides a hard cap to overventilation in a twenty four hour period. The value of X may be preset or may be entered by a user. In one embodiment, X may be about 5%, though any value may be used, as desired. Using 5%, then the overventilation for the twenty-four hour period would be limited to five percent of the ventilation required in a single hour (3600 seconds).

The third condition is:

$$bin(1)-fanbin(1)>(bin(25)-fanbin(25))*(1+Y\%)$$

This condition compares the fan operations of the present hour with those from the past, in particular (using one hour time blocks) a full day ago. Y is a value that may be entered by a user as an hourly overventilation factor. This limits the hourly overventilation to Y % of the ventilation that occurred the same time the day before.

The fourth condition checks whether V_E is zero. If V_E is zero, the user has turned off the FAV control manually. This means the user has selected to have no ventilation occur.

If any of the four conditions shown at 350 occur, then the method de-energizes the damper relay (if provided) as shown at 352, and no ventilation occurs. From 352 the method moves to "E" in FIG. 5N. Otherwise, the method energizes the damper relay (if provided) as shown at 354, and goes on to "D" in FIG. 5N.

Referring now to FIG. 5N, if the method is from "D" in FIG. 5L or FIG. 5M, the fan is on with the damper (if provided) open so ventilation is occurring and is counted by incrementing bin(1), as shown at 356. In all cases, the hourtimer is incremented as shown at 358, regardless of whether the method comes from "D" (ventilation occurring) or "E" (no ventilation occurring). The method then goes back to "A" in FIG. 5D.

FIGS. 6A–6F show a flow chart of yet another illustrative method in accordance with the present invention. The flow chart of FIGS. 6A–6F makes reference to a number of terminals on thermostats and fan boards. Illustrative configurations and connections of such terminals are shown below in FIGS. 9A–9E.

Figure 6A:
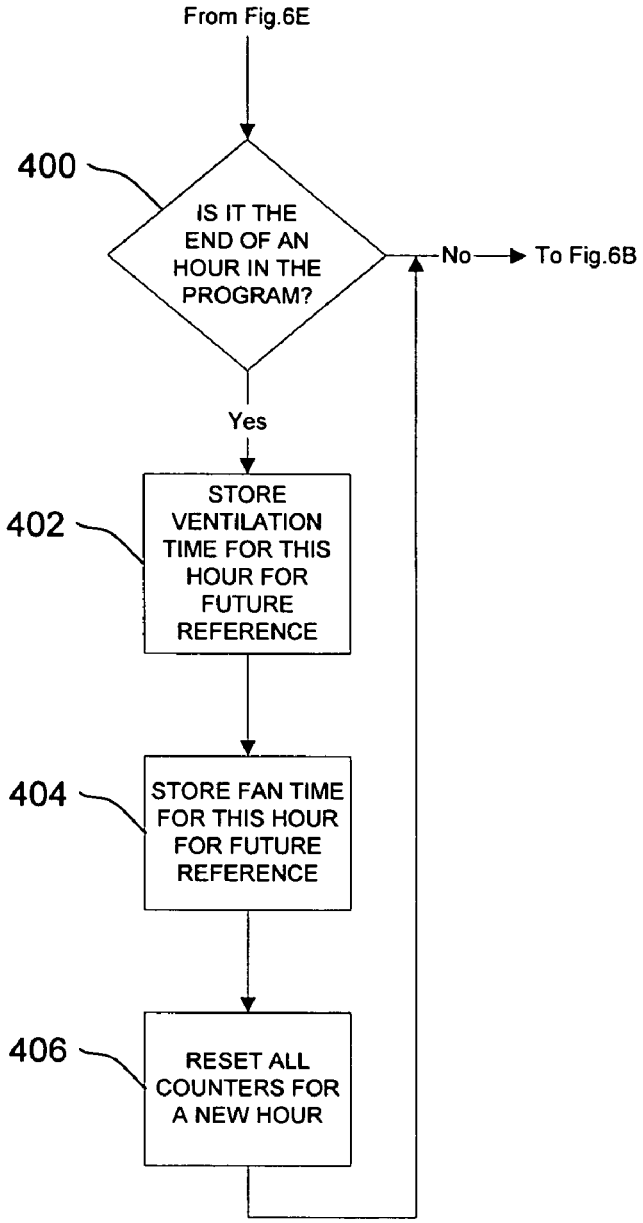
FIGS. 6A–6F show a flow chart of yet another illustrative method in accordance with the present invention.

Referring to FIG. 6A, as shown at 400, the method checks whether the end of a block of time (an hour) is occurring. If so, then the method prepares to start a new hour. First, as shown at 402, the method stores the ventilation time for the expiring hour. Then, as shown at 404, the method includes storing the fan time for the expiring hour. Finally, the method includes resetting all counters for a new hour to begin, as shown at 406. The method then goes to FIG. 6B.

Figure 6B:
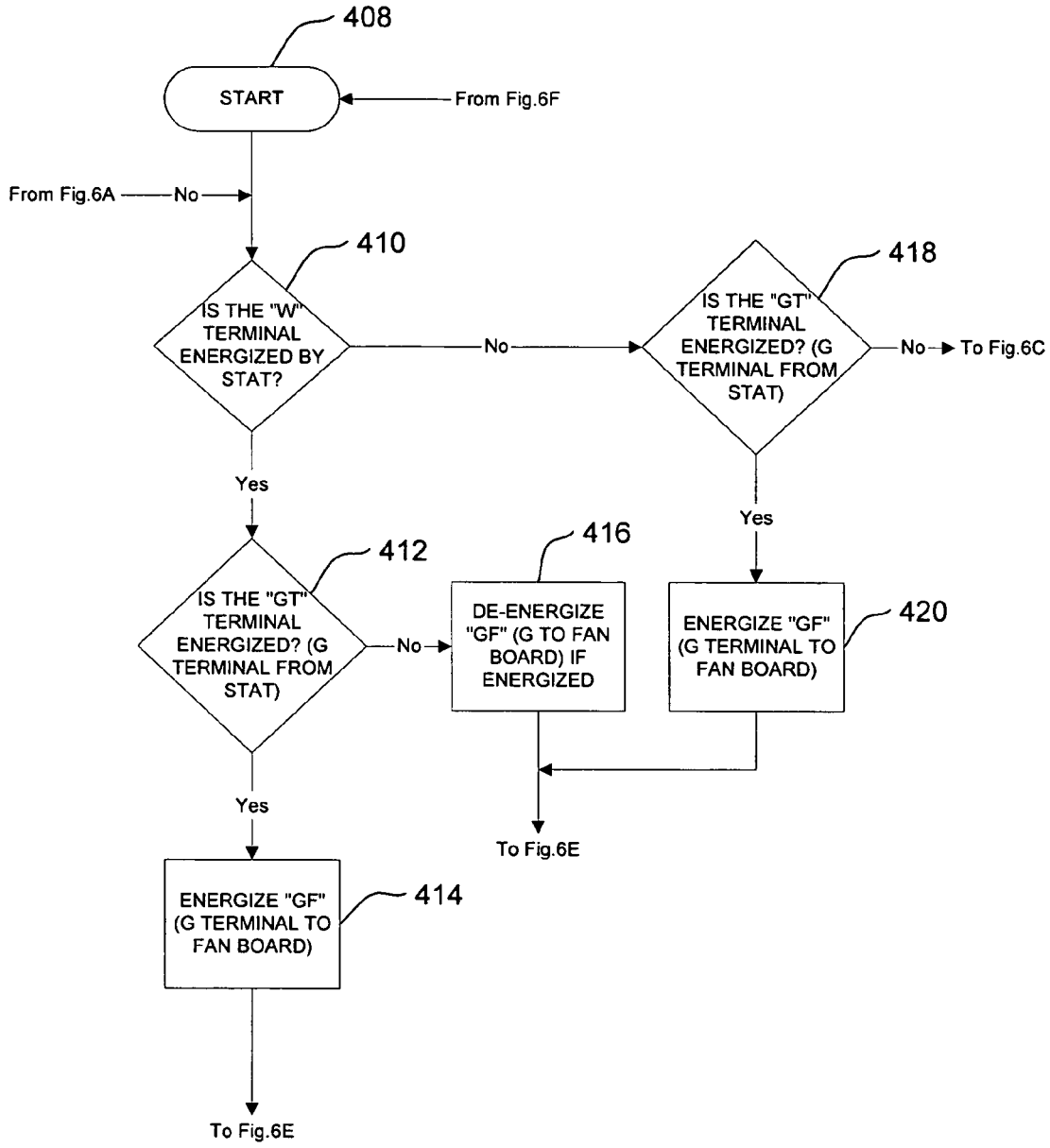

FIG. 6B includes a start block 408 that is the point in the method where, after a user inputs values at block 407. These input values may be used to determine or set the ventilation requirement as a desired percent of on time, the method begins. An illustrative set of inputs is shown in FIG. 6F. Coming from the start block 408 or from FIG. 6A, the method includes checking whether the W terminal is energized by the thermostat (stat), as shown at 410. This determines whether there is a heating signal from the thermostat. If there is a heating signal from the thermostat, the next step is to check whether the thermostat is calling for fan operation by checking whether GT is energized as shown at 412. If the thermostat is calling for fan operation, the method then energizes GF, which is coupled to the G terminal on the fan board, as shown at 414. This turns the fan on. From 414 the method continues in FIG. 6E. If, instead, the GT terminal is not energized, the method goes from block 412 to 416, where it de-energizes GF, if GF was previously energized. This turns the fan off.

If there is no heating signal from the thermostat as checked at 410, the method determines whether there is a fan signal from the thermostat by checking GT as shown at 418. If there is no thermostat call for the fan, the method continues in FIG. 6C. If the thermostat is calling for a fan signal, the method includes energizing GF as shown at 420, turning the fan on. From either of 416 or 420, the method continues in FIG. 6E.

Figure 6C:
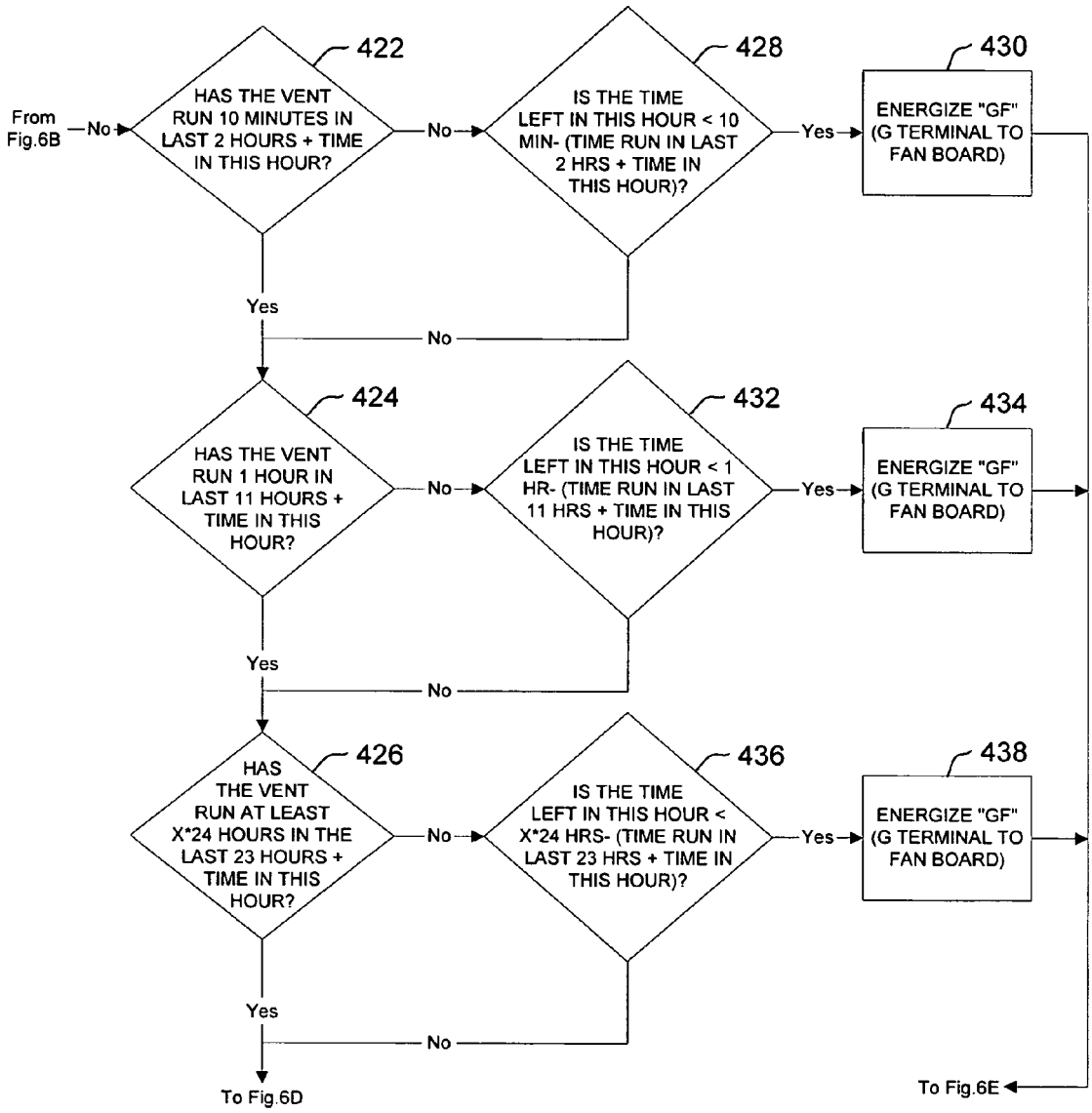

If the thermostat is not calling for heating or the fan (GT and W are not energized), the method continues at FIG. 6C from FIG. 6B. As shown at 422, the method includes determining whether the fresh air ventilation has run ten minutes in the last two hours plus the present hour. If so, then the three hour ventilation requirement has been met. The method continues at 424 by determining whether the fresh air ventilation has run for an hour in the last eleven hours plus the present hour. If so, then the twelve hour ventilation requirement has been met as well. The method continues at 426 by determining whether the fresh air ventilation has run at least X*24 hours in the last twenty-three hours and the present hour, where X is the required twenty four hour ventilation on percentage. If each condition has been met, then all ventilation requirements are met and the method goes to FIG. 6D.

If the three hour requirement checked at 422 is not met, then the method goes to 428 to determine whether the time left in the present hour is less than the amount of ventilation time required to meet the three hour ventilation need. If so, then the method energizes GF, turning on the fan, as shown at 430, and continues in FIG. 6E. If not, then the method goes back to check whether the twelve hour requirement is met at 424.

If the twelve hour requirement checked at 424 is not met, the method goes to 432 to determine whether the time left in the present hour is less than the ventilation time required to meet the twelve hour ventilation need. If so, then the fan is turned on by energizing GF, as shown at 434. The method then moves to FIG. 6E. If the condition in 432 fails, the method goes on to determine whether the twenty-four hour requirement is met at block 426.

If the twenty four hour requirement is not met at 426, the method determines whether the time left in the present hour is less than the ventilation time needed to meet the twenty four hour requirement, as shown at 436. If so, then the fan is turned on by energizing GF as shown at 438. Otherwise, the fan need not be turned on, and the method goes to FIG. 6D.

Figure 6D:
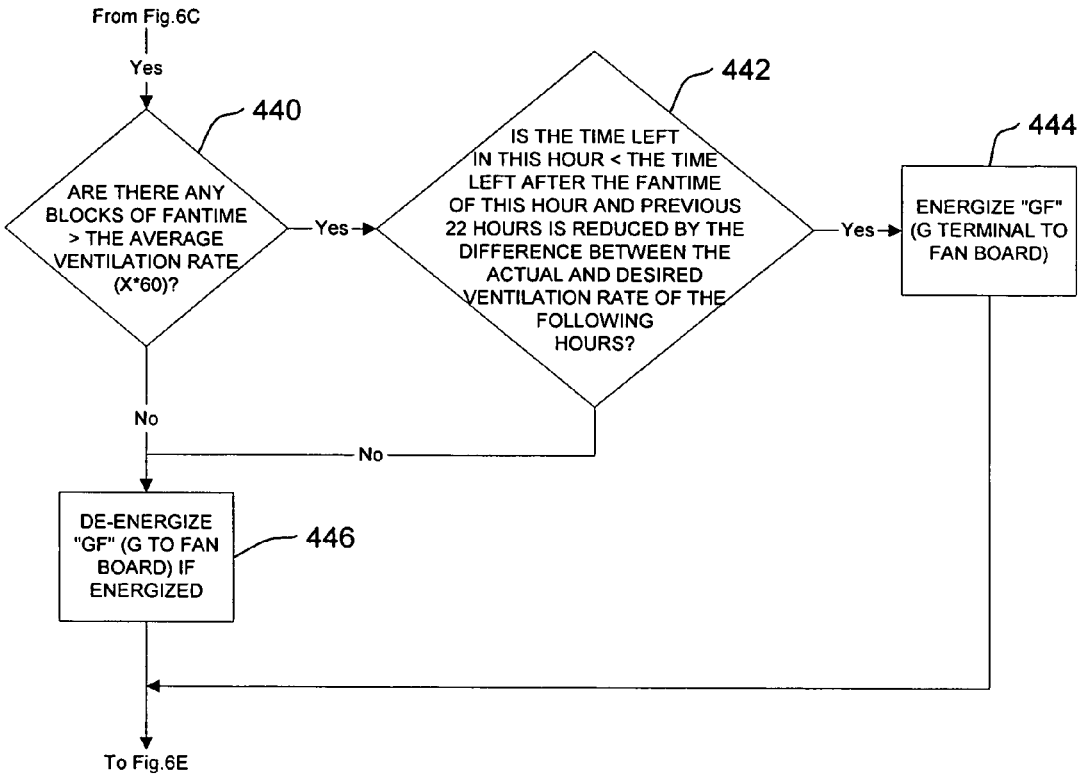

FIG. 6D relates to an illustrative smoothing function. As shown at 440, the method determines if there are any blocks of time where the fantime (the time during which the fan is operated to meet ventilation only requirements) exceeds the average ventilation rate for a block of time. If so, then the smoothing function can be used to reduce the occurrence of such over-ventilated blocks of time. As shown at 442, the method determines if the time left in the present hour is less than the time left after the fantime of the present hour and the previous twenty-two hours is reduced by the difference between the actual and desired ventilation rates of the following hours. An illustrative smoothing function is explained in greater detail below with reference to FIGS. 8A–8B. If the condition of 442 is met, the method turns on the fan by energizing GF, as shown at 444. Otherwise GF is de-energized as shown at 446, which is also the case if there are no over-ventilated time blocks as determined at 440. When the smoothing function is complete, the method goes to FIG. 6E.

Figure 6E:
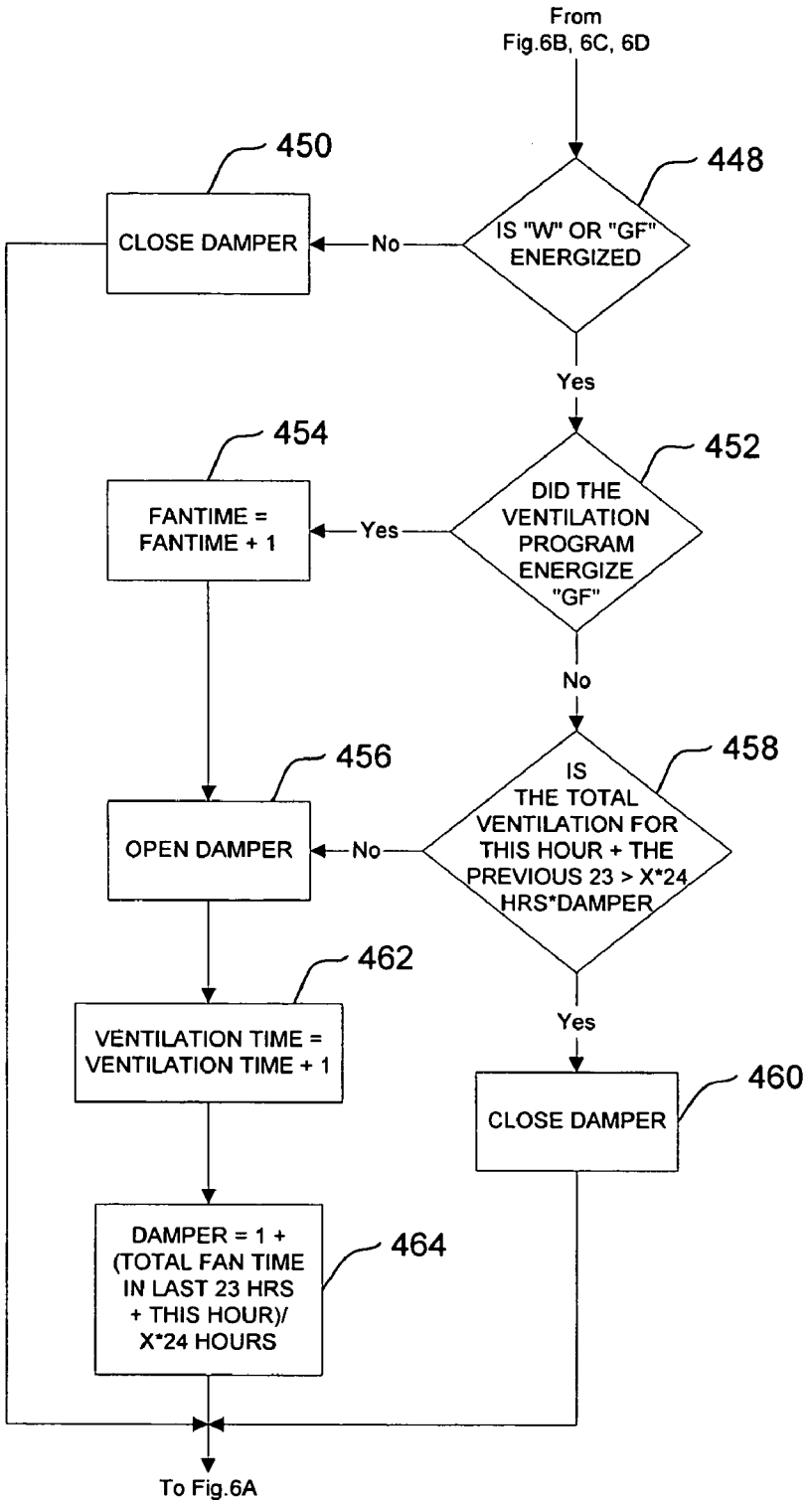
Figure 6F:
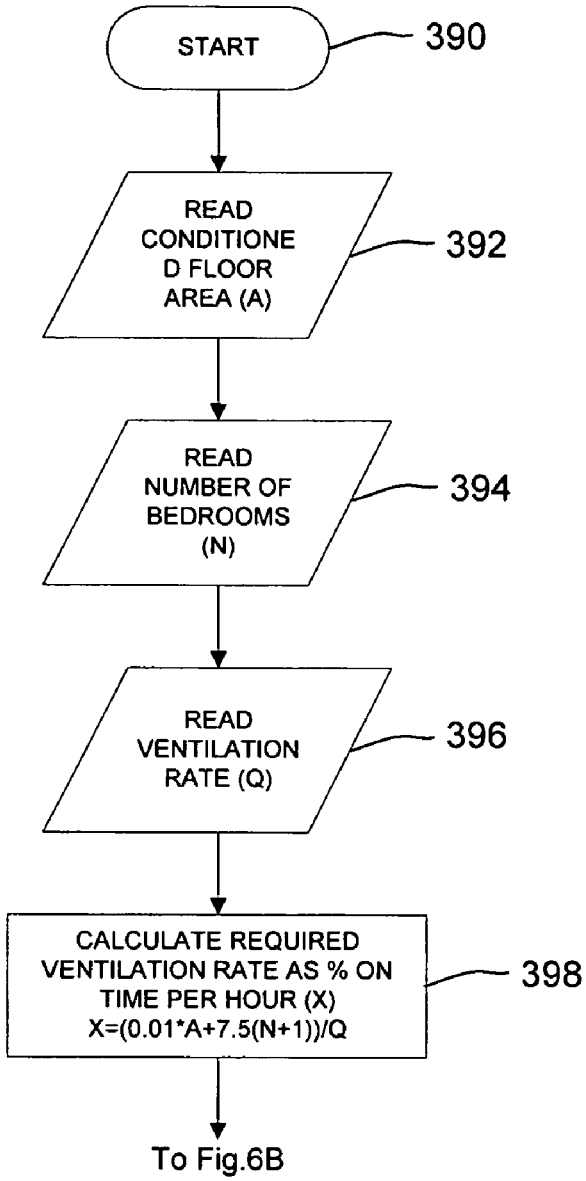

In FIG. 6E, the method initially checks if W or GF are energized, which would indicate a thermostat call for heat or that the ventilation control (either independently or due to a thermostat call) has the fan on, as shown at 448. If neither condition is true, then the method closes the damper (if provided) as shown at 450, and returns to FIG. 6A.

If at least one of W or GF is energized, the method determines whether the ventilation program energized GF, as shown at 452. If so, then the fantime is incremented as shown at 454, and the damper (if provided) is opened as shown at 456. If the ventilation program did not energize GF at 452, the method continues to 458. The method determines whether the total ventilation for the present hour and the previous twenty-three is greater than the required twenty-four hour ventilation time multiplied by "damper" which is an overventilation limiting variable, as shown at 458. If so, then the damper (if provided) is closed as shown at 460 and the method returns to FIG. 6A.

If the twenty-four hour ventilation requirement plus the allowable over-ventilation calculated in 464 has not been exceeded, the method opens the damper (if provided) as shown at 456. With the damper (if provided) open, the method then increments the ventilation time as shown at 462. Then the variable referred to as "damper" is set to equal one plus the total fan time in the last twenty three hours plus the present hour, divided by the required twenty four hour ventilation time, as shown at 464. The fractional portion of "damper" represents the amount of time of over-ventilation that is needed to eliminate any need for the ventilation program to turn the fan on when the thermostat is not calling for fan usage. The method then returns to FIG. 6A.

FIG. 6F illustrates a number of user inputs and a calculation of a ventilation rate desired. In particular, from a start block 390, the method reads conditioned floor area A, as shown at 392. Then the method reads the number of bedrooms N in the space as shown at 394. Next, the method includes reading the ventilation rate Q of the associated HVAC system, as shown at 396. Finally, as shown at 398, the method calculates a desired ventilation rate as a percentage on time per hour, denoted X, from the following formula:

$$X = \left[\frac{0.01 * A + 7.5 * (N + 1)}{Q}\right]$$

Having computed the desired ventilation rate as a percentage on time per hour, the system then moves to the method as shown above.

FIGS. 7A–7E show a flow chart of another illustrative method in accordance with the present invention. The flow chart of FIGS. 7A–7E is adapted to meet ASHRAE® Standard 62-1999, rather than ASHRAE® Standard 62.2. As illustrated in greater detail below in FIGS. 10–12, the methods of FIGS. 6A–6F and 7A–7E may be incorporated into a single large method that enables a user to select form a number of possible ventilation standards to use as ventilation goals.

Figure 7A:
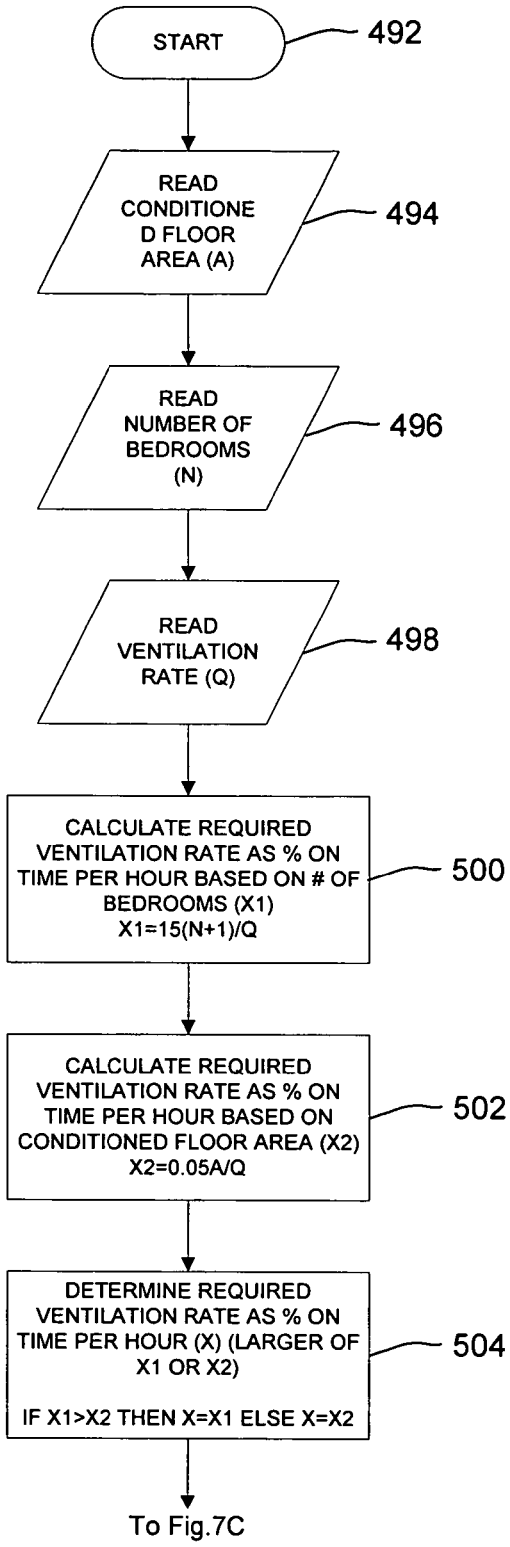
FIGS. 7A–7E show a flow chart of another illustrative method in accordance with the present invention.

The method begins in FIG. 7A at a start block 492. Following the start block 492, the method begins by reading the conditioned floor area A, as shown at 494. Then the method includes reading the number of bedrooms N, as shown at 496. Next the method includes reading the ventilation rate as shown at 498. These steps 494, 496, 498 may call for a user or technician input, as desired.

Next the method determines two possible desired ventilation rates. First, the method calculates the desired ventilation rate as determined from the number of bedrooms (X1), as shown at 500. This step uses the following formula:

$$X1 = \left[\frac{15 * (N + 1)}{Q}\right]$$

Next the method determines a desired ventilation rate as determined from the conditioned floor area (X2) as shown at 502. This step uses the following formula:

$$X2 = \left[\frac{0.05 * A}{Q}\right]$$

The method continues by determining which of X1 and X2 is larger, as shown at 504. If X1 is the greater value, then the method continues by setting X (the desired percentage on time) equal to X1, otherwise the method continues by setting X equal to X2. The method continues from what is basically a start-up block of functions shown in FIG. 7A by going to step 510 in FIG. 7C.

Figure 7B:
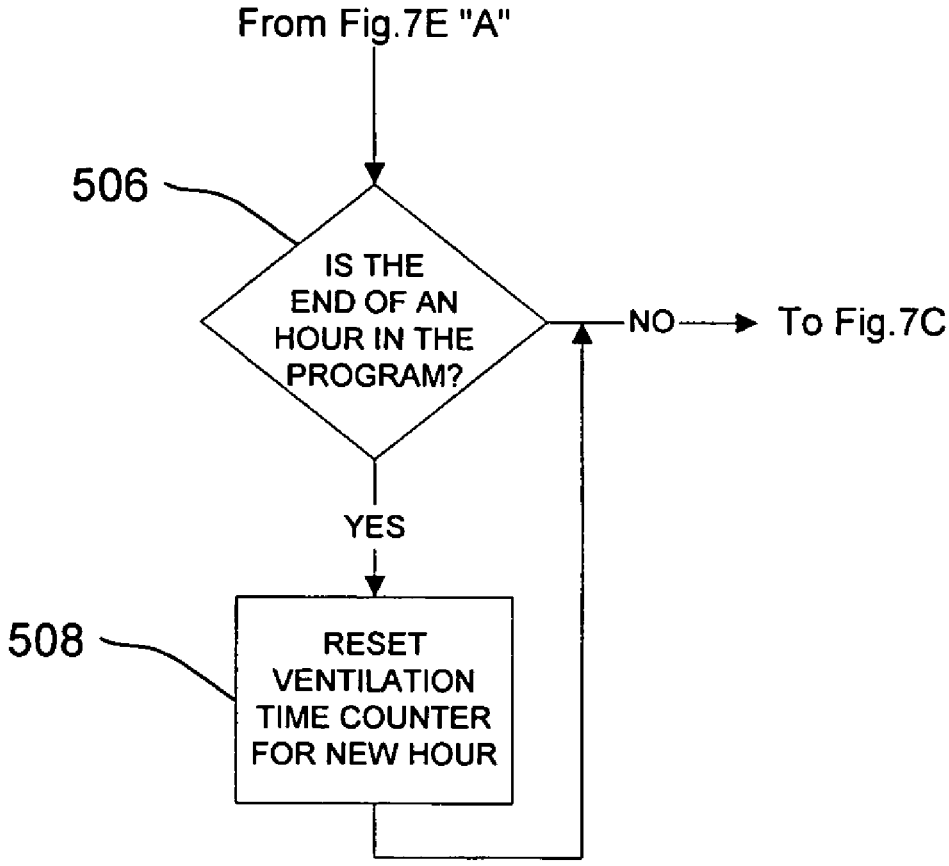

In case the method is in a continuing operation mode, rather than start up, the method begins in FIG. 7B. Returning from A (the point where the method loops back to FIG. 7B from FIG. 7E), the method determines whether it is the end of an hour in the program, as shown at 506. If so, the method resets the ventilation time counter to begin a new hour, as shown at 508. Once the ventilation time counter is reset, the method goes to step 510 in FIG. 7C. If it is not the end of an hour in the program when the check is performed at block 506, the method goes directly to step 510 in FIG. 7C.

Figure 7C:
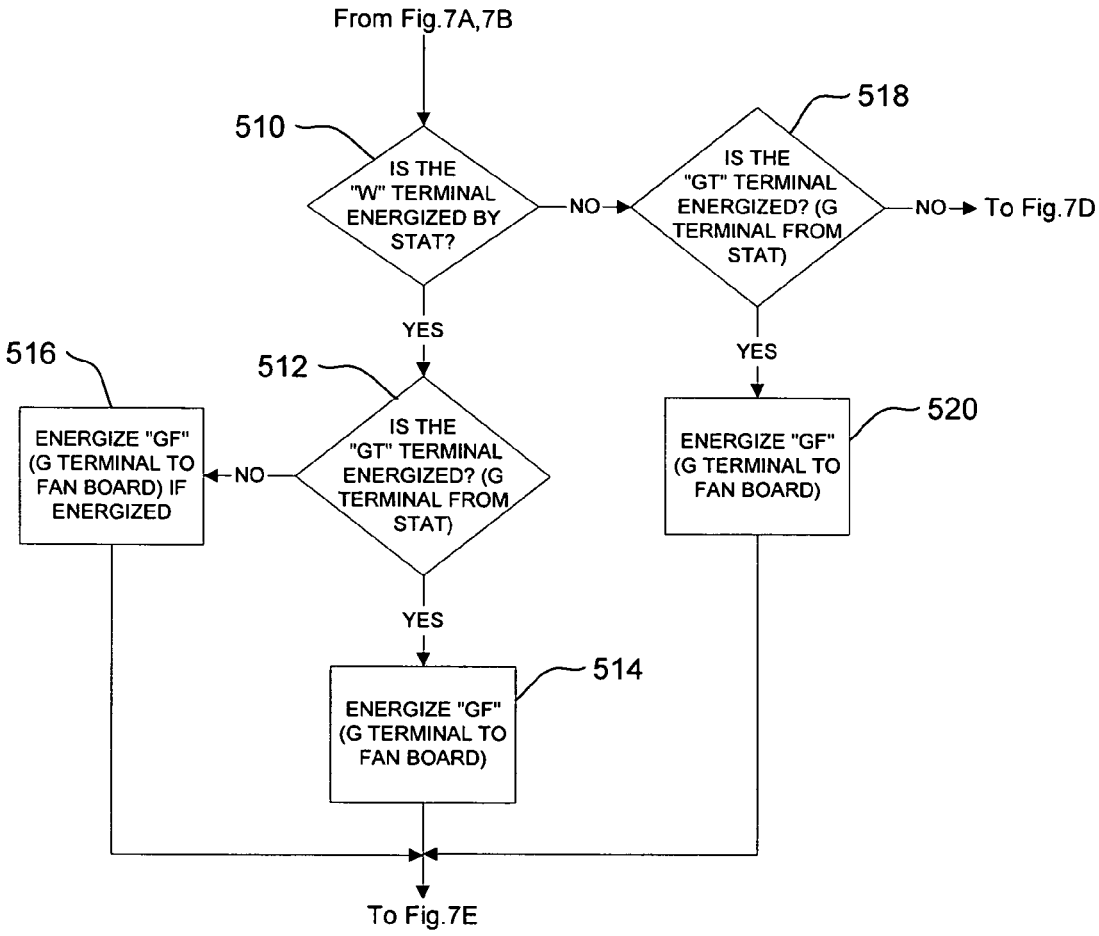

From either FIG. 7A or 7B, the method moves to FIG. 7C. As shown at 510, the method determines whether the W terminal on the furnace board has been energized by the thermostat, indicating a call for heat. If so, the method goes to determine whether the Gt terminal has been energized by the thermostat, i.e. if there is a call for fan operation, as shown at 512. If there is a call for fan operation then the Gf terminal is energized, as shown at 514, sending a fan on signal to the furnace fan board. On the other hand, if there is no call for fan operation at Gt, then the method includes de-energizing the Gf terminal if it is energized, as shown at 516.

In the event the W terminal is not energized (note the W terminal is merely tapped by the controller, so that a call for heat from the thermostat goes directly to the furnace board), the method determines whether the Gt terminal is energized as shown at 518. If so, then the method includes energizing the Gf terminal to send a fan-on signal to the furnace fan board, as shown at 520. From any of boxes 514, 516, 520, the method continues with block 548 in FIG. 7E.

Figure 7D:
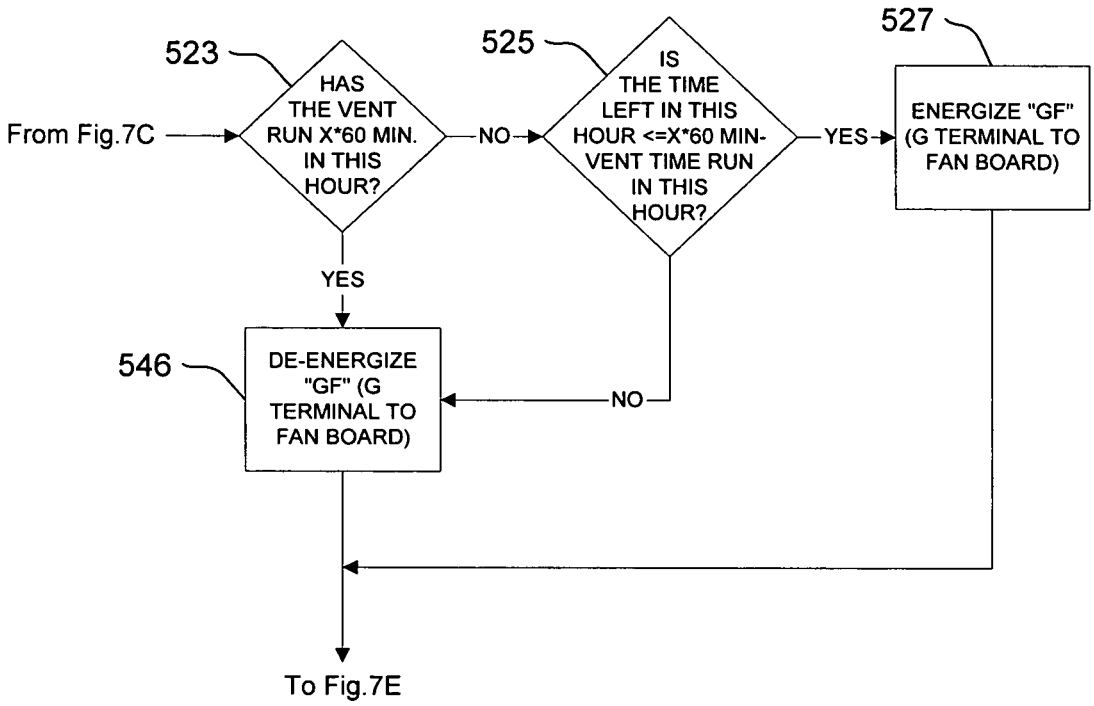

If the result from block 518 is negative, the method continues with block 523 in FIG. 7D. At block 523, the method determines whether the vent has run a predetermined lower limit (X*60) during the present hour. If not, then the method determines whether the fan must turn on to meet the lower goal by checking the following equation:

$$\text{Time.Left.in.this.Hour} \leqq (X*60) - \text{Vent.Time.in.this.Hour}$$

If the time left in the present hour is less than or equal to the remaining time needed to meet the ventilation goal, then the method includes energizing the Gf terminal, sending a fan-on signal to the furnace fan board, as shown at 527. Otherwise, the method goes to block 546 where Gf is de-energized. Likewise, if the result from block 523 is positive and the ventilation goal has been met for the present hour, the method goes to block 546 to de-energize Gf. Again, after either of blocks 527 or 546, the method continues with block 548 in FIG. 7E.

Figure 7E:
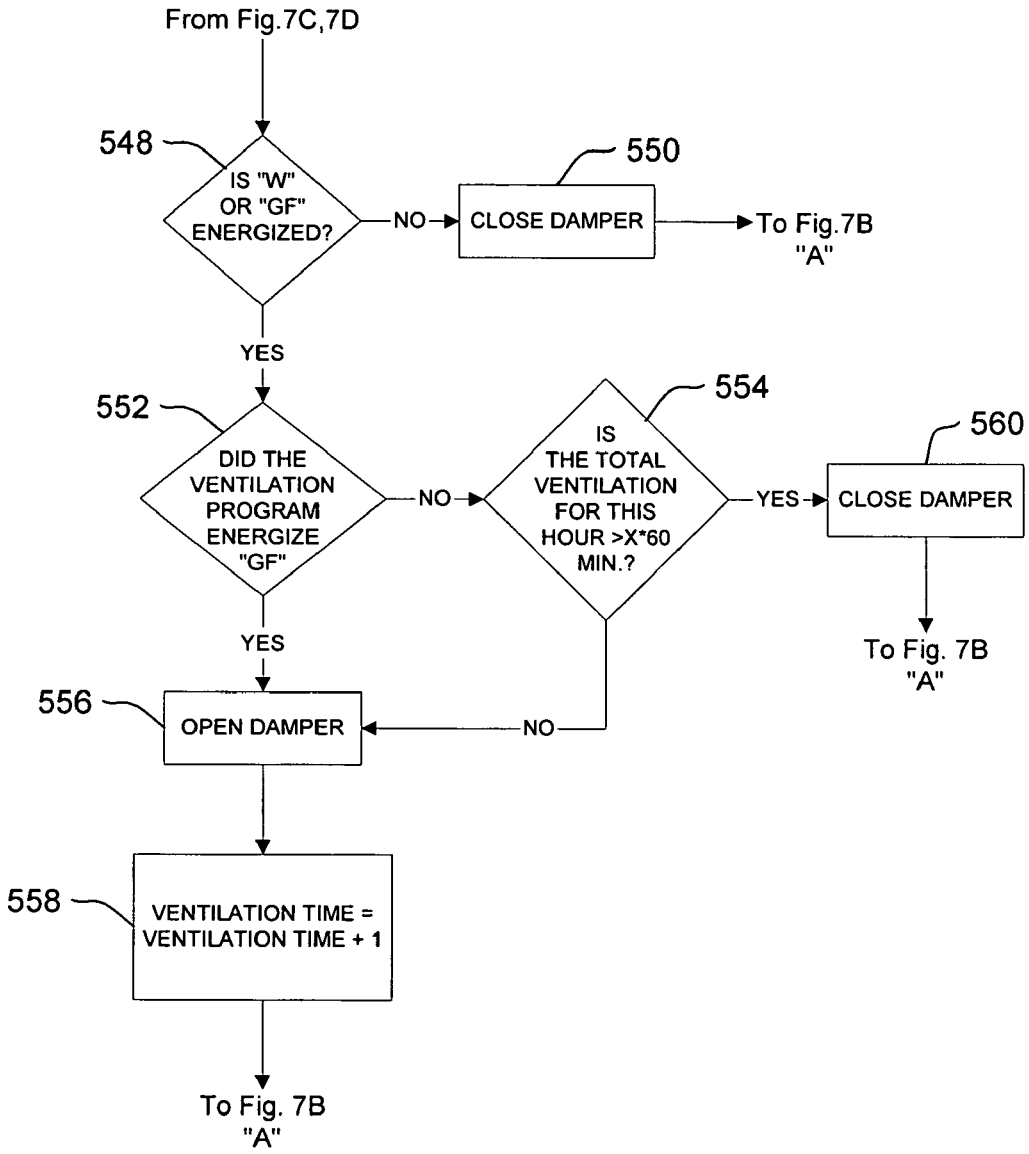

In FIG. 7E, block 548 determines whether W or Gf is energized. If not, the method closes the damper 550 (if provided), and goes to A, which takes the method back to A in FIG. 7B. Otherwise, the method determines whether the ventilation program itself energized Gf (i.e. from block 527). If so, the method opens the damper (if provided), as shown at 556. Otherwise the method determines if the total ventilation for the present hour is greater than X*60 minutes, as shown at 554. If not, then the method opens the damper (if provided), as shown at 556. If the damper is open and the fan is on, the ventilation time is updated as shown at 558, and control is passed to "A" in FIG. 7B. Referring back to step 554, if the total ventilation for the present hour is greater than X*60 minutes, the method closes the damper (if provided) as shown at 560 to prevent over-ventilation. Control is then passed to "A" in FIG. 7B.

FIGS. 8A–8B are charts showing an illustrative smoothing function in accordance with the present invention. Starting at the current hour, the illustrative smoothing function begins to work backwards in an analysis of the ventilation history. An illustrative ventilation fraction of 0.5 is chosen for the purpose of use in the chart, though the actual fraction for a given space may depend on a number of factors such as those of ASHRAE® Standard 62.2, or those specified by a user, as desired.

Beginning at the current hour, for each previous hour, the method of calculating the smoothing function observes how much time the ventilation fan and damper were operated solely to meet the ventilation requirements. An example reason why the fan would run longer than the ventilation fraction is that the ventilation fraction of 0.5 is a long term (for example full day) average ventilation fraction, while other shorter term ventilation requirements (such as 3-hour and 12-hour requirements) may also need to be met. When meeting a shorter term ventilation requirement, the average requirements may be exceeded for a given hour or other time block. Likewise, when thermostat calls occur and ventilation is performed while the fan is running for a thermostat call, variations in the hour-to-hour ventilation that occurs may arise.

Going backward, a sum is calculated and stored. If, during a given time block (one hour blocks are used for the illustrative example), the ventilation fan ran for longer than the long term average ventilation fraction (above 0.5 for the illustrative example) solely to meet ventilation requirements, then the difference between the ventilation fraction and the actual time is added to the sum. If the ventilation requirement exceeds the ventilation due solely to ventilation requirements for a time block, then the difference is subtracted from the sum, as long as the sum is greater than or equal to zero.

For the illustrative ventilation history of FIG. 8A, it can be seen that little ventilation occurred during several time blocks from 4 to −10 hours. However, going back to hours −18 to −23, it can be seen that there was significant ventilation due solely to a need to meet the ventilation requirements. FIG. 8B shows the stored value or sum resulting from these calculations. As a result of the calculations, a stored value of 0.2 is reached. The stored value of 0.2 is stored until it is determined (see also FIG. 6D) that the amount of time remaining in the present time block (i.e. the current hour) is less than the stored value times the length of the time block.

For a method using hourly time blocks, the stored value of 0.2 means that smoothing is needed, and requires at least twelve minutes of ventilation in the hour. Once the time remaining in the hour no longer exceeds the time called for by the stored value less any ventilation that has occurred in the present hour, the air handler fan is turned on and the FAV damper (if provided) is opened. Fresh air ventilation is performed for the remainder of the present time period to smooth out the spikes in the previous long-term time period.

Figure 9A:
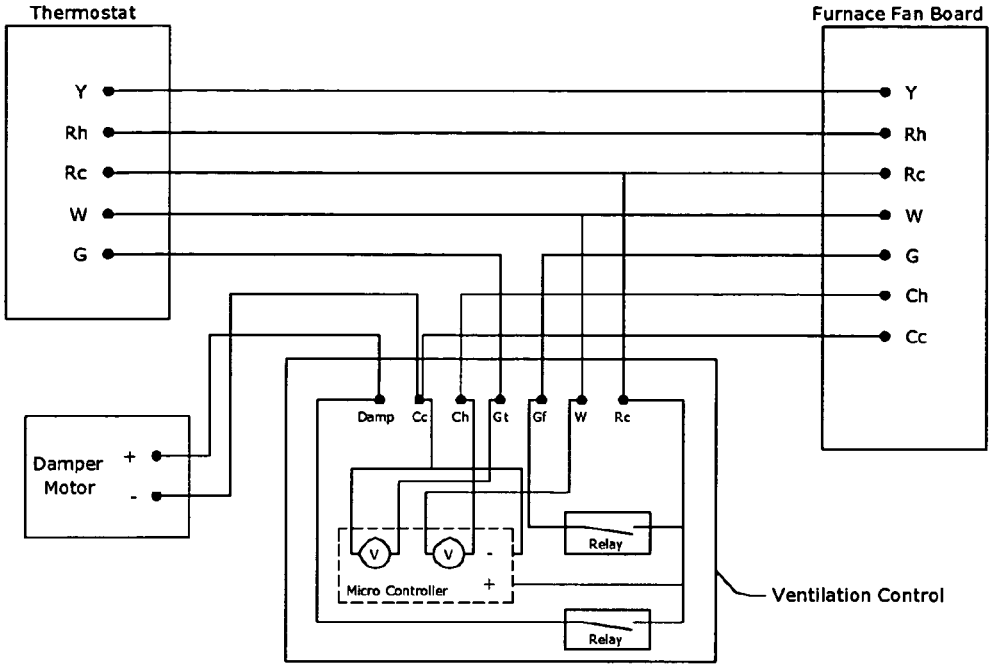
FIGS. 9A–9E are schematic diagrams showing illustrative ventilation control board configurations in accordance with the present invention.
Figure 9B:
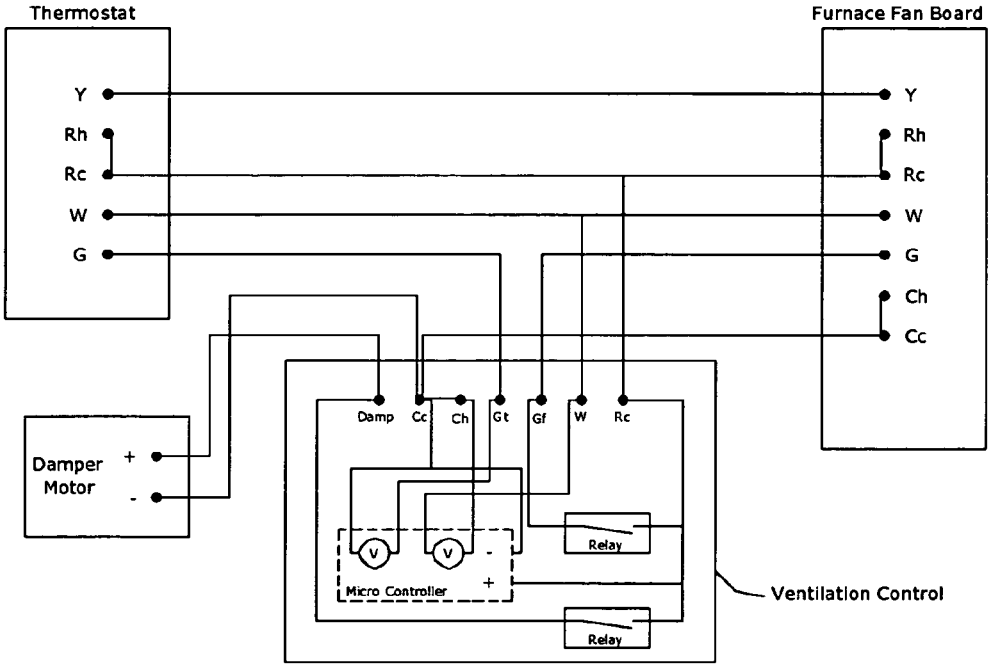
Figure 9C:
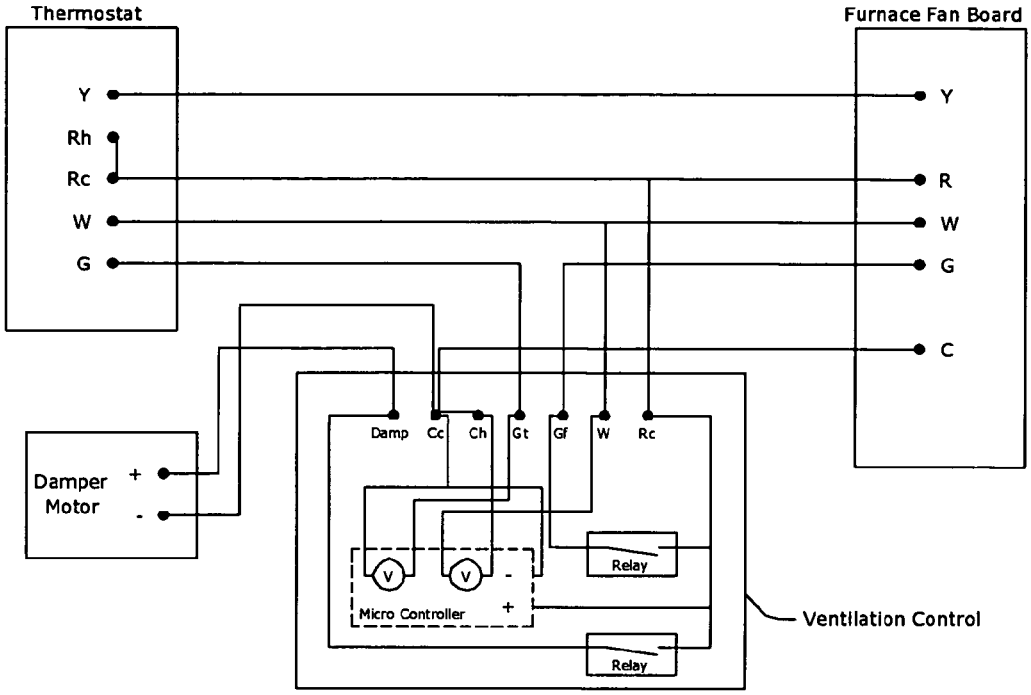
Figure 9D:
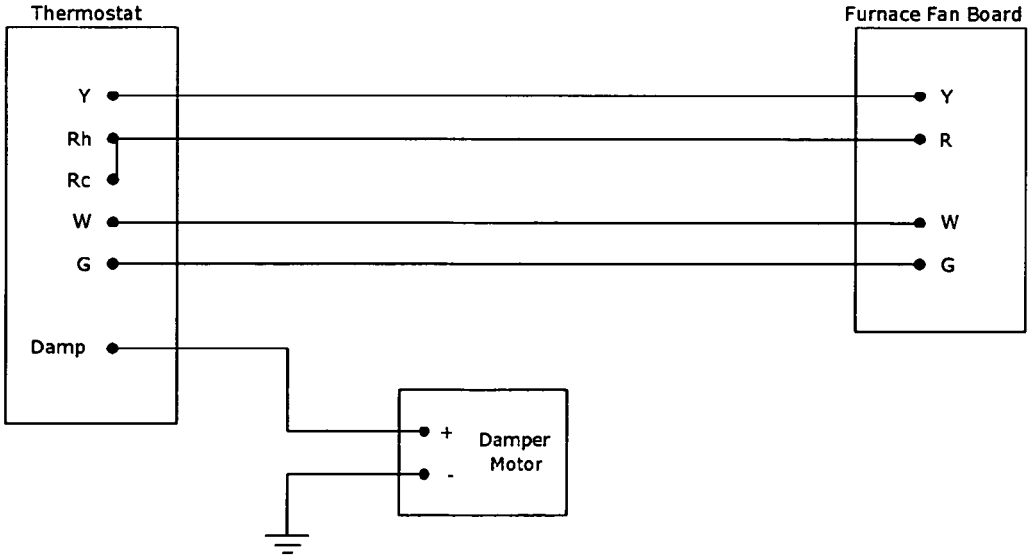
Figure 9E:
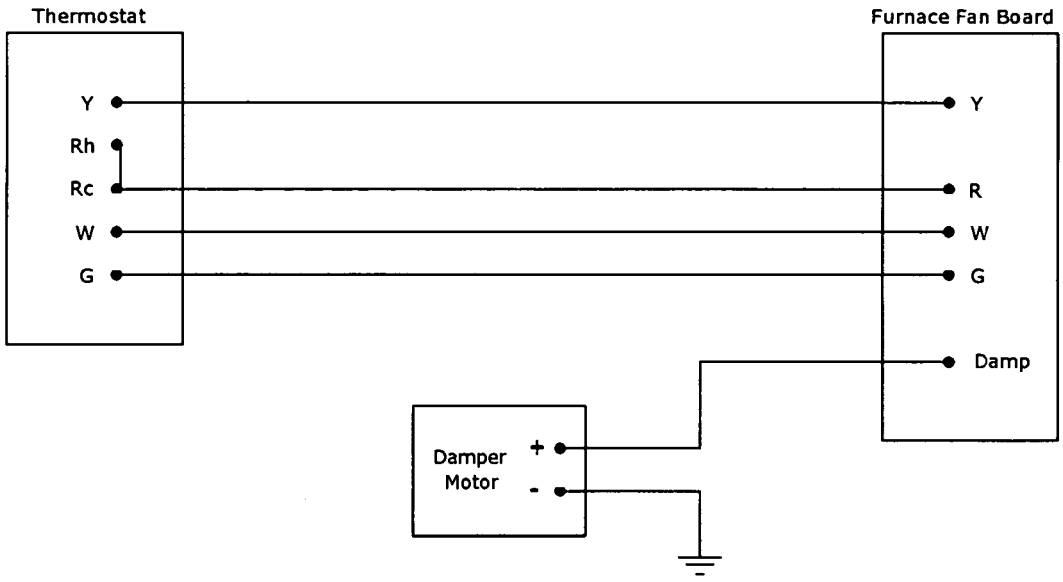

FIGS. 9A–9D are schematic diagrams illustrating various ways a ventilation control board may be retro-fitted to thermostat/furnace fan boards. FIG. 9A illustrates control as applied to a two transformer system, FIG. 9B shows wiring for a single transformer system, and FIG. 9C shows an alternative single transformer wiring configuration. It may be noted that the ventilation control only taps into, but does not control the W and Rc wires, but the ventilation control does in fact control the G wire leading to the fan. Alternatively, a single box may contain an entire system incorporating the above illustrated methods. For example, the thermostat control box shown in FIG. 9D includes, in a single device, the outputs needed to control the furnace and fan as well as a fresh air damper. FIG. 9E illustrates a wiring configuration in highly schematic form where a thermostat is coupled directly to a furnace fan board, with an FAV damper motor in turn controlled by the furnace fan board. The embodiment of FIG. 9E is further illustrated in FIG. 10.

Figure 10:
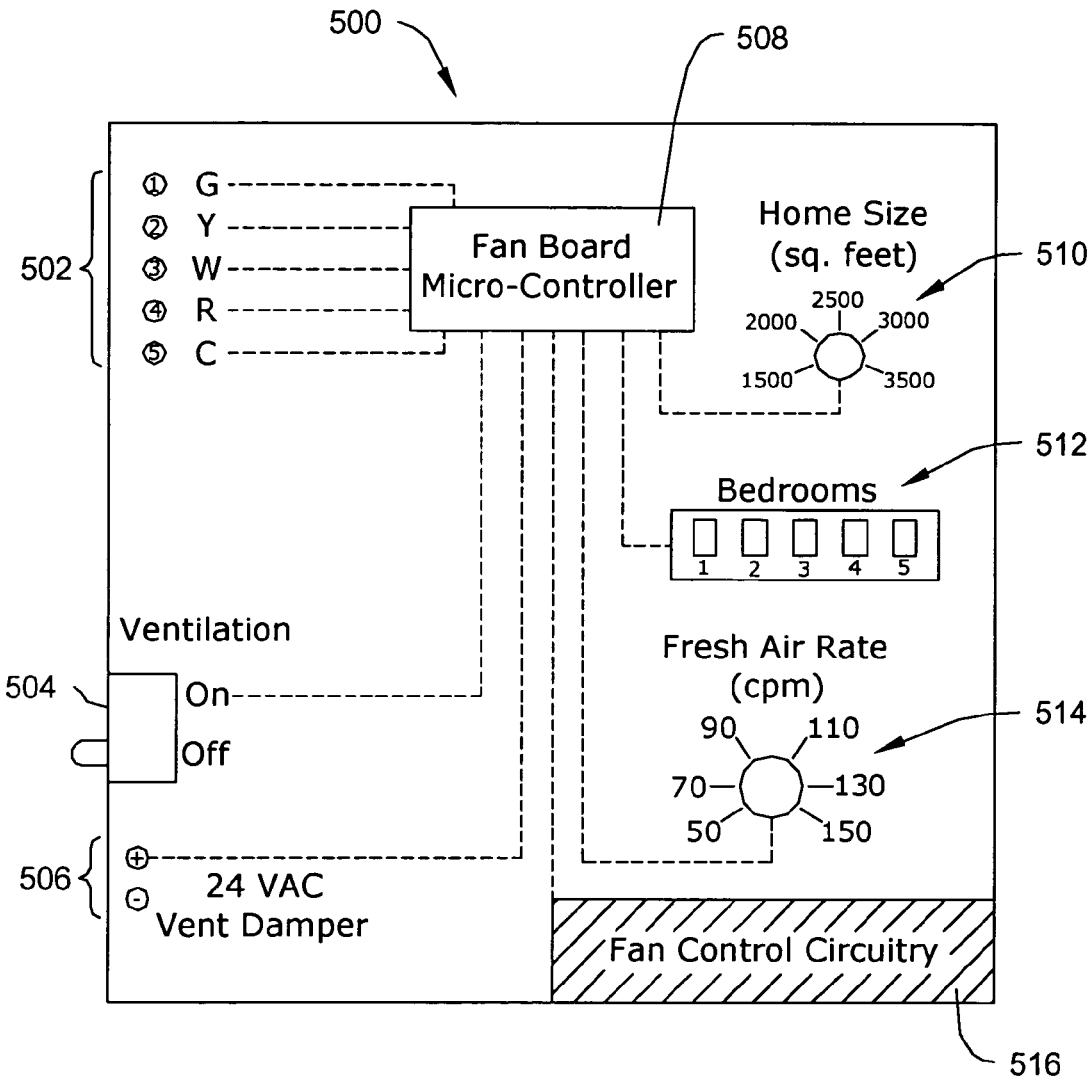
FIG. 10 is a schematic diagram showing an illustrative furnace-fan board in accordance with the present invention.

FIG. 10 is a schematic diagram illustrating a furnace-fan board design for incorporating a ventilation control scheme. The furnace fan board 500 includes a number of ports 502 for connection to a thermostat or other environmental sensor. A ventilation on/off switch 504 is included, and may be used in several FAV control schemes as shown above, for example, in FIG. 5I as a control vent enable voltage or switch. This enables a user to deactivate the FAV control for a system, preventing fresh air ventilation from occurring.

The furnace fan board design also includes vent damper terminals 506 for providing control signals to an FAV damper. This reduces the amount of intermediate wiring (i.e. wiring from a thermostat to an FAV controller, in turn to the furnace fan board and the FAV damper). A controller 508 is also illustrated, and may, for example, take the form of a microcontroller programmed to determine from signals received at the ports as well as an FAV control scheme whether the furnace fan should be activated or de-activated. The controller 508 also preferably determines whether the FAV damper should be opened or closed.

The furnace fan board 500 also includes several user inputs, illustrated as knobs and switches. The user inputs may, instead, be incorporated using a touch pad or other data input device. A space knob 510 allows a user to input the approximate square footage of the controlled environment. For example, if the furnace fan board is to be used in a 2580 square foot house, then the knob can be set to 2580 square feet.

The number of bedrooms and/or their occupancy can also be input using the room switches 512. For example, some desired FAV goals or requirements vary depending upon the expected occupancy of the space. The capacity of the FAV source can also be input at the fresh air rate knob 514. Knowledge of how quickly fresh air will enter a space enables more precise determination of whether FAV requirements are being met.

Using the furnace fan board of FIG. 10, a number of modifications to existing systems can be achieved. A furnace manufacturer may program the furnace fan controller to monitor and meet FAV requirements, eliminating the need for separate ventilation control. Because the furnace fan board is already adapted to monitor and distinguish a variety of calls from a thermostat or other related controller, the incorporation of FAV requirement programming to a furnace fan controller can reduce the costs of implementing such FAV requirements. Further, a number of wiring concerns that may accompany separate FAV control can be reduced or eliminated.

Even without having the controller 508 perform the steps of determining whether an FAV damper should be opened or closed for ventilation purposes, having the damper signal pass through the furnace fan board can provide advantages. In one embodiment, the furnace fan board may close an FAV damper whenever it is determined that a heating or cooling source is inoperable. For example, when it is very cold outdoors, if a heat source or fan fails, opening the FAV damper would allow cold air to enter the space when the HVAC system is unable to condition the air, accelerating the loss of heat from a controlled space.

An FAV damper (if provided) is often placed in a lower portion of a house or building, as is the furnace fan. Given the relative proximity of these two elements, having the damper control signals come from the furnace fan board will often reduce wiring difficulties. The wiring from a thermostat to the furnace fan board will be needed in any case. Adding another wire to the existing set of wires from the thermostat(s) to the furnace fan board does not appreciably complicate that aspect of the wiring scheme. However, eliminating the separate passage of a pair of wires from one remote location (the thermostat) to another (the damper) does reduce wiring complexity.

As is known, over the past 10 to 15 years, rising fuel costs and changes in national energy policy have resulted in "tighter" home construction with less natural infiltration/exfiltration. This has lead to homes that are more energy efficient and results in better occupant thermal comfort with fewer drafts, etc. Unfortunately, the corresponding decrease in infiltration/exfiltration has also resulted in conditions where indoor air contaminates, such as CO2 and VOC's, can build up to annoying and potentially unhealthy levels.

Several different standards organizations and government bodies are working on new building codes and standards specifically designed to address these issues. Among these new standards and codes, there is a considerable difference in how the amount of ventilation is determined and the schedule by which it must be supplied. For example, the Minnesota Energy Code specifies that ventilation systems must be designed to supply no less than 0.05 CFM/ft2 and that, when the structure is occupied, the ventilation must be 15 CFM/bedroom+15 CFM. In contrast, the new ASHRAE Standard 62.2, Low-Rise Residential Ventilation Standard, specifies a ventilation rate of 0.01 CFM/ft^2+7.5 CFM*(# of Bedrooms+1). Furthermore, the Canadian National Building Code (CNBC) specifies a ventilation rate based on the number of habitable rooms, such as bedrooms, etc. and number of large rooms, such as living room, basement, etc.

Typically, prior ventilation controllers are designed to meet only one ventilation standard, typically using a single control method (e.g. algorithm). Thus, it is up to the installer to purchase the correct controller and verify that it meets the application and local codes. There are at least two problems that can occur with this type of approach. First, since there are many different codes and standards, separate controllers must be produced for each standard, which increases the number of controller that must be stocked. There are also several different strategies that can be used to meet a particular standard. For example, some strategies are better suited for different locations like cool northern climates versus warm southern climates.

To overcome these and other difficulties, the present invention contemplates providing a ventilation controller that includes two or more different control methods. In some cases, the controller may have the ability to change at least some of the operational characteristics of one or more of the control methods, as desired. By incorporating more than one control method into a single controller, the controller may be used in more than one application. For example, a single controller may include different control methods for each of two or more ventilation standards. This may reduce the difficulty of picking the correct controller for a particular application, and may reduce the number of different controllers that need to be stocked.

Alternatively, or in addition, it is contemplated that a controller may be adapted to include two or more different control methods (e.g. algorithms), each capable of meeting the same ventilation requirement. This may allow a user and/or installer more flexibility when setting up the ventilation controller. For example, it is possible to meet the ASHRAE 62.2 ventilation requirements using an algorithm that meets the ventilation each hour without over-ventilating. This may provide relatively even ventilation for good circulation, etc., but may not be the most energy efficient solution. It is also possible to meet the ventilation requirements of ASHRAE 62.2 using an adaptive control that provides less continuous ventilation but attempts to optimize the ventilation time and reduce the number of ventilation only fan cycles. As such, and in some illustrative embodiments, it is contemplated that a controller may include both control methods (e.g. algorithms), and the user and/or installer may select which control method is best suited for the particular application. By incorporating more than one control method for a particular ventilation standard, the user may choose how the particular standard is to be met, as well as in some cases, which ventilation standard to meet.

It is also contemplated that this same concept may be extended to include two different versions of the same control method. For example, the control method may use a predictive approach that allows some over-ventilation. While this is good from an energy standpoint, some users might not like it. As such, it is contemplated that a controller may, for example, allow a user and/or installer to operate the control method with or without over-ventilation. That is, the user and/or installer may modify a control method by, for example, selecting which parts of the control method to enabled and/or disabled.

It is also contemplated that the controller may change one or more input parameters based on the ventilation control method that is selected. This may be desirable because different control methods may require different input parameters. Thus, it is contemplated that the controller may solicit different input parameters from a user and/or installer, based on the control method selected.

As can be seen, the present invention may offer significant advantages over currently known ventilation controllers. As noted above, current ventilation controllers typically are only capable of controlling ventilation using a single control method, to meet a single ventilation requirement. This can limit the flexibility of these controllers, and may require the user to either adapt the control to their application by adjusting the input parameters or purchase a different controller for each different application such as commercial, residential, Canadian, ASHRAE 62.2, Minnesota, etc. In contrast, the present invention may allow a single controller to meet different ventilation standards, sometimes using different control methods, where the user and/or installer simply chooses the appropriate control method (e.g. algorithm). This may increase the flexibility of the controller by allowing the user to change the ventilation standard later if the application of the building changes, and/or change the control method used to meet a particular ventilation standard. For example, if a residential building is converted to light commercial, the user may simply chose the ASHRAE 62-2001 algorithm verses the ASHRAE 62.2 algorithm, and the control would deliver the correct ventilation per that standard.

It is contemplated that the user and/or installer may select which control method (e.g. algorithm) to use using any suitable method or mechanism. For example, in one illustrative embodiment, the user may select which control method to use by adjusting the positions of a two (or more) position DIP switch. In this specific illustrative embodiment, the available control methods may include one method that is adapted to meet the ASHRAE 62-2001 standard, and another method to meet the ASHRAE® 62.2 standard. Both of these control methods use the same user input information (conditioned floor area (A), number of bedrooms (N), and ventilation flow rate (Q)) when calculating the ventilation rate. The controller may use the selected control method, with the user input information, to control the ventilation in the structure. As can be seen, this may allow one controller to be used in applications where ventilation is mandated per the ASHRAE 62.2 standard as well as in applications where the ventilation is mandated per the ASHRAE 62-2001 standard. This may, for example, allow the same controller to be used in both residential and light commercial applications, because the ASHRAE 62.2 standard typically only applies to residential construction whereas the ASHRAE 62-2001 standard typically applies to both residential and commercial structures.

In some illustrative embodiments, the user and/or installer may be given other control options. For example, the user and/or installer may be given the option to set a maximum allowable ventilation rate, such as either 60% or 100%, though the use of another two (or more) position DIP switch. This may allow the user and/or installer to set the maximum fan run time at a limit where, for example, the homeowner will not become concerned about the amount of time the system fan is operating to meet the ventilation requirement.

In some illustrative embodiments, both the control method (e.g. algorithm) and the user inputs may be changed, depending on the ventilation standard that is selected. For example, the ventilation rate of different standards may be calculated using different input variables. Thus, it is contemplated that the controller may request different input parameters from the user and/or installer depending on the control method that is selected. For example, the Canadian National Building Code (CNBC) determines the required ventilation rate using the total number of rooms and number of large rooms. However, ASHRAE 62.2 uses the conditioned floor area and number of bedrooms. In a controller that is adapted to include control methods to meet both of these standards, the controller may ask for total number of rooms and number of large rooms if the CNBC control method is selected, and may ask for conditioned floor area and number of bedrooms if the ASHRAE 62.2 control method is selected. That is, the controller may be adapted to tailor the requested inputs to the selected control method. One possible way to query a user and/or installer for the desired user inputs, beyond providing DIP switches or the like, is to provide an LCD display with multiple segments or a dot matrix LCD and appropriate control software. Any other suitable method or mechanism may also be used, as desired.

In some embodiments, the controller may also change the units based on the control method selected. For example, if the user and/or installer selects a control method that is adapted to meet the CNBC standard, the user input units may be displayed or accepted in metric units. However, if the user and/or installer selects a control method that is adapted to meet the ASHRAE standard, the user input units may be displayed or accepted in English units.

In some illustrative embodiments, it is contemplated that the user and/or installer may enter a zip code, latitude and longitude, state, etc., and the controller may chose the control method to use based on the location and the local codes for that area. This may free the user and/or installer from having to know which algorithm is correct, because by entering a location, type of building, etc., the controller may select the correct algorithm, and in some cases, ask for the necessary user inputs. As long as the basic input information is entered correctly, the controller may do all of the work of selecting the algorithm to meet the ventilation needs of the application.

It is also contemplated that the controller may use a memory card, have a digital input port where the installer may upload one or more control methods, be connected to the internet or a phone line, and/or contain a modem/wireless network capability to upload different algorithms and/or algorithm updates. This may allow the controller to adapt to different applications as well as new standards or standard changes. This may also provide the controller with access to potentially hundreds of control methods (e.g. algorithms) without having to have all of them pre-programmed into the controller. The ability of one controller to meet different ventilation standards and/or the ability of one controller to meet a ventilation standard in different ways is a significant improvement over prior ventilation controllers.

Figure 11A:
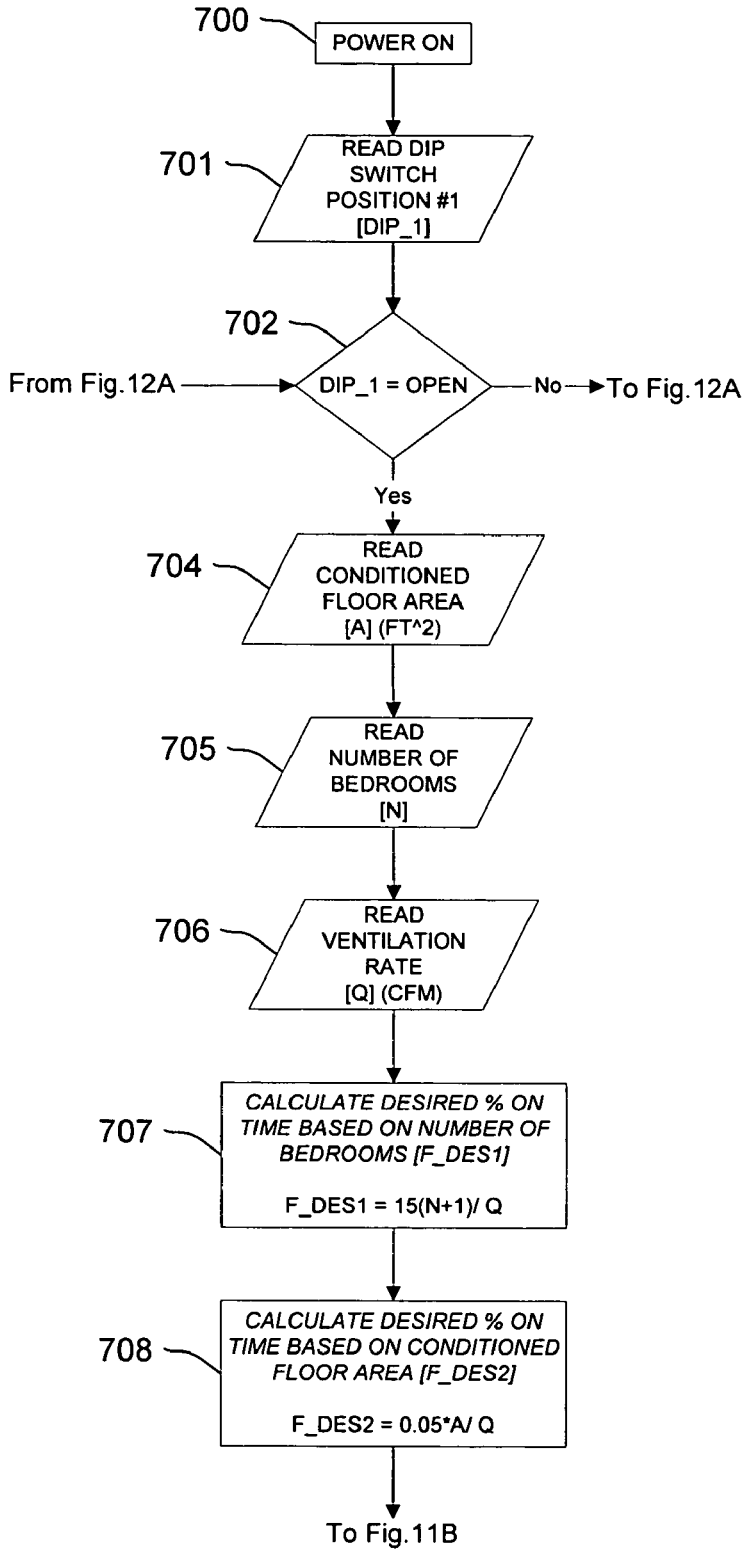
Figure 11B:
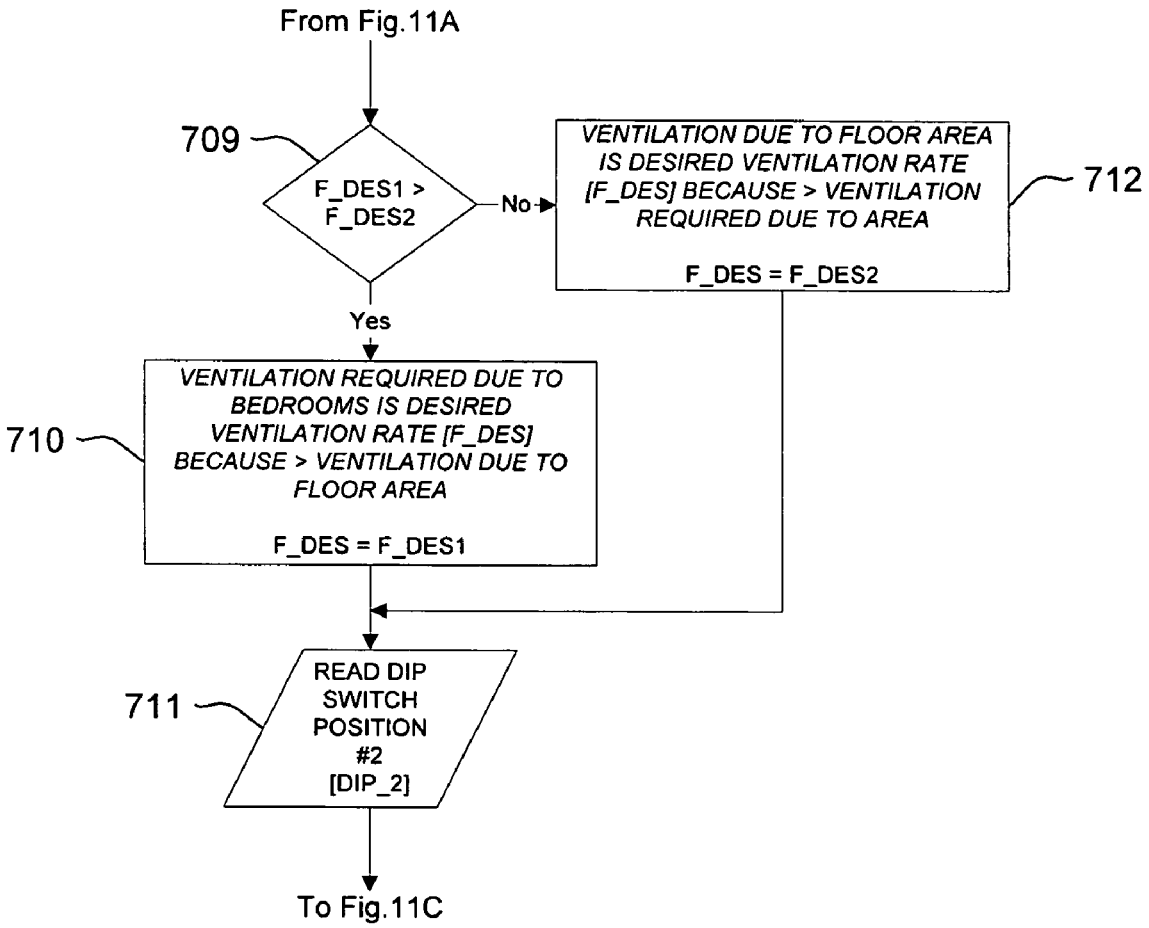
Figure 11C:
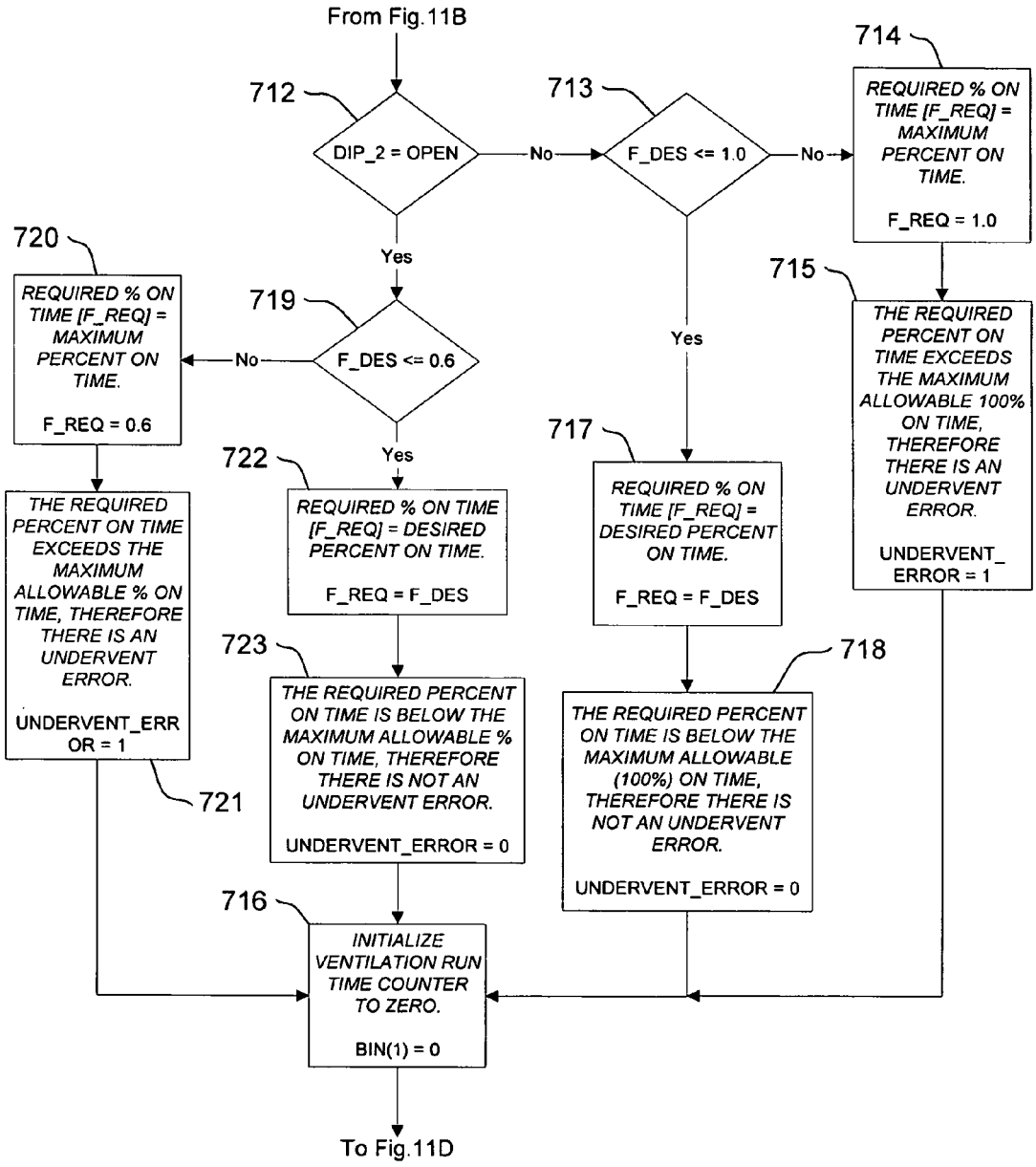
Figure 11N:
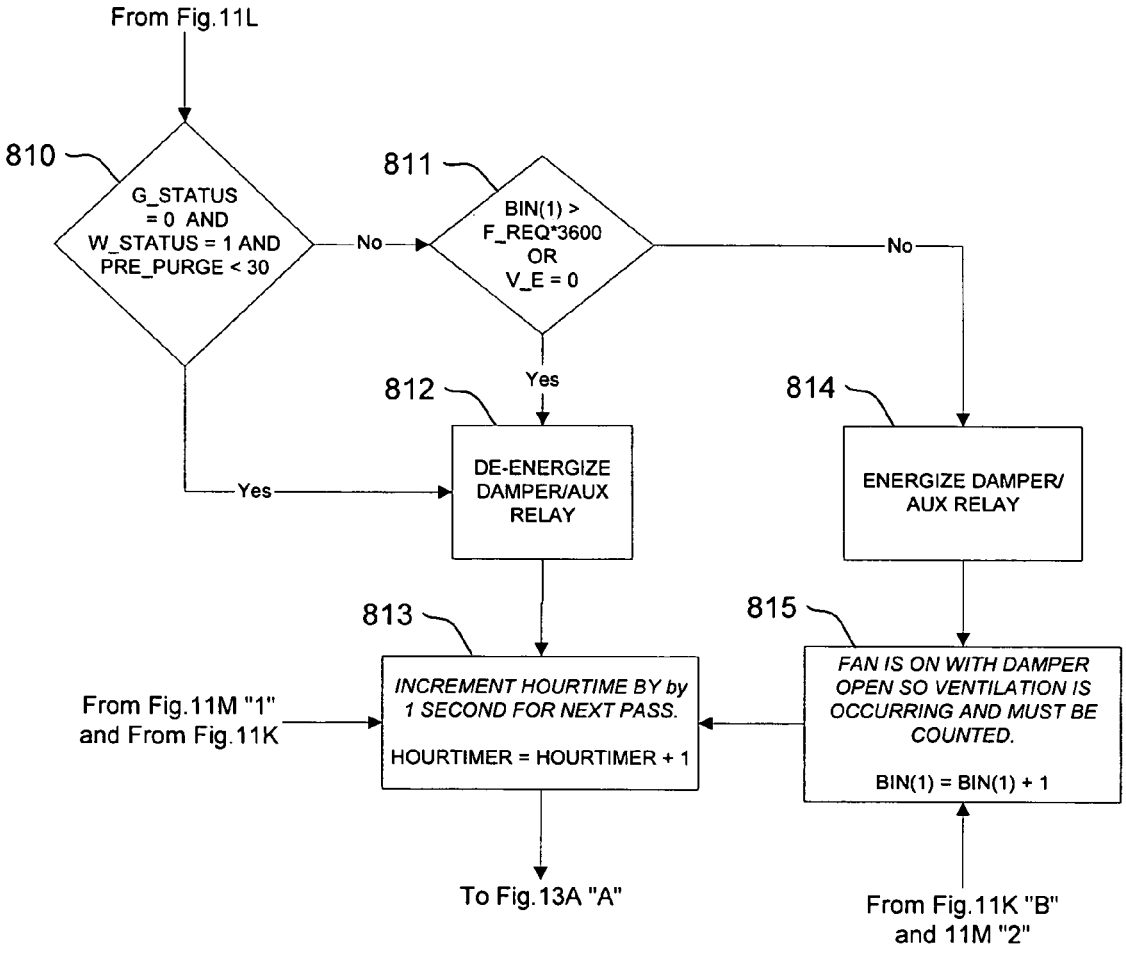
Figure 12A:
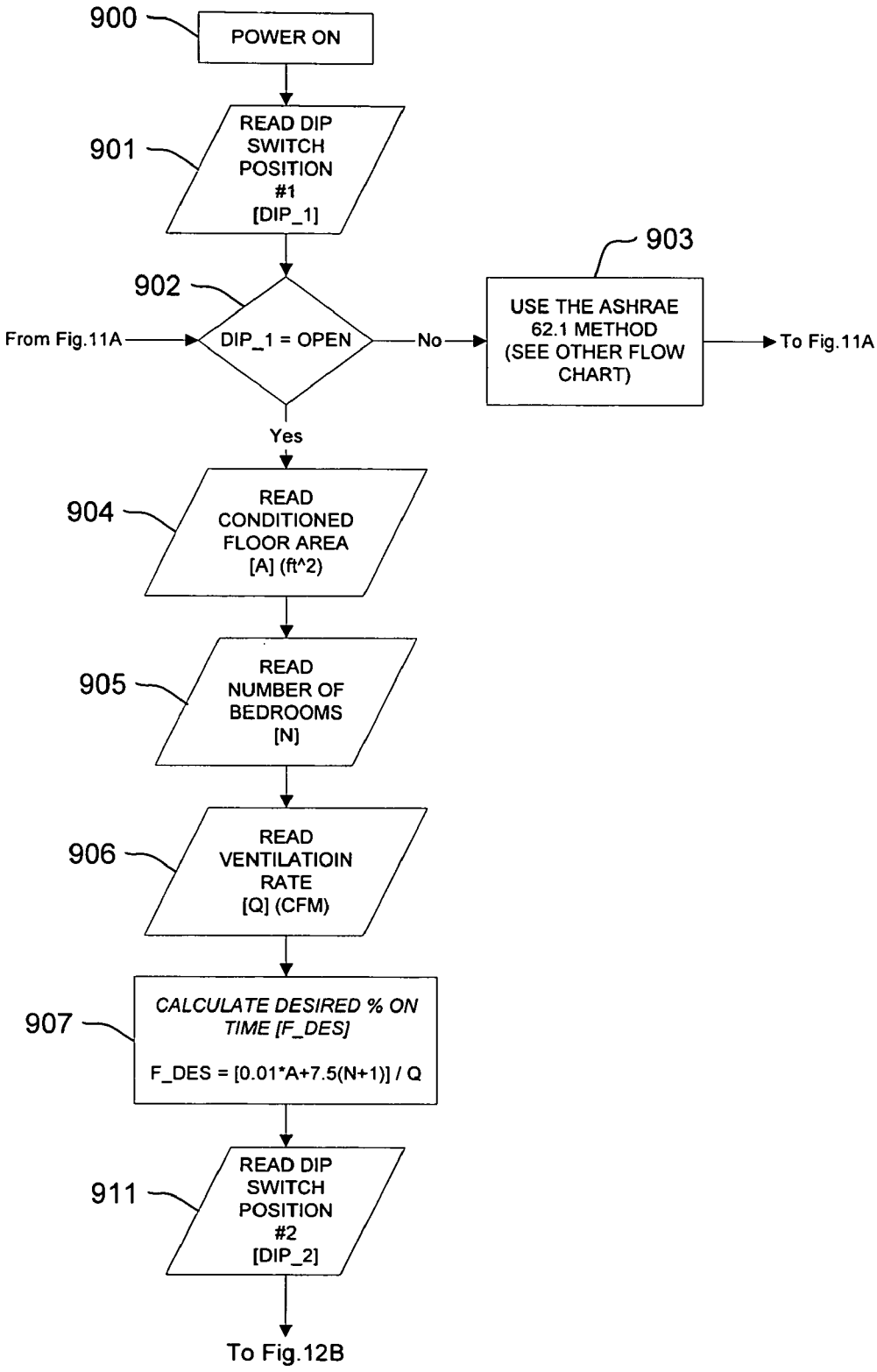
Figure 12B:
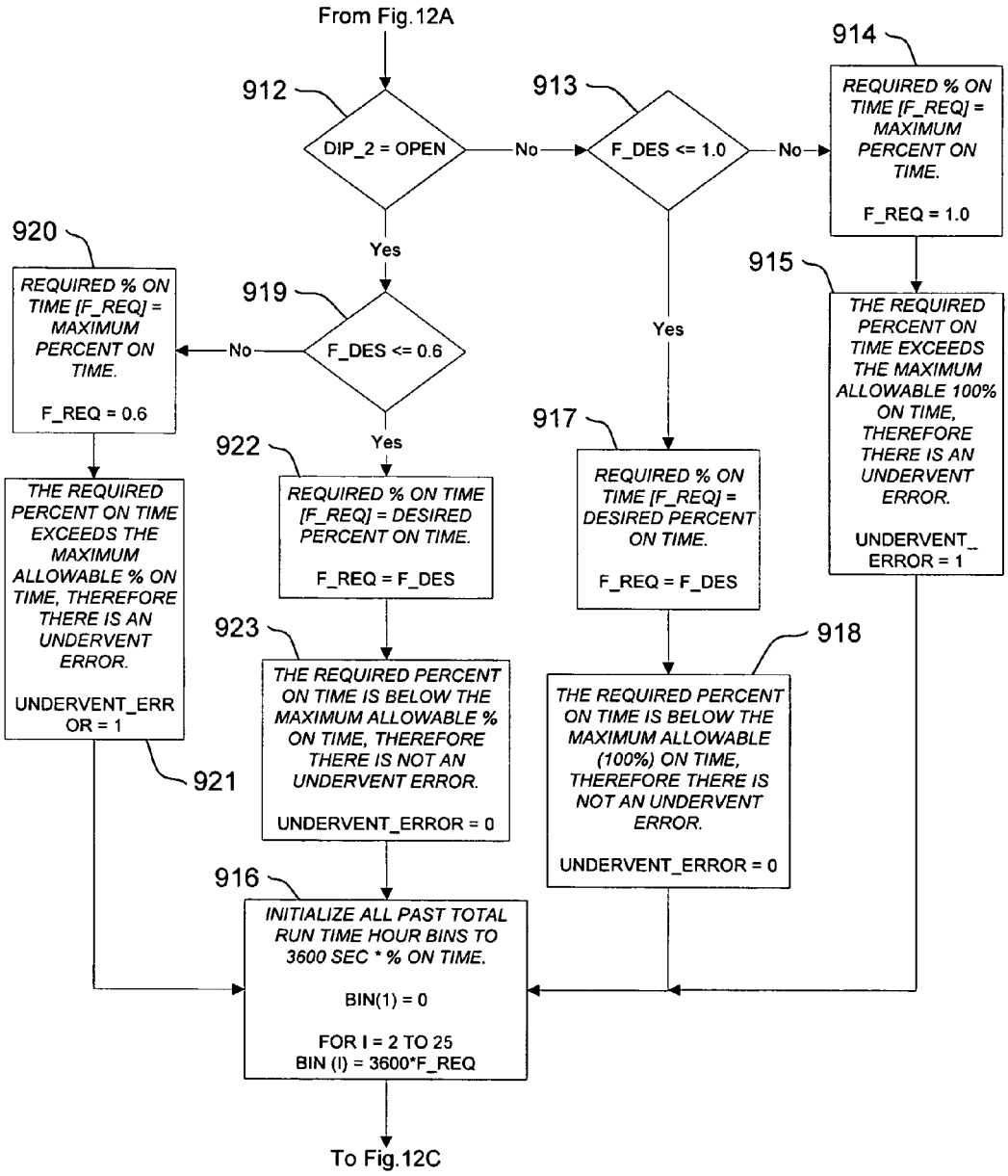

FIGS. 11A–11P along with FIGS. 12A–12R and 13A–13C illustrate another method of the present invention, this time adding further capabilities to the method. In particular, FIGS. 11B–11P are focused on a method for meeting a first set of desired FAV goals, while FIGS. 12B–12R are focused on a method for meeting a second set of desired FAV goals, with FIGS. 11A and 12A including steps for selecting from among the FAV goals to be met. FIGS. 11P and 12R show variable keys for aiding in understanding, respectively, FIGS. 11A–11N and 12A–12Q.

The illustrative method shown in FIGS. 11A–11P, 12A–12R and 13A–13C allows for selection from multiple ventilation methods. FIGS. 11A–11P show a method to meet a minimum ventilation goal that includes an hourly goal but does not allow for carry-over of ventilation time from previous hours, and further does not include a function for smoothing out uneven ventilation over several hours. FIGS. 12A–12R show a method to meet several minimum ventilation goals including hourly, multi-hourly, and daily goals, as well as including a function for smoothing out uneven ventilation duty cycles.

FIG. 11A shows a first portion of an illustrative method beginning with the power being turned on as shown at 700. Next, the DIP switch position for a first dip switch is read as shown at 701. If DIP_1 is open, then the smoothing/multi-tiered goal method of FIGS. 12A–12R is selected by a user or installer, so control goes to block 902 in FIG. 12A as shown at 702. Otherwise, control moves to block 704 where the conditioned floor area is read from a user input. In an illustrative embodiment, the floor area may be entered by selecting from several ranges (such as the manner using a dial shown in FIG. 10), or may be entered by typing the area into a keypad, or in any other suitable manner.

Next the number of bedrooms is read from a user input as shown at 705. Again, a knob, dial, keypad or any other suitable data entry device may be used to enter this data. Likewise, the ventilation rate of an associated furnace fan and/or ventilation apparatus are entered and read at 706. As shown at 707, the illustrative method next calculates a desired percent on time based on the number of bedrooms (f_des1) using the following formula:

$$\text{f_des1} = \left\lceil \frac{15 * (N + 1)}{Q} \right\rceil$$

Next the method determines a desired ventilation rate as determined from the conditioned floor area (f_des2) as shown at 708. This step uses the following formula:

$$\text{f_des2} = \left\lceil \frac{0.05 * A}{Q} \right\rceil$$

Next, the method goes to FIG. 11B where, as shown at 709, the method determines which of f_des1 and f_des2 is greater. If the rate called for based on the number of bedrooms (f_des1) is larger, then the desired ventilation rate (f_des) for the method is set to f_des1, as shown at 710. If the rate called for based on the conditioned floor area (f_des2) is greater, then f_des is set to f_des2, as shown at 712. With the desired ventilation rate set, the method moves to step 711 where the position of a second dip switch is read.

Step 711 checks the second dip switch, which is included to enable a user to set an acceptable maximum ventilation rate. For the illustrative example, the maximum rate is a 60% limit, meaning that the desired ventilation rate is not allowed to exceed a 60% duty rate. Looking at FIG. 11C now, the method checks whether DIP_2 is open as shown at 712. If DIP_2 is open, this corresponds to a user or installer selecting the 60% limit. If DIP_2 is closed, the user or installer has selected unlimited ventilation operation.

If DIP_2 is not open, the method checks whether f_des is less than one, as shown at 713. If not, then the desired percentage-on-time is unattainable, since it would require the circulation fan to be on more than 100% of the time. Therefore the variable to be used in the method, f_req (for the method this is the required ventilation time) is set to one, as shown at 714. From step 714, the method also includes making note that the desired ventilation rate cannot be met so a variable called undervent_error is set to one, as shown at 715, to indicate the error. From step 715, the method goes to initialize the ventilation run time counter to zero, as shown at 716, which prepares a controller performing the method to begin operating and recording ventilation data for the present hour.

If DIP_2 is not open, and f_des is less than one, the method goes from step 713 to step 717, where f_req is set to f_des to set the required ventilation on time to the desired level. Since there was no error with the desired ventilation on time, the undervent_error variable is set to zero at 718. From step 718, as with step 715, the method goes to step 716.

If DIP_2 is open, the method goes from step 712 to step 719, where it is determined if the f_des is less than or equal to the chosen maximum ventilation rate of 0.6. If not, the method goes to step 720 and sets the f_req to 0.6, its maximum value. Because the desired rate exceeded the maximum allowed, the method also includes step 721 where the undervent_error variable is set to one. Again, from step 721 the method goes to step 716 where the recorded ventilation time is initialized.

If, instead, f_des is less than 0.6, the method includes setting f_req equal to f_des, as shown at 722. Next the under_vent variable is set to zero, since the desired ventilation rate f_des is acceptable. Again, the method next goes to step 716 and initializes the recorded ventilation time.

Figure 11D:
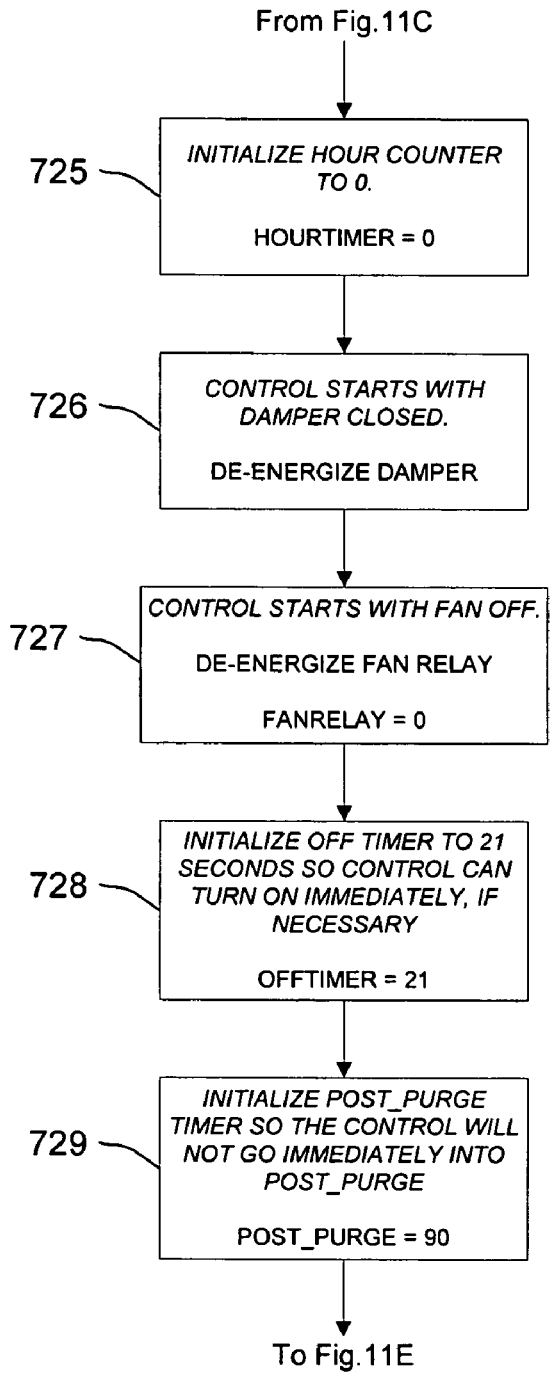

Turning to FIG. 11D, the method initializes several counters. As shown at 725 the hourtimer is set to zero, indicating the start of an hour. Next the control starts with the damper signals de-energized, as shown at 726. The control also starts without control over the fan, de-energizing the fanrelay as shown at 727. The off timer is set to twenty-one seconds to allow the fan to turn on immediately if desired, as shown at 728. The step in block 728 is performed because the method is adapted to prevent short-cycling of the ventilation fan by the use of an off-timer counter that determines how long the fan has been off since its last cycle. By setting the offtimer to twenty-one seconds, the off-timer is prevented from keeping the method from turning the fan on within the first twenty-one seconds of control. As another optional feature, the method may include setting a post_purge timer to ninety seconds or some other suitable value, as shown at 729. The post_purge timer is used to account for fan time where the circulation fan is on due to the furnace being in a post-purge state because, after furnace operation, the circulation fan continues to operate for a period of time (e.g. ninety seconds) after the thermostat stops calling for additional heat.

Figure 11E:
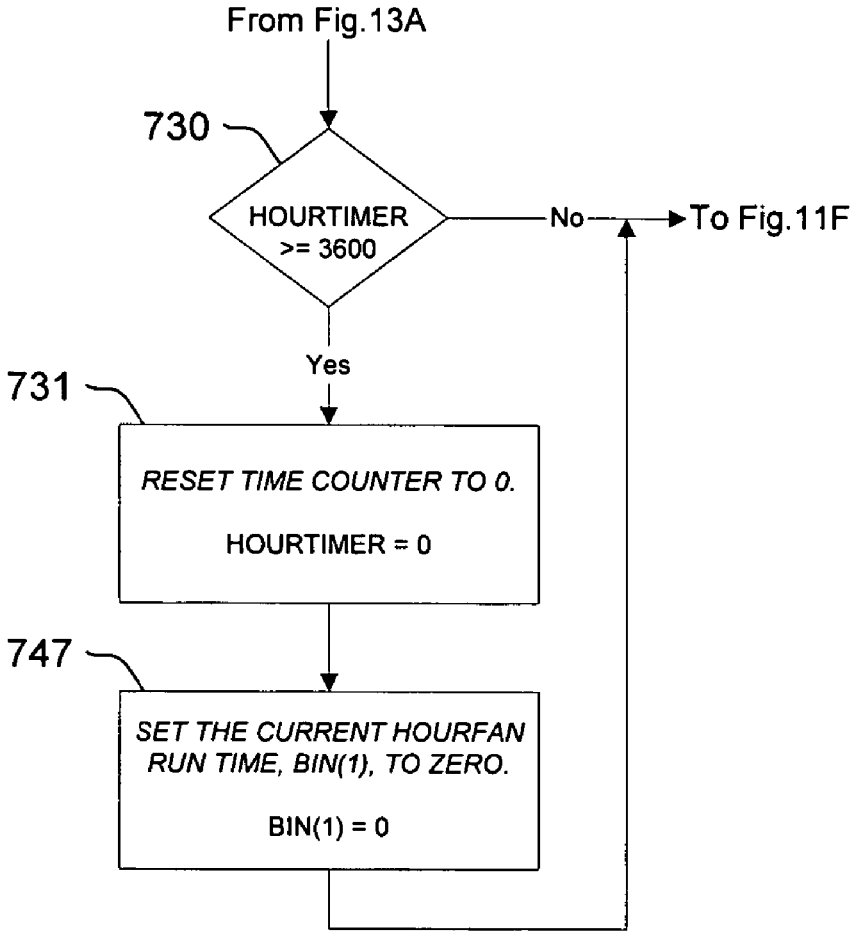
Figure 13A:
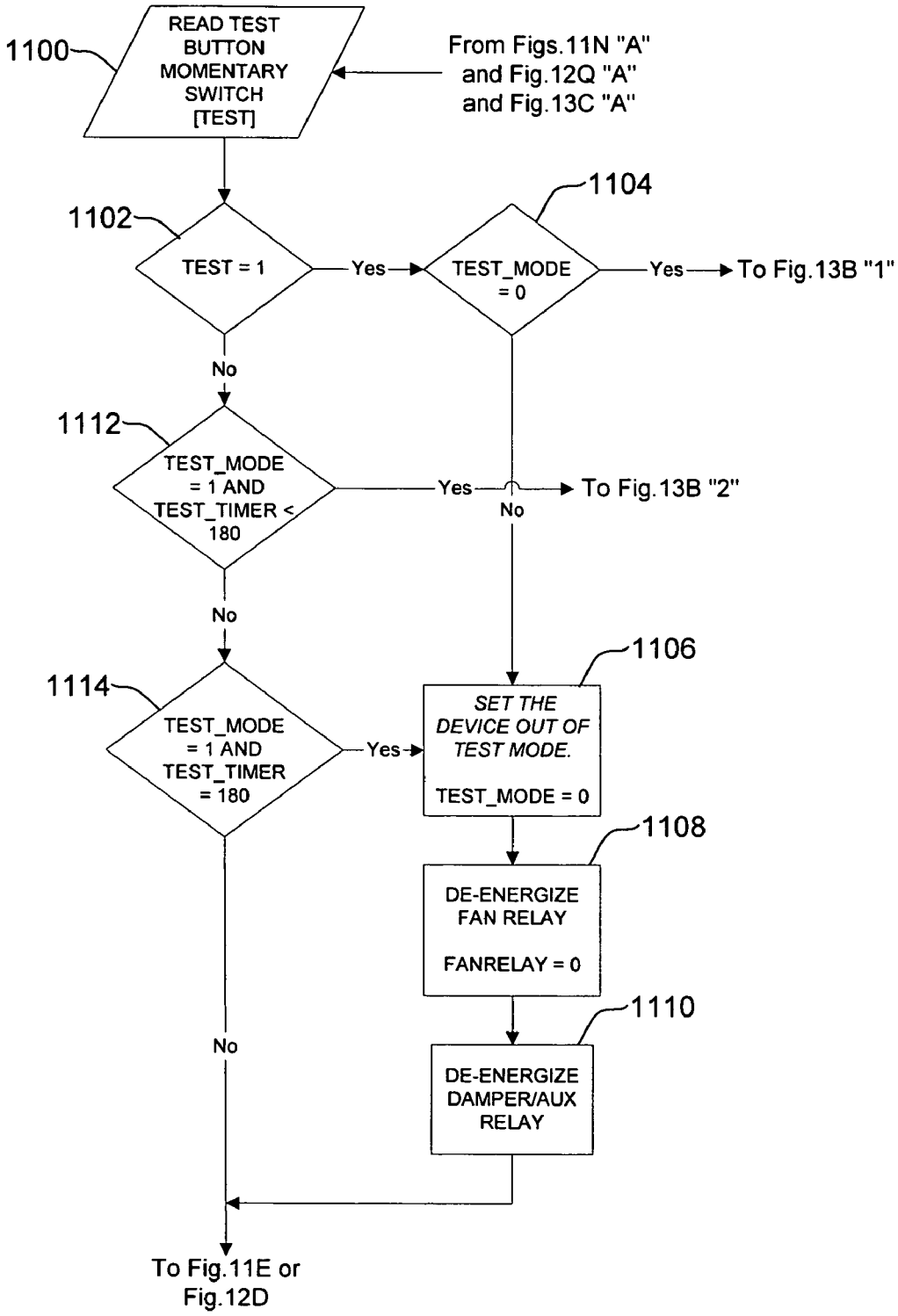
FIGS. 13A–13C illustrate a testing method adapted for use with the method of FIGS. 11A–11H, 11J–11N, and 11P, and 12A–12H, 12J–12N and 12P–12R.

From step 729 in FIG. 11D, the method moves to 730 in FIG. 11E. In step 730, the method determines whether the hourtimer has exceeded 3600 seconds, or one hour. It should be noted as well that this is the return step for the method from the testing algorithm in FIGS. 13A–13C, as shown in FIG. 13A going to a check of the hourtimer at 730. If the hourtimer has exceeded 3600, then the hourtimer is reset as shown at 731. After the hourtimer is reset, the recorded ventilation time in bin(1) is also reset, as shown at 747. This simple reset is a result of the fact that the method in FIGS. 11A–11P relies on a single hour ventilation goal and includes neither multi-hour goals nor a smoothing function.

Figure 11F:
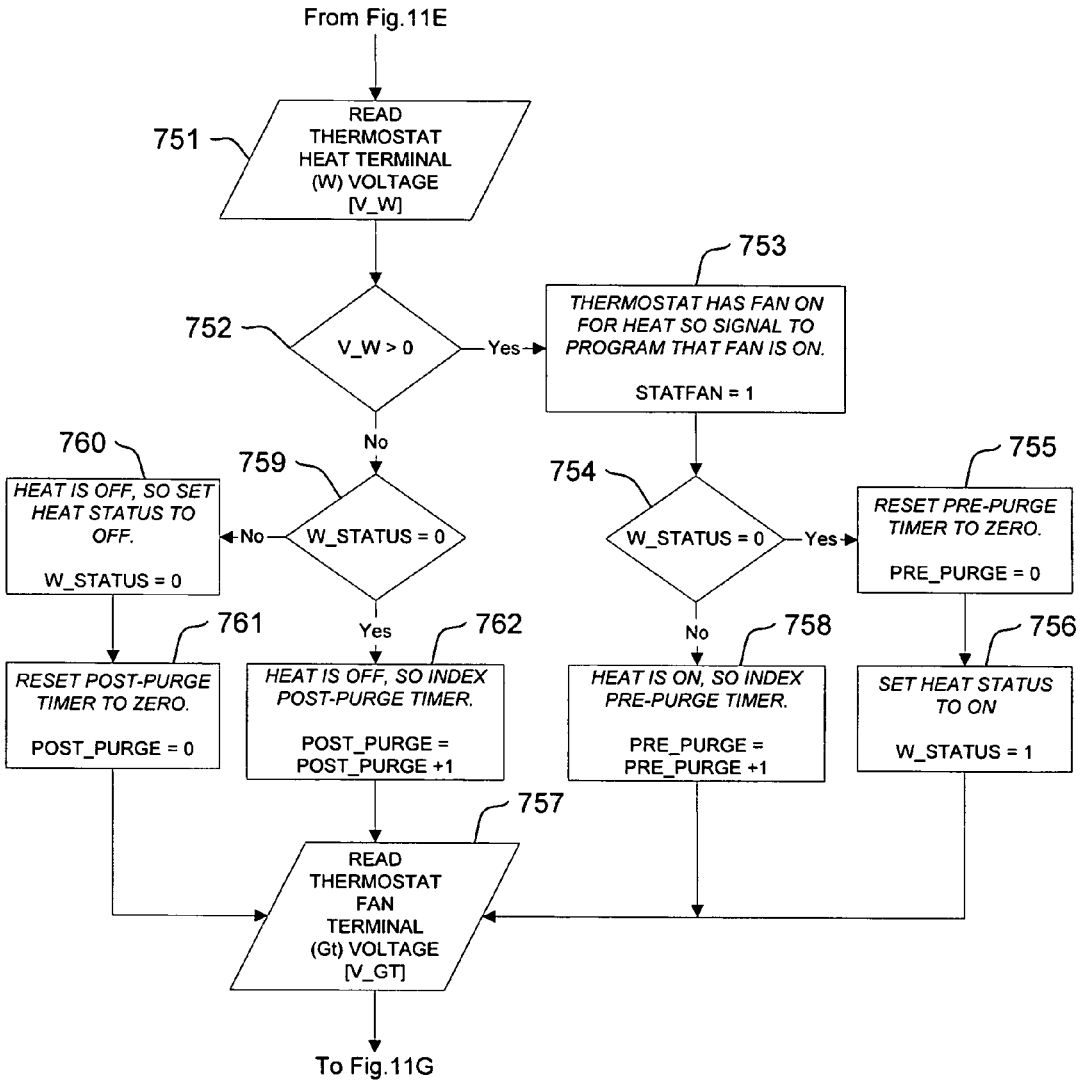
Figure 11G:
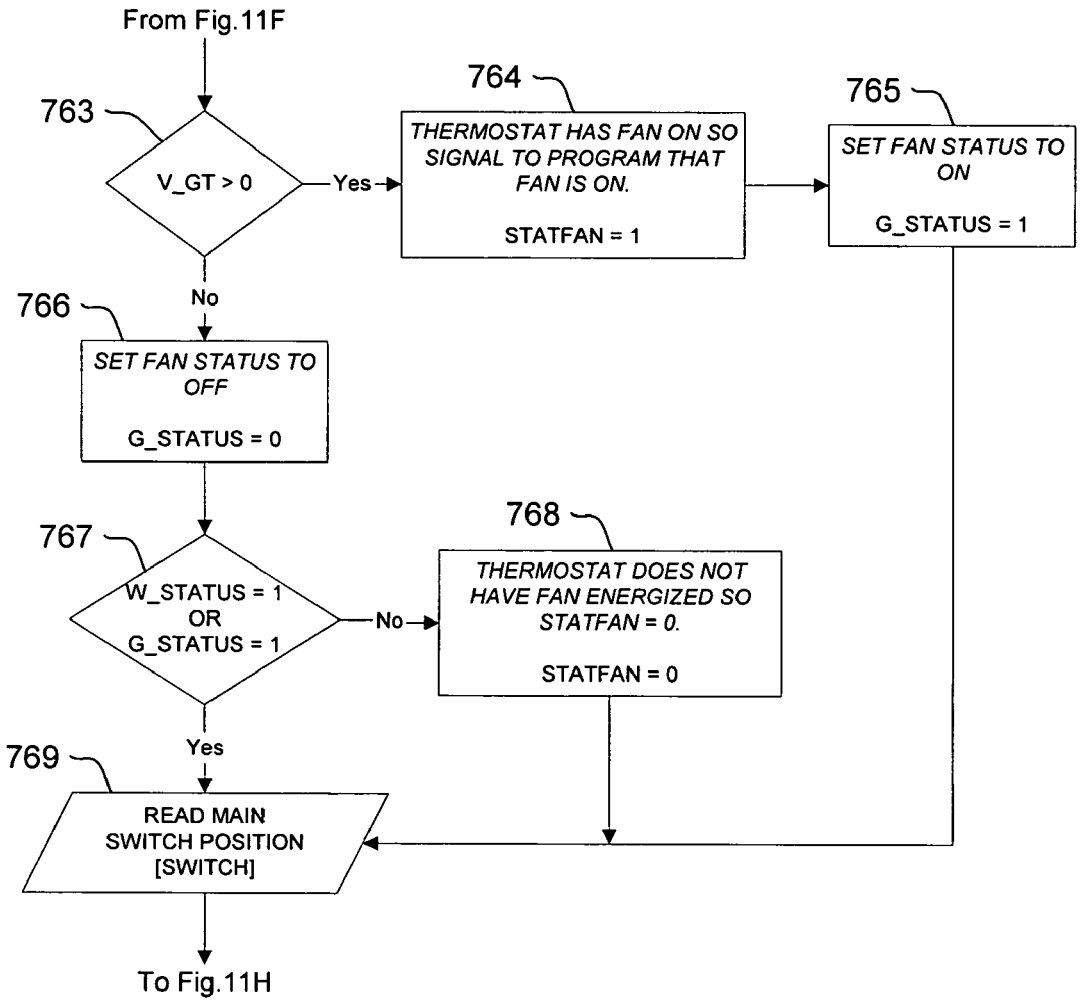

Following the reset of the hourtimer and recorded ventilation time the method moves to step 751 in FIG. 11F. Likewise, if the hourtimer has not exceeded 3600 seconds as checked at step 730, the method still continues with step 751 in FIG. 11F. The thermostat heat terminal voltage V_w is read in step 751. This is enabled by providing the controller with an input from the thermostat heat terminal using, for example, a configuration as in any of FIGS. 9A–9E. In step 752, the voltage V_w is checked to determine whether the thermostat has activated the furnace for heating purposes, which causes the circulation fan to activate as well.

If V_w indicates that the thermostat has called for heat at 752, then the method sets the statfan variable (which indicates the thermostat's circulation fan call status) to one, as shown at 753. Next the method checks whether W_status, the controller's variable for monitoring whether the thermostat has called for heating, is zero, as shown at 754. If W_status is zero, then the pre-purge timer is set to zero as shown at 755, which is done since the pre-purge timer counts the time at the beginning of a heat cycle when the fan is not on due to the furnace being in a pre-purge state. This pre-purge time (the first thirty seconds of a heat call) does not count as ventilation time because the circulation fan is not actually on yet. The prepurge timer is reset at this point because W_status being zero indicates that the call for heat has just occurred. As shown at 756, after the prepurge timer is reset W_status is set to one indicating that the call for heat is no longer new. The method then goes to step 757 where the thermostat fan terminal voltage V_Gt is read.

If W_status is one at step 754, the method goes to step 758 where the pre-purge timer is incremented. This indicates that the heat call from the thermostat has been ongoing for an additional second. The method again goes to step 757 after the pre-purge timer is incremented.

Going back to step 752, if V_w is zero, indicating that the thermostat does not have the fan on for heating, the method checks whether the controller variable W_status is zero as shown at 759. If not, then, since the heat is newly off (the heat is newly off because the W_status variable is still one), the method includes the steps of setting W_status to zero, shown at 760, and setting a post_purge value to zero, as shown at 761. The post-purge value is used to keep the damper (if provided) open during the furnace's post-purge state, during which the circulation fan is on. The method then goes to step 757, as before.

If W_status at step 759 is zero, then the furnace has been off for at least one iteration of the method. Therefore, as shown at 762, the post-purge variable is incremented. The method again goes to step 757 to read the thermostat fan terminal voltage V_Gt. V_Gt may be read by the controller by the use of a wiring scheme such as one of those shown in FIGS. 9A–9E. With V_Gt read, the method goes to step 763 in FIG. 11G.

Figure 1:
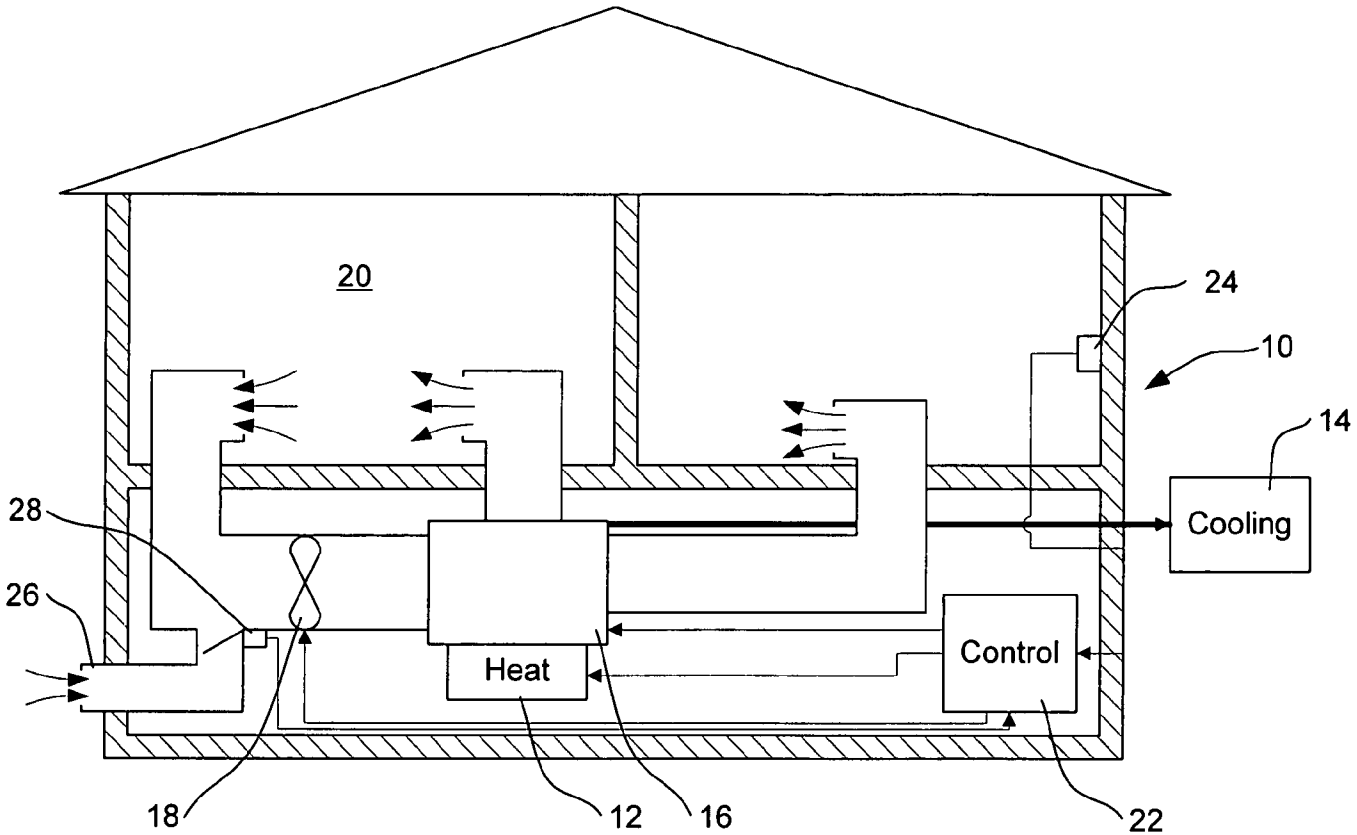
FIG. 1 is a schematic view of a building with an illustrative HVAC system.

Turning to FIG. 1G, the method continues by determining whether V_Gt is greater than zero, as shown at 763. If so, then the thermostat has the fan on and so the statfan variable is set to one as shown at 764. Next the fan status is set to one by setting the G_status variable to one, as shown at 765. Having observed and set the fan status, the main switch position is read at 769. The main control switch can have at least three illustrative positions, including "REMOTE ONLY", "AUTO", or "CONTINUOUS".

If V_Gt is not greater than one, then the thermostat does not have the fan on, and the method goes from step 763 to step 766. The fan status is set to off, as shown at 766. Then the method determines whether W_status or G_status is equal to one, as shown at 767. If neither W_status nor G_status is one, then the thermostat has the fan off, so statfan is set to zero as shown at 768. Either from step 767 or step 768, the method continues to step 769 where the main switch position is read.

Figure 11H:
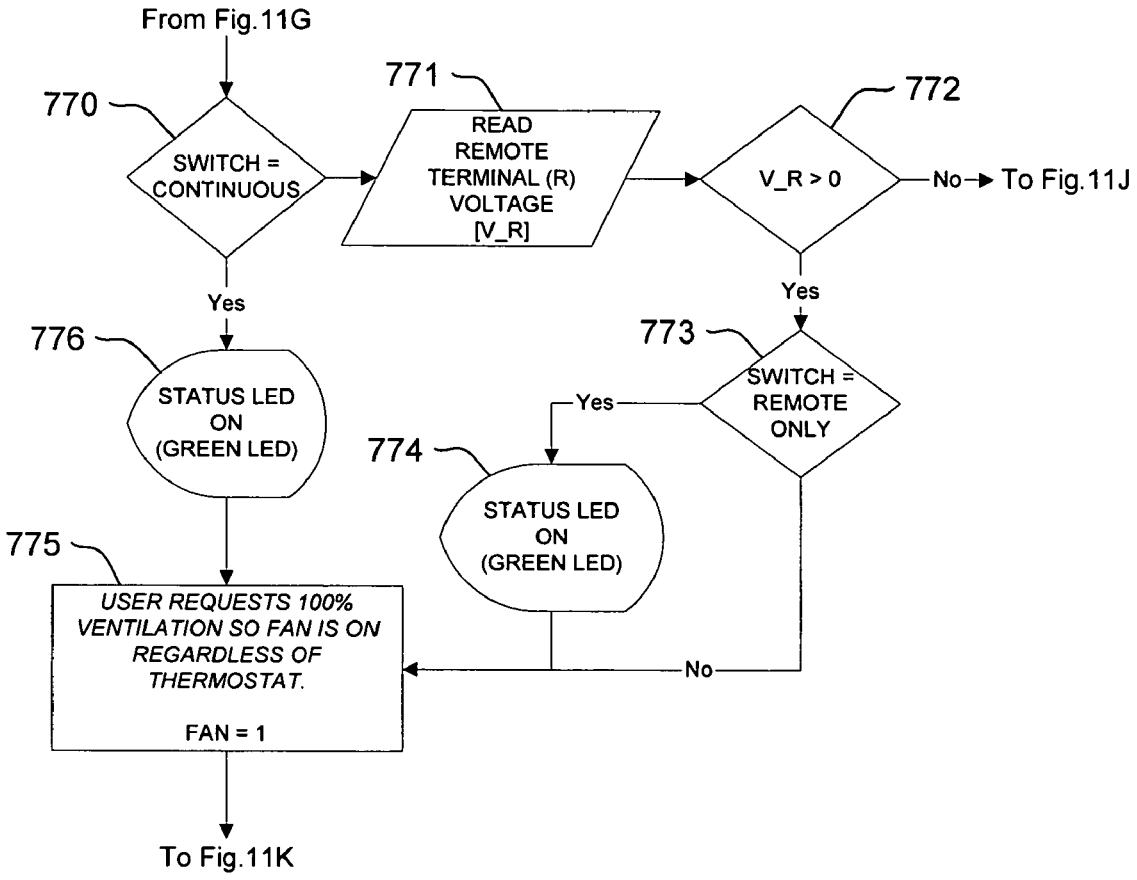

Looking now at FIG. 11H, the method determines whether the main switch is set to continuous, as shown at 770. If not, then the method reads the remote terminal voltage V_R, as shown at 771, and determines whether V_R is on, as shown at 772. If not, then the method goes to step 778 in FIG. 11J. If V_R is on at 772, then the method determines whether the switch is set to remote only, as shown at 773. If the switch is in the REMOTE ONLY position, and the remote terminal voltage V_R is high, then a green status LED is turned on to indicate that the user has requested 100% ventilation, as noted at 774. Also shown at 775 is that the variable "fan" is set to one, indicating that the ventilation program wants the fan to be on. Going back to the determination of whether SWITCH is set to CONTINUOUS at 770, if the result is positive then the green status LED is turned on as shown at 776, and the method again goes to block 775. From 775, the method continues at 792 in FIG. 11K.

Figure 11J:
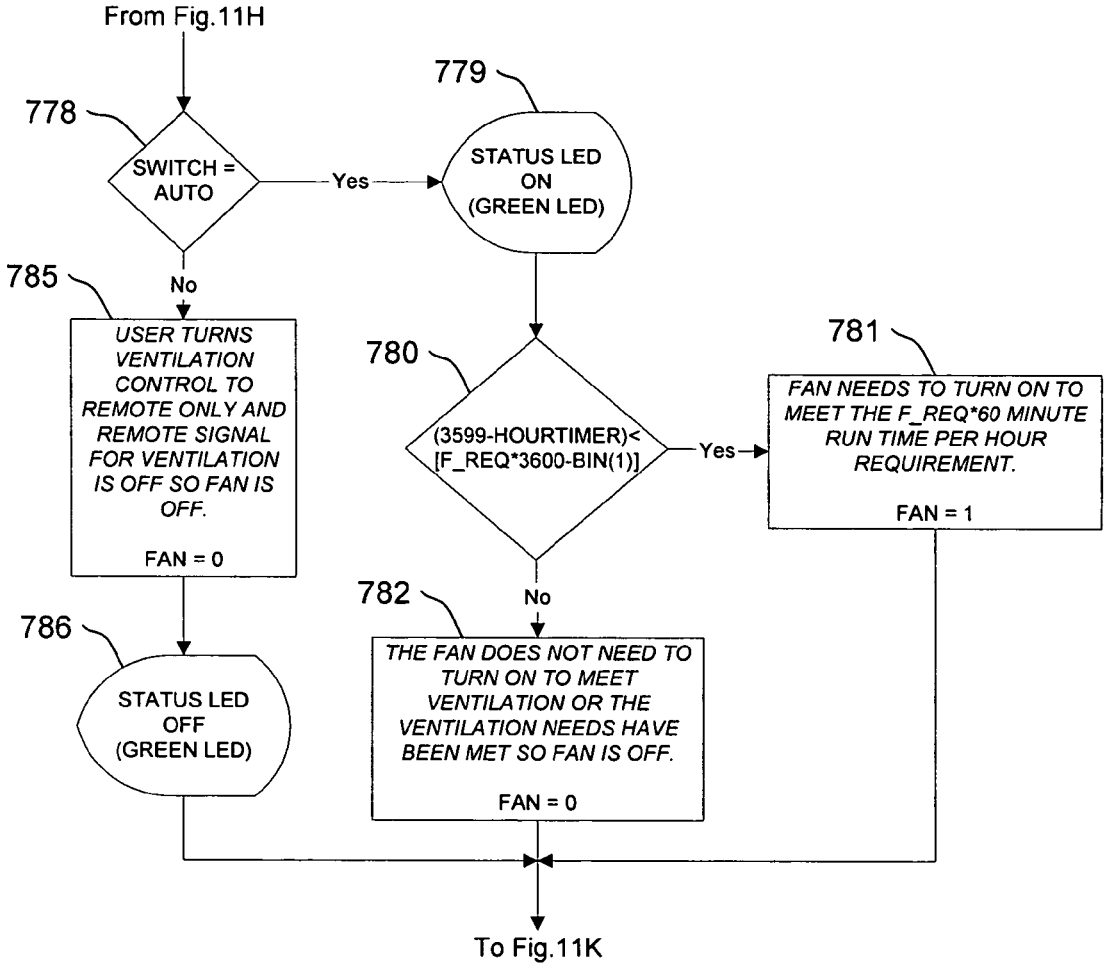

Looking now at FIG. 11J, coming from 772 in FIG. 11H, the method determines whether SWITCH is set to AUTO, as shown at 778. If so, then the green status LED is turned on as shown at 779. From 779, the method next determines whether the fan needs to turn on from the equation shown at 780:

$$(3599-\text{hourtimer})<\{(f_\text{req}*3600)-\text{bin}(1)\}$$

If the result is true, then the fan must be turned on to meet the ventilation goal or target, so the variable "fan" is set to one, as shown at 781. If the result from 780 is false, then the fan does not need to turn on in order to meet the ventilation goal or target from f_req or f_des. Therefore the variable "fan" is set to zero, at shown at 782.

Going back to 778 in FIG. 11J, if SWITCH is not set to AUTO, then the only choice left for the switch is REMOTE, having eliminated AUTO at 778 and CONTINUOUS at 770 (FIG. 11H). In order to reach step 778, the method had to determine that the remote terminal voltage was off at step 772 in FIG. 11H, so it can be concluded, as noted at 785, that the user has the switch set to REMOTE ONLY and the remote signal for ventilation is off. Therefore, as also shown at 785, the variable, fan, is set to zero and, as shown at 786, the green status LED is turned OFF. The method then continues with step 792 in FIG. 11K.

Figure 11K:
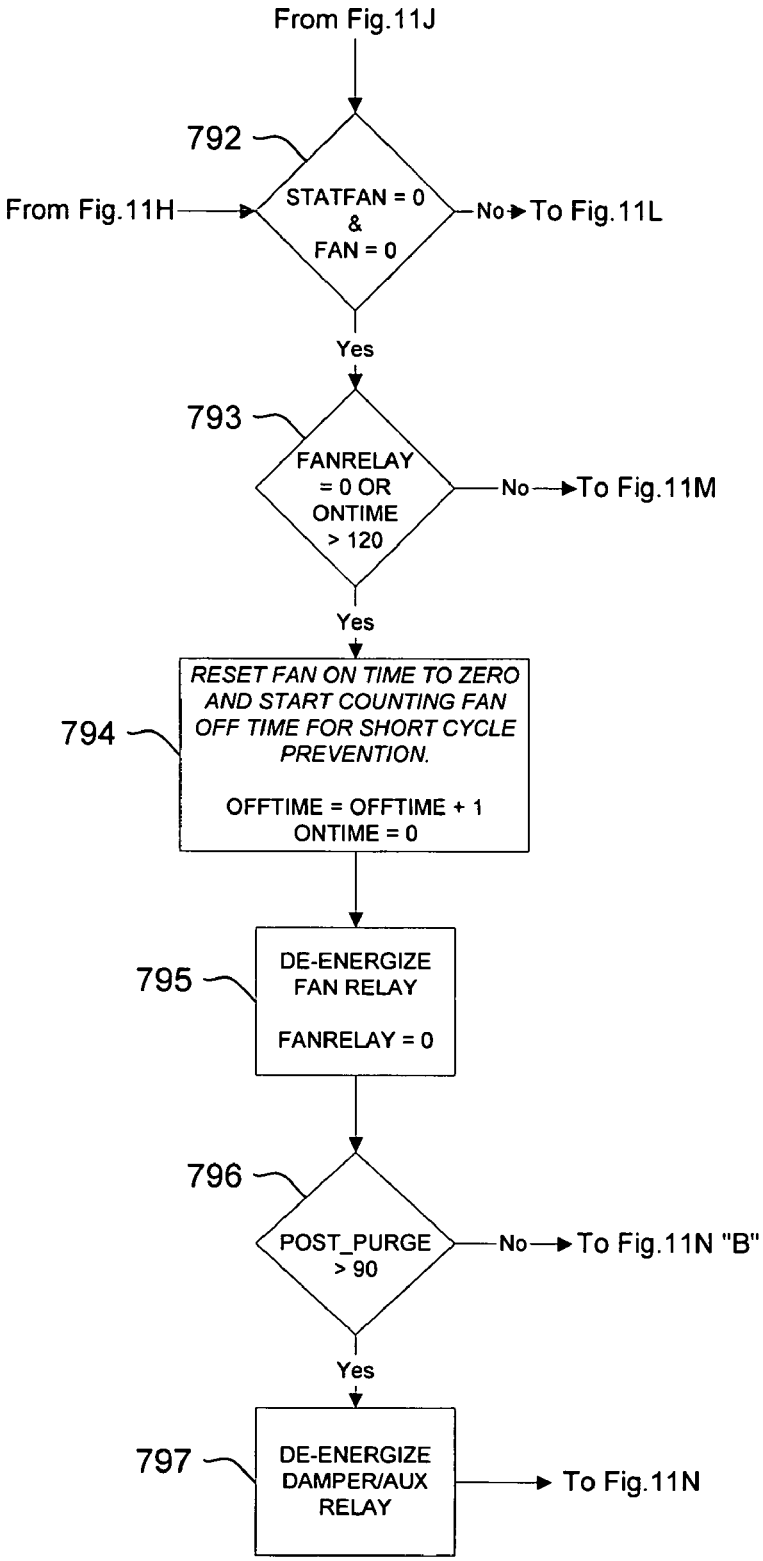

Looking now at FIG. 11K, the method continues by determining whether both statfan and fan are set to zero, as shown at 792. If not, then the method continues with step 798 in FIG. 11L. If, instead, both statfan and fan are zero at 792, the method next determines whether either fanrelay is zero or the ontime is greater than one-hundred-twenty seconds, as shown at 793. If not, the method continues at step 805 in FIG. 11M.

If either fanrelay is zero or the ontime is greater than one-hundred-twenty seconds at 793 then, because neither the program nor the thermostat are calling for fan operation (both fan=0 and statfan=0) and the minimum ontime has been met (ontime>120) or the controller is already not controlling fan operation (fanrelay=0), the method increments the offtime and sets the ontime to zero, as shown at 794, and reassures that the controller does not have fan control setting fanrelay=0 as shown at 795 (when fanrelay=0, the fan receives an input signal directly from the thermostat, and when fanrelay=1 the fan receives an input signal from the FAV controller). After 795, the method determines whether post_purge is greater than ninety, as shown at 796. If not, then a call for heat from the thermostat has not been over long enough to get out of the furnace post-purge state where the circulation fan continues to operate, and so the method jumps to B, taking it to B in FIG. 11N. If post_purge is greater than ninety, the method then de-energizes the damper or auxiliary relay, as shown at 797, because by this point the fan is now off, having completed the post-purge state. After step 797, the method continues to block 813 in FIG. 11N.

Figure 11L:
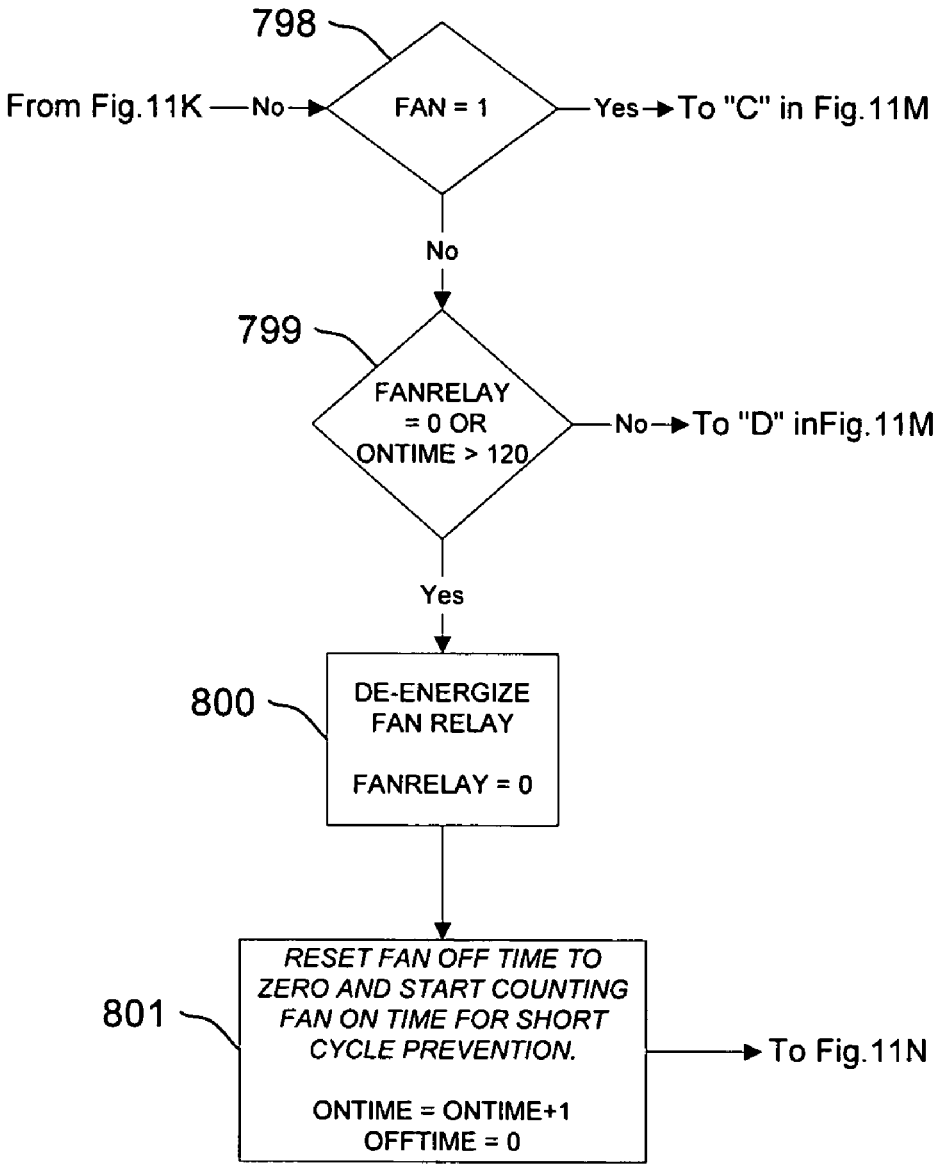

Going back to step 792, if one of statfan or fan is not zero, the method continues in FIG. 11L at 798. Turning to FIG. 11L, if fan equals one, as shown at 798, the method continues to step 802 in FIG. 11M. Otherwise, the method continues by determining if either the fanrelay is zero or the ontime is greater than one-hundred-twenty seconds as shown at 799. If the fanrelay is not zero, then the controller is controlling fan operation. If the ontime is not greater than one-hundred-twenty seconds, then not enough time has passed since fan=1 (step 798) was a true condition, so the fan cannot be turned off yet in order to avoid short-cycling. If neither condition is true in step 799, then the fan must remain on and the method continues at step 805 in FIG. 11M.

If either condition in 799 is true, then the method allows the fan relay to be turned off if it is not already off (which would be the case if, at 799, fanrelay=1 and ontime>120 seconds) as shown at 800. With fanrelay off, the FAV controller incorporating the methods of FIGS. 11A–11P, 12A–12R, and 13A–13C relinquishes control over the fan to the thermostat. Since fan does not equal one (from 798), it can be determined from step 792 (FIG. 11K) that statfan=1, such that the fan is on due to a thermostat call. Therefore, as shown in step 801, the fan ontime is incremented and the fan offtime is set to zero. From step 801, the method continues at 810 in FIG. 11N.

Figure 11M:
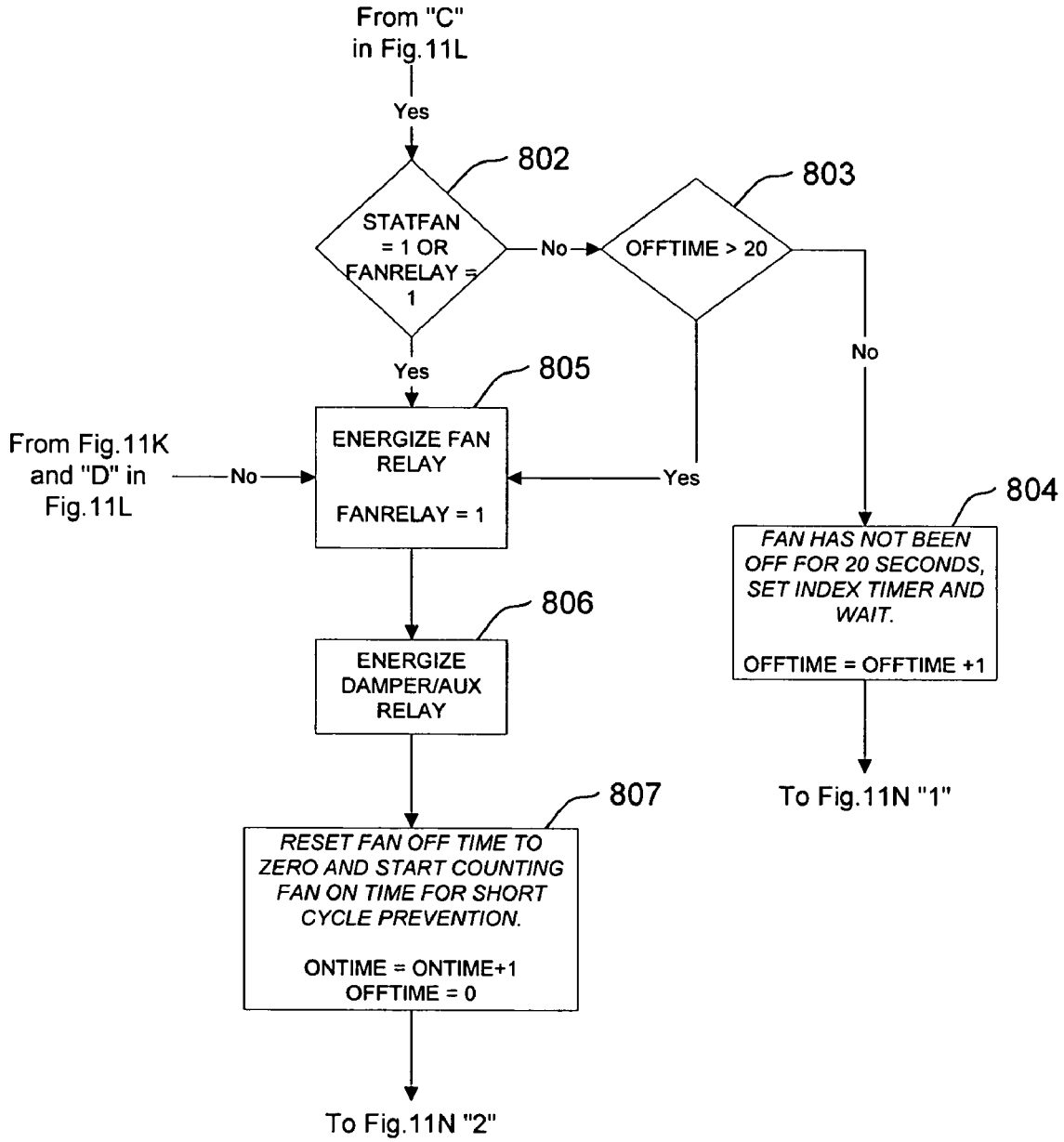

Returning to step 798, if fan=1, meaning that the controller program wants to turn the fan on, the method goes to step 802 in FIG. 11M. Turning to FIG. 11M, the method determines at 802 whether either statfan=1 or fanrelay=1. If not, then the method checks whether the offtime is greater than twenty seconds as shown at 803. If not, then the fan has not been off long enough to be turned on again, so the fan remains off and the offtime is incremented, as indicated at 804. From step 804, the method continues with step 813 in FIG. 11N.

If the offtime is greater than twenty at step 803, or if either statfan or the fanrelay are on at step 802, then the fan relay can be energized at step 805, allowing the controller to take control over the fan. Because fan=1 (from step 798 in FIG. 11L), indicating the control program has requested more ventilation, when fanrelay is set to one at step 805, the fan is activated, and the damper (if provided) is opened at step 806. With the fan activated and the damper open, the ontime is incremented and the offtime is reset to zero, as shown at 807. The method then continues at step 815 in FIG. 11N.

Now turning to FIG. 11N, if control passes into FIG. 11N from step 801 in FIG. 1L, if G_status is zero, W_status is one, and pre_purge is less than thirty seconds, the method goes to step 812. Otherwise the method determines if either the ontime for the present period is greater than that required {bin(1)>f_req*3600}, or whether the controller is enabled (by checking V_E), as shown at 811. If either condition is true, or if the conditions in step 810 are all true, the method passes to step 812 where the damper/aux relay is de-energized. After either of step 804 (FIG. 11M) or step 812, the method goes to step 813 and increments the hourtimer by one to indicate that another second has passed.

If the conditions from step 811 are not true, the method goes to step 814 and energizes the damper/aux relay and continues to step 815. Other steps leading to block 815 include block 807 in FIG. 11M and block 797 in FIG. 11K. Because the fan is on and the damper is open, the recorded ventilation time in bin(1) is incremented, as shown at 815. After step 815, the method also goes to step 813 where the hourtimer is incremented by one. Control then loops to A as shown, going to A in FIG. 13A.

FIGS. 12A–12R illustrate another portion of the method introduced in FIGS. 11A–11P. As noted above, the method of FIGS. 12A–12R is adapted to meet hourly, multi-hourly, and daily ventilation goals, as well as provide smoothing of uneven ventilation cycles during the course of a day. The overall illustrative method includes a user-selectable option of operating in accordance with FIGS. 11A–11P or in accordance with FIGS. 12A–12R, with FIGS. 13A–13C providing a system testing scheme for use in conjunction with the overall illustrative method.

The three ventilation goals selected for use in FIGS. 12A–12R include:

A. a three hour goal of ten minutes of ventilation in each three hour time block;

B. a twelve hour goal of one hour of ventilation in each twelve hour time block; and C. a twenty four hour goal that depends upon a calculated value f_req that is based, within limits, upon the size and configuration of the ventilated space FIG. 12A shows a first portion of a method beginning with the power being turned on as shown at 900. Next, the DIP switch position for a first DIP switch is read as shown at 901. If DIP_1 is closed, then the non-smoothing method of FIGS. 11A–11P is selected, and control passes to block 702 in FIG. 11A as shown at 903. Otherwise, control passes to block 904 where the conditioned floor area is read from a user input. Next the number of bedrooms is read from a user input as shown at 905. Likewise, the ventilation rate of an associated furnace fan and/or ventilation apparatus are entered and read at 906. As shown at 907, the method next calculates a desired percent on time (f_des) by the following formula:

$$\text{f_des} = \left[\frac{(0.01 * A) + (7.5 * (N + 1))}{Q}\right]$$

Next, the method goes to step 911, which reads a second dip switch position.

The second dip switch is included to enable a user to set an acceptable maximum ventilation rate. For the illustrative example, the maximum rate is a 60% limit, meaning that the desired ventilation rate is not allowed to exceed a 60% duty rate. Looking at FIG. 12B now, the method checks whether DIP_2 is open as shown at 912. If DIP_2 is open, this corresponds to a user selecting the 60% limit. If DIP_2 is closed, the user has selected unlimited ventilation operation.

If DIP_2 is not open, the method checks whether f_des is less than one, as shown at 913. If not, then the desired percentage-on-time is unattainable, since it would require the circulation fan to be on more than sixty minutes in every hour. Therefore the variable to be used in the method, f_req (for the method this is the required ventilation time) is set to one, as shown at 914. From step 914, the method also includes making note that the desired ventilation rate cannot be met so a variable called undervent_error is set to one, as shown at 915, to indicate the error. From step 915, the method goes to initialize the ventilation run time counters to zero, as shown at 916, which prepares a controller performing the method to begin operating and recording ventilation data.

If DIP_2 is not open, and f_des is less than one, the method goes from step 913 to step 917, where f_req is set to f_des to set the required ventilation on time to the desired level. Since there was no error with the desired ventilation on time, the undervent_error variable is set to zero at 918. From step 918, as with step 915, the method goes to 916.

If DIP_2 is open, the method goes from step 912 to step 919, where it is determined if the f_des is less than or equal to the chosen maximum ventilation rate of 0.6. If not, the method goes to step 920 and sets the f_req to 0.6, its maximum value. Because the desired rate exceeded the maximum allowed, the method also includes step 921 where the undervent_error variable is set to one. Again, from step 921 the method goes to step 916 where the recorded ventilation time is initialized.

If, instead, f_des is less than 0.6, the method includes setting f_req equal to f_des, as shown at 922. Next, the under_vent variable is set to zero as shown at 923, since the desired ventilation rate f_des is acceptable. Again, the method next goes to step 916 and initializes the recorded ventilation time. In step 916 the method first sets the present hour's recorded ventilation time to zero (bin(1)=0). Also in step 916, since the system has just been turned on, the ventilation history is initialized by iteration. Since the method of FIGS. 12A–12R includes a smoothing function as well as multi-hour ventilation goals, starting with the ventilation history set to zero would cause over-ventilation initially to meet the longer multi-hour goals. To avoid this, the prior history bins (bin(2) to bin(25)) are filled with the average required ventilation time by the iterative step:

for i=2 to 25, bin($i$)=3600*$f$_req

Figure 12C:
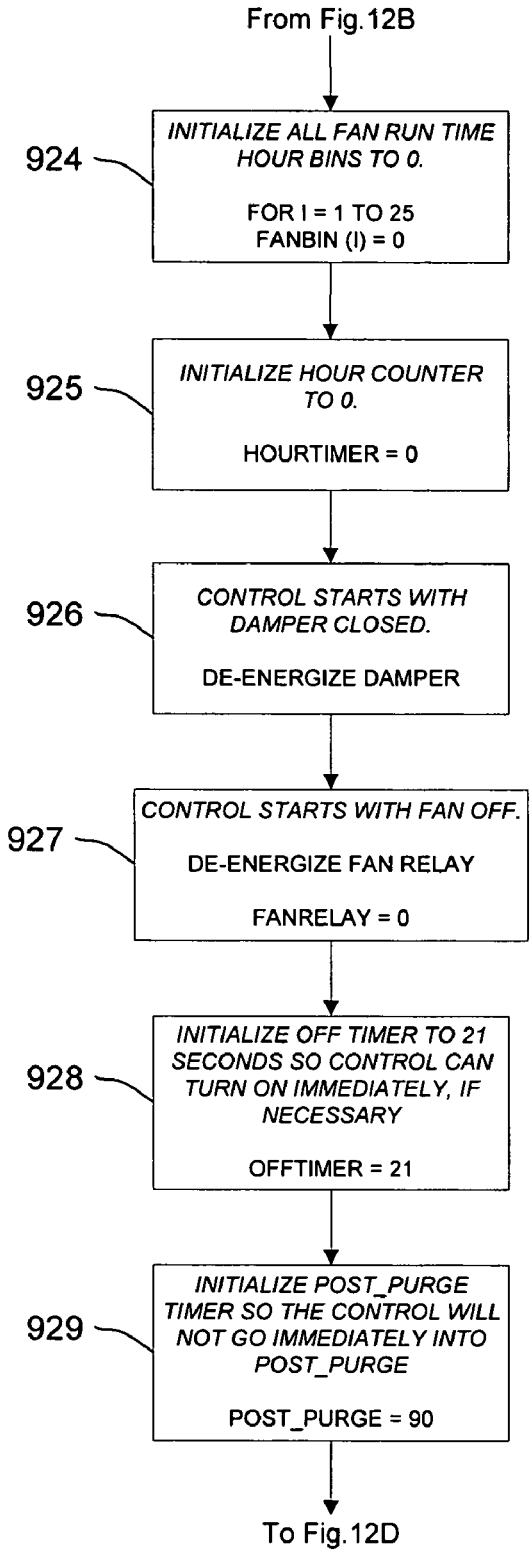

Turning to FIG. 12C, the method initializes several counters. First, a fanbin fan history counter set is initialized to have all zeroes therein, as shown at 924. The fanbin variable represents the amount of time in each respective hour that the ventilation fan is run when the thermostat is not on or does not call for fan operation due to heating or cooling. The fanbin variables are used in particular to establish a smoothing function.

As shown at 925 the hourtimer is set to zero, indicating the start of an hour. Next the control starts with the damper de-energized, as shown at 926. The control also starts without control over the fan, de-energizing the fanrelay as shown at 927. The off timer is set to twenty-one seconds to allow the fan to turn on immediately if desired, as shown at 928. The step in block 928 is performed because the method is adapted to prevent short-cycling of the ventilation fan by the use of an off-timer counter that determines how long the fan has been off since its last cycle. By setting the offtimer to twenty-one seconds, the off-timer is prevented from keeping the method from turning the fan on within the first twenty-one seconds of control. As another feature, the method may include setting a post_purge timer to ninety seconds or any other suitable value, as shown at 929. The post_purge timer is used to account for fan time where the circulation fan is on due to the furnace being in a post-purge state because, after furnace operation, the circulation fan continues to operate for a period of time. (e.g. ninety seconds) after the thermostat stops calling for additional heat.

Figure 12D:
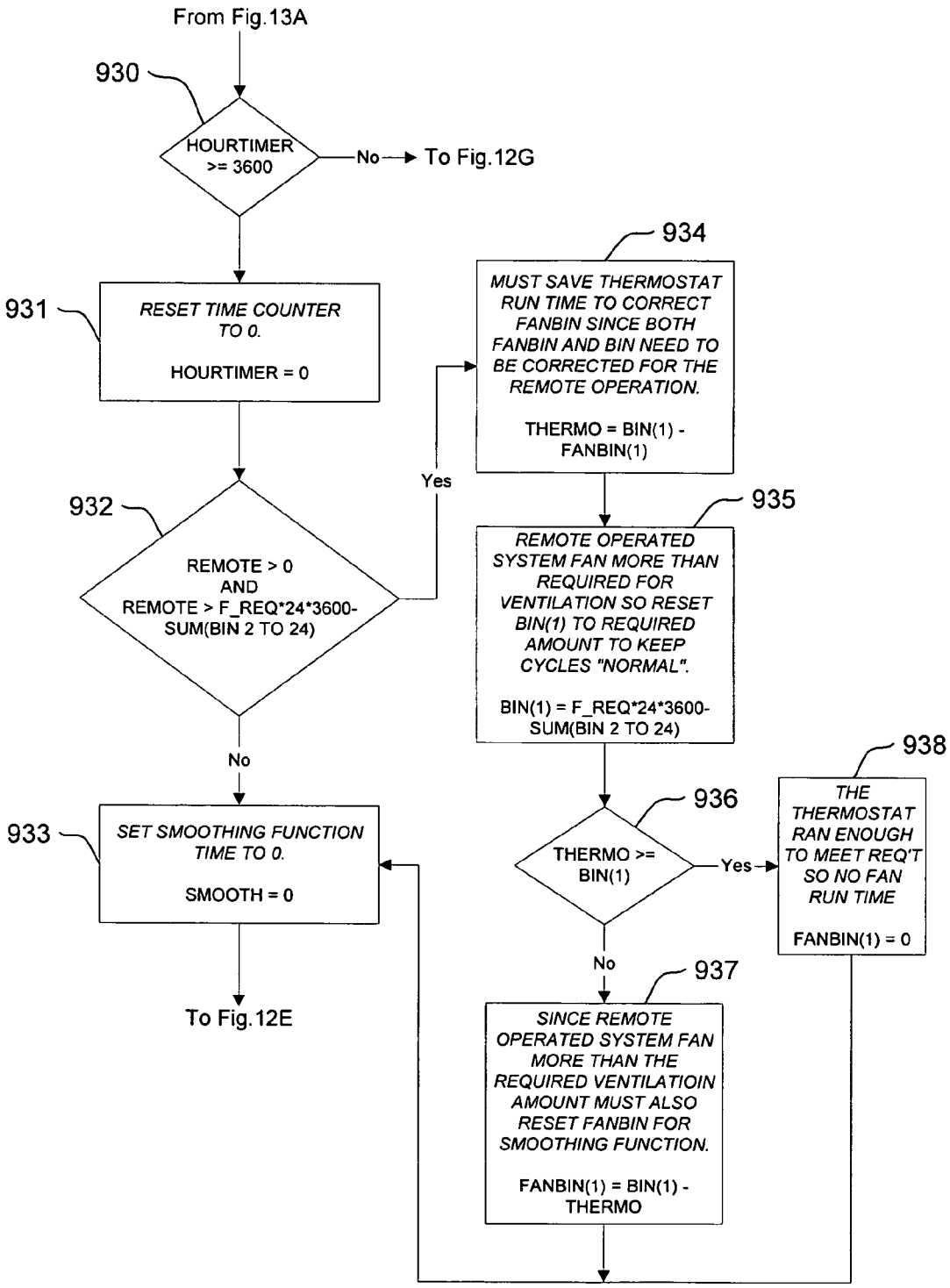

From step 929 in FIG. 12C, the method moves to 930 in FIG. 12D. In step 930, the method determines whether the hourtimer has exceeded 3600 seconds, or one hour. It should be noted as well that this is the return step for the method, which comes from FIG. 13A to the check of the hourtimer at 930. If the hourtimer has exceeded 3600, then the hourtimer is reset as shown at 931.

Next, the method determines whether the remote control (which, if on, causes full time ventilation until turned off) was on longer than necessary to meet the ventilation needs for the past hour, as shown at 932. Note that, for 932, the amount of ventilation needed in the most recent hour to meet a twenty-four hour ventilation standard is the ventilation required in the twenty four hour period (f_req*24*3600) less the amount of ventilation in the previous twenty-three hours (sum(bin2 to 24)). If not, then the method simply continues to initializing the smooth variable to start calculating a smoothing function by setting smooth to zero, as shown at 933.

If the query in 932 returns a positive result, the method saves the thermostat run time to correct the fanbin time in order to correct for the excess remote operation. First a variable thermo is set to the difference between bin(1) and fanbin(1), as shown at 934. Next, the recorded ventilation time for the most recent hour (bin(1)) is set to the amount of ventilation that was required in the previous hour, as shown at 935. Next, the method determines whether the thermo variable is greater than the adjusted bin(1), as shown at 936. If not, then, because the remote operated the system more than the required ventilation amount, the fanbin variable must also be set to provide for the smoothing function. This step is performed by setting fanbin(1) equal to the bin(1)) less thermo, as shown at 937. If the adjusted bin(1)) is less than the thermo variable, then the thermostat ran enough to meet the ventilation requirement, so fanbin(1)) would have been zero. Therefore the method sets fanbin(1)) to zero as shown at 938, and then goes to step 933. After step 933, the method continues to block 939 in FIG. 12E.

Figure 12E:
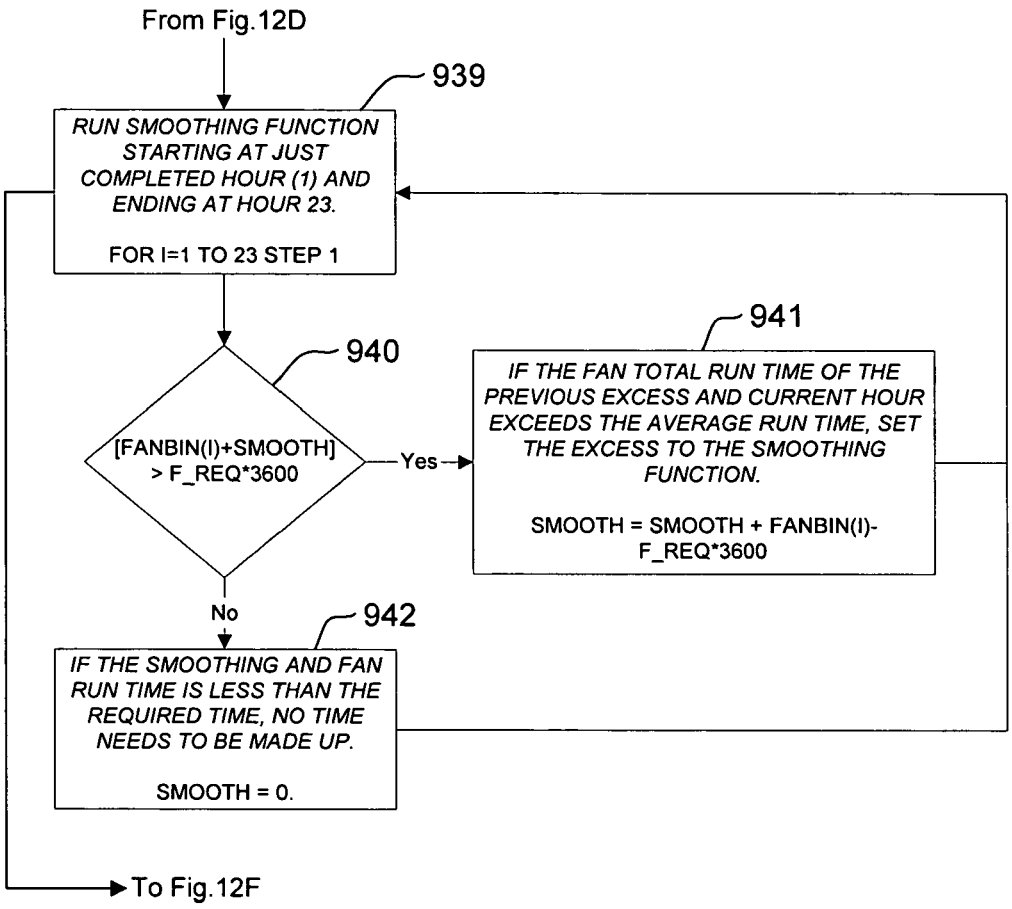

FIG. 12E illustrates calculation of the smoothing function. As shown at 939, the smoothing function operates for i equals one to twenty three. As shown at 940, for each i, if (fanbin(i)+smooth)>f_req*3600, the method goes to step 941. The calculation in 940, in words, determines whether the sum of the fanbin for an hour plus the value of smooth at that time is greater than the twenty-four hour average amount of ventilation required in an hour.

If the method goes to step 941, the excess is added to the smoothing function by the step:

smooth=smooth+fanbin($i$)−($f$_$req$*3600)

Otherwise, if the sum of the smoothing function plus the fanbin for an hour is less than the twenty four hour average per hour, the smoothing function is set to zero, as shown at 942. This is one illustrative method of calculating a smoothing function.

Figure 12F:
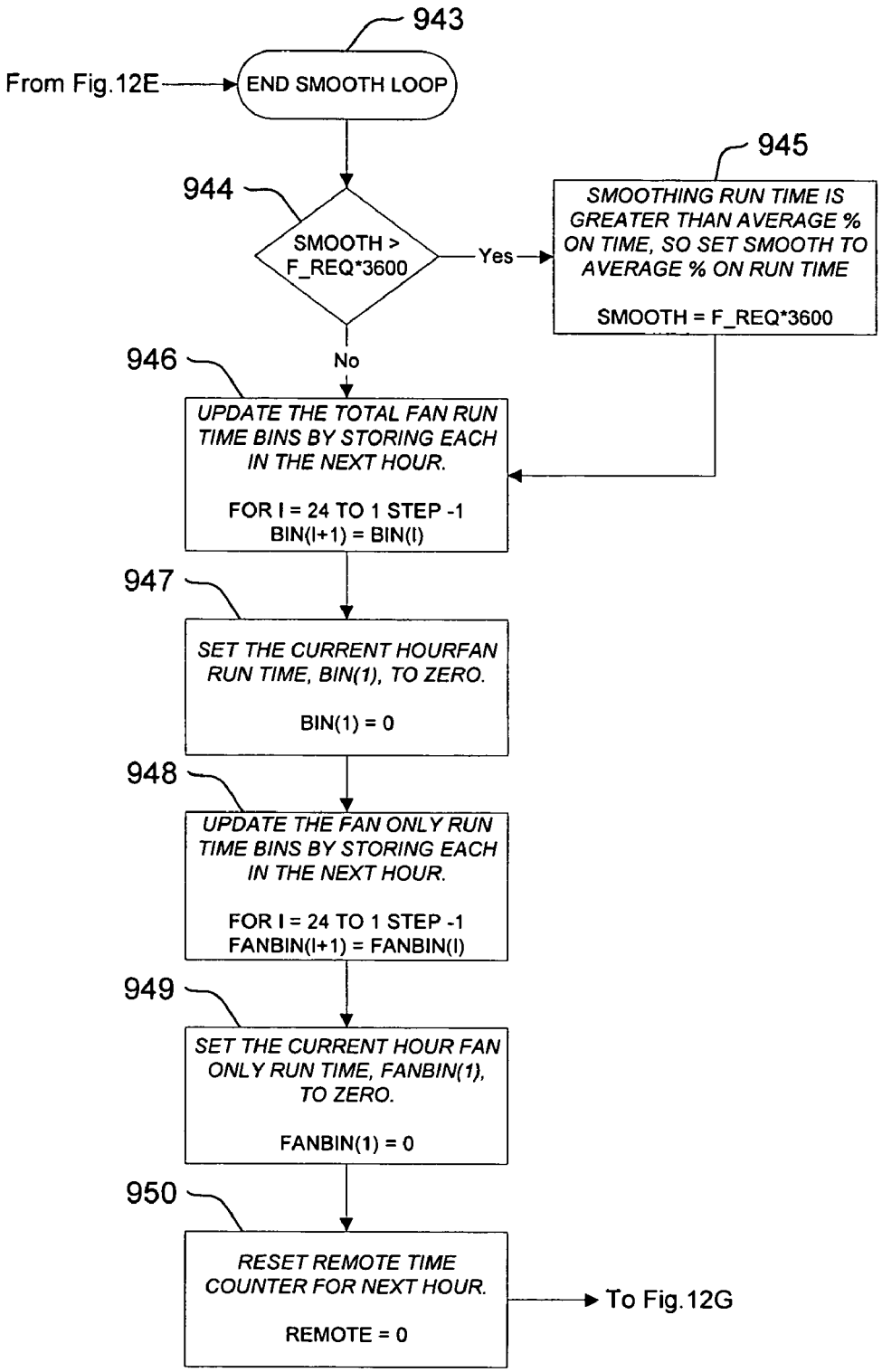

Having completed iterations for i=1 to 23 in FIG. 12E, the method ends the smooth loop as shown at 943 in FIG. 12F. Then the smoothing function is compared to the twenty-four hour average ventilation per hour, as shown at 944. If the smoothing function exceeds the twenty-four hour ventilation per hour at 944, the method goes to step 945 and sets the smoothing function to the twenty four hour ventilation per hour. Then, from either 944 or 945, the method updates the total fan run time bins by storing each hour in the next hour, as shown at 946. Next, the recorded ventilation time in bin(1)) is reset to zero, as shown at 947.

Then, the method shifts the fanbin fan only run times by storing each in the next hour, as shown at 948. The current hour fan only run time, fanbin(1)), is then reset to zero, as shown at 949. Finally, the remote time counter is set to zero as shown at 950.

Figure 12G:
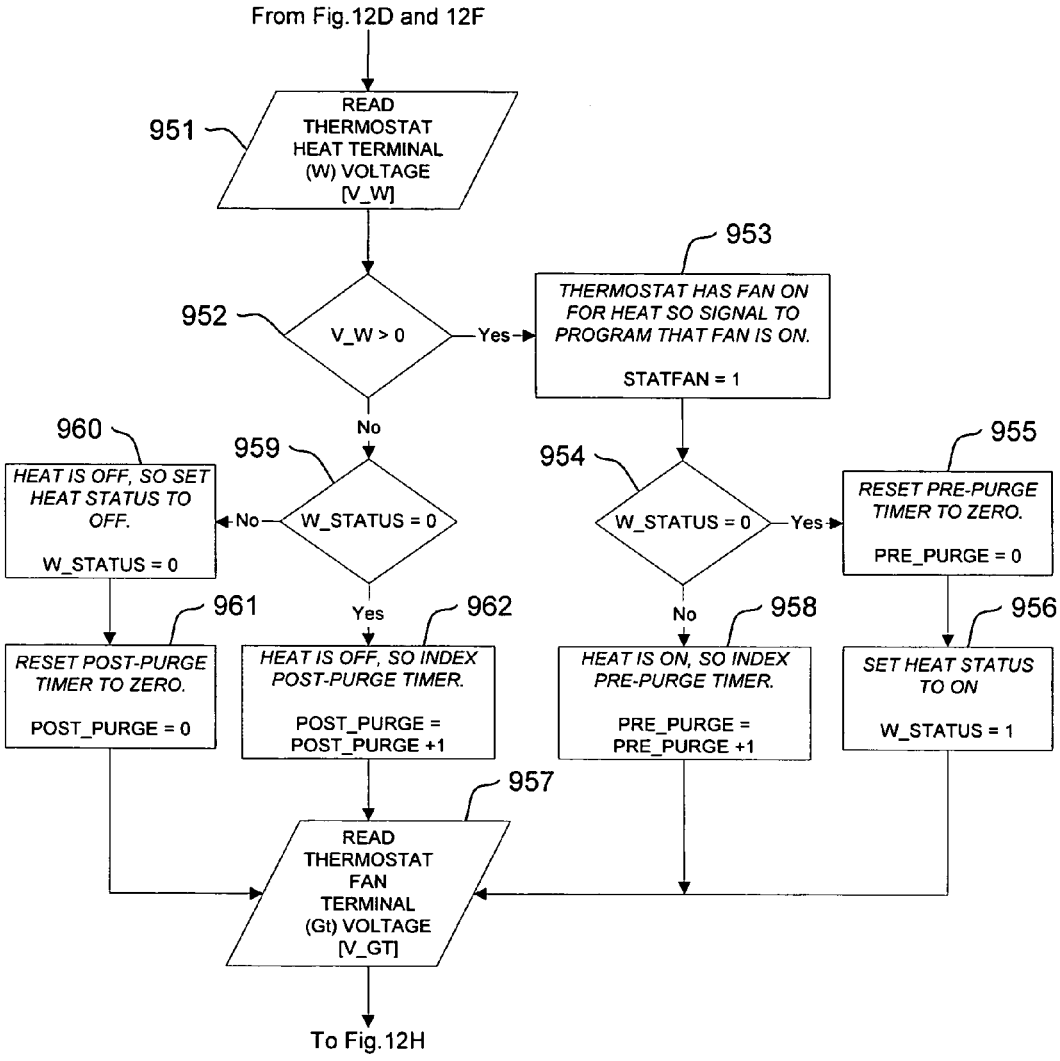

From 950, the method continues at step 951 in FIG. 12G. Likewise, if the hourtimer has not exceeded 3600 seconds as checked at step 930, the method continues with step 951 in FIG. 12G. The thermostat heat terminal voltage V_w is read in step 951. This is enabled by providing the controller with an input from the thermostat heat terminal using, for example, a configuration as in any of FIGS. 9A–9E. In step 952, the voltage V_w is checked to determine whether the thermostat has activated the furnace for heating purposes, which causes the circulation fan to activate as well.

If V_w indicates that the thermostat has called for heat at 952, then the method sets the statfan variable (which indicates the thermostat's circulation fan call status) to one, as shown at 953. Next the method checks whether W_status, the 'controller's variable for monitoring whether the thermostat has called for heating, is zero, as shown at 954. If W_status is zero, then the pre-purge timer is set to zero as shown at 955, which is done since the pre-purge timer counts the time at the beginning of a heat cycle when the fan is not on due to the furnace being in a pre-purge state. This pre-purge time (the first thirty seconds of a heat call) does not count as ventilation time because the circulation fan is not actually on yet. The prepurge timer is reset at this point because W_status being zero indicates that the call for heat has just occurred. As shown at 956, after the prepurge timer is reset W_status is set to one indicating that the call for heat is no longer new. The method then goes to step 957 where the thermostat fan terminal voltage V_Gt is read.

If W_status is one at step 954, the method goes to step 958 where the pre-purge timer is incremented. This indicates that the heat call from the thermostat has been ongoing for an additional second. The method again goes to step 957 after the pre-purge timer is incremented.

Going back to step 952, if V_w is zero, indicating that the thermostat does not have the fan on for heating, the method checks whether the controller variable W_status is zero as shown at 959. If not, then, since the heat is newly off (the heat is newly off because the W_status variable is still one from when the heat was on), the method includes the steps of setting W_status to zero, shown at 960, and setting a post_purge value to zero, as shown at 961. The post-purge value is used to keep the damper (if provided) open during the furnace's post-purge state, during which the circulation fan is on. The method then goes to step 957, as before.

If W_status at step 959 is zero, then the furnace has been off for at least one iteration of the method. Therefore, as shown at 962, the post-purge variable is incremented. The method again goes to step 957 to read the thermostat fan terminal voltage V_Gt. V_Gt may be read by the controller by the use of a wiring scheme such as one of those shown in FIGS. 9A–9E. With V_Gt read, the method goes to step 963 in FIG. 12H.

Figure 12H:
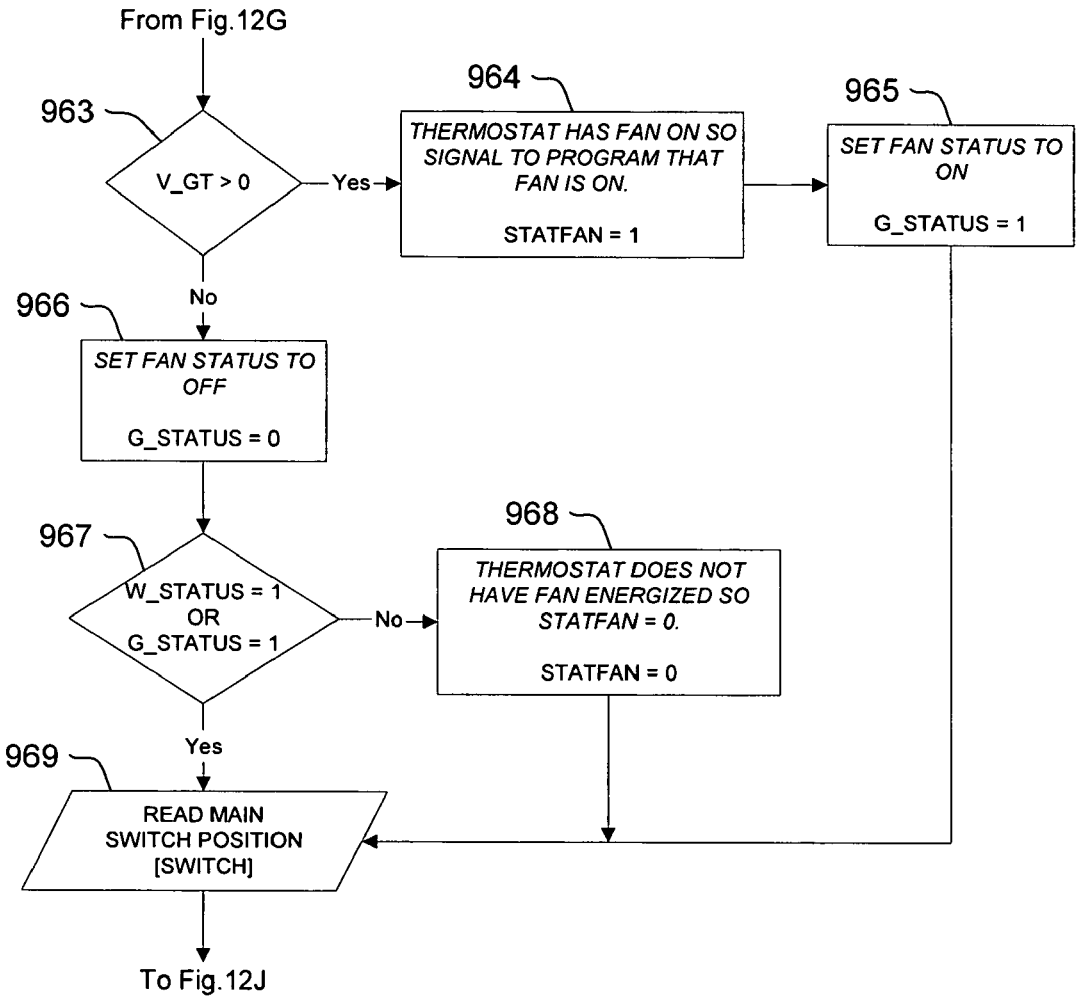

Turning to FIG. 12H, the method continues by determining whether V_Gt is greater than zero, as shown at 963. If so, then the thermostat has the fan on and so the statfan variable is set to one as shown at 964. Next the fan status is set to one by setting the G_status variable to one, as shown at 965. Having observed and set the fan status, the main switch position is read at 969. The main control switch can have at least three illustrative positions, including "REMOTE ONLY", "AUTO", or "CONTINUOUS".

If V_Gt is not greater than one, then the thermostat does not have the fan on, and the method goes from step 963 to step 966. The fan status is set to off, as shown at 966. Then the method determines whether W_status or G_status is equal to one, as shown at 967. If neither W_status nor G_status is one, then the thermostat has the fan off, so statfan is set to zero as shown at 968. Either from step 967 or step 968, the method continues to step 969 where the main switch position is read.

Figure 12J:
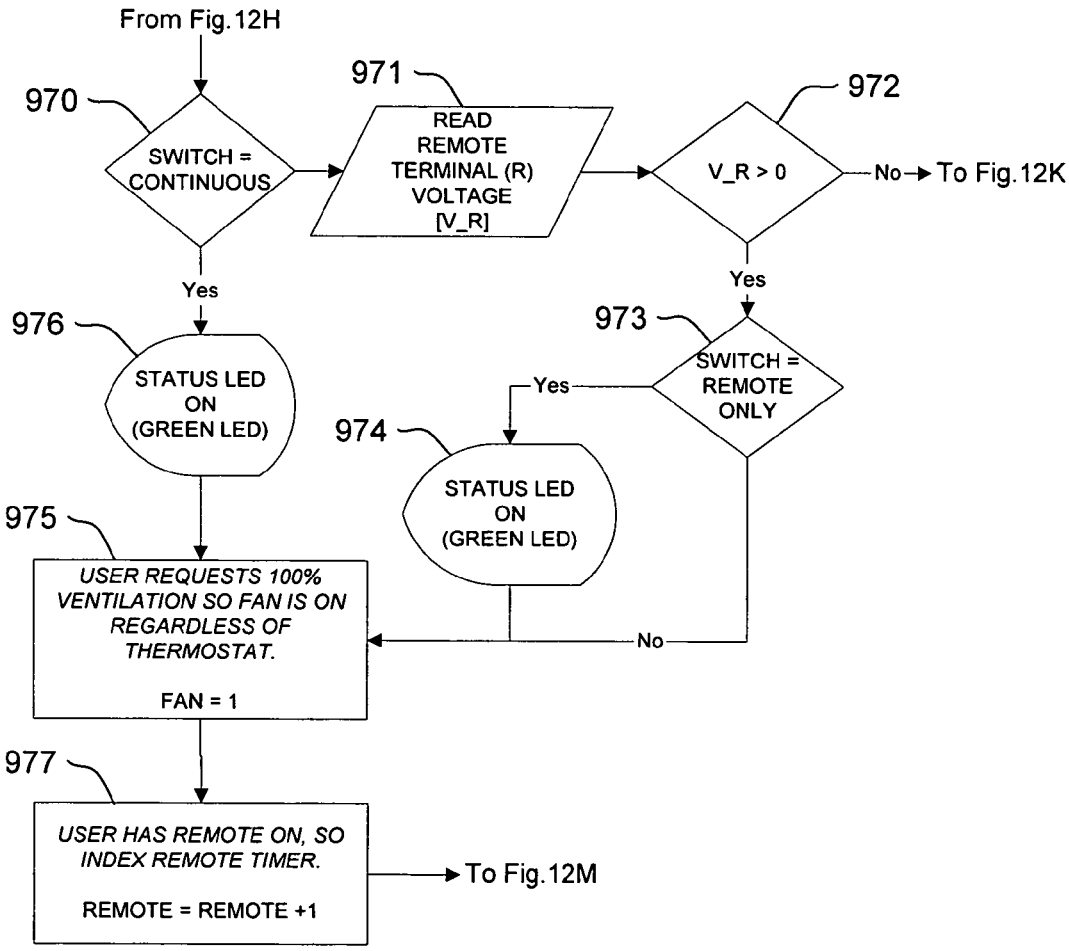

Looking now at FIG. 12J, the method determines whether the main switch is set to continuous, as shown at 970. If not, then the method reads the remote terminal voltage V_R, as shown at 971, and determines whether V_R is on, as shown at 972. If not, then the method goes to step 978 in FIG. 12K. If V_R is on at 972, then the method determines whether the switch is set to remote only, as shown at 973. If the switch is in the REMOTE ONLY position, and the remote terminal voltage V_R is high, then a green status LED is turned on as shown at 974 to indicate that the user has requested 100% ventilation, as noted at 975. Also shown at 975 is that the variable "fan" is set to one, indicating that the ventilation program wants the fan to be on. Going back to the determination of whether SWITCH is set to CONTINUOUS at 970, if the result is positive then the green status LED is turned on as shown at 976, and the method again goes to block 975. Since the user has the remote on, the remote timer is indexed to account for this time, as shown at 977. From 977, the method continues at 992 in FIG. 12M.

Figure 12K:
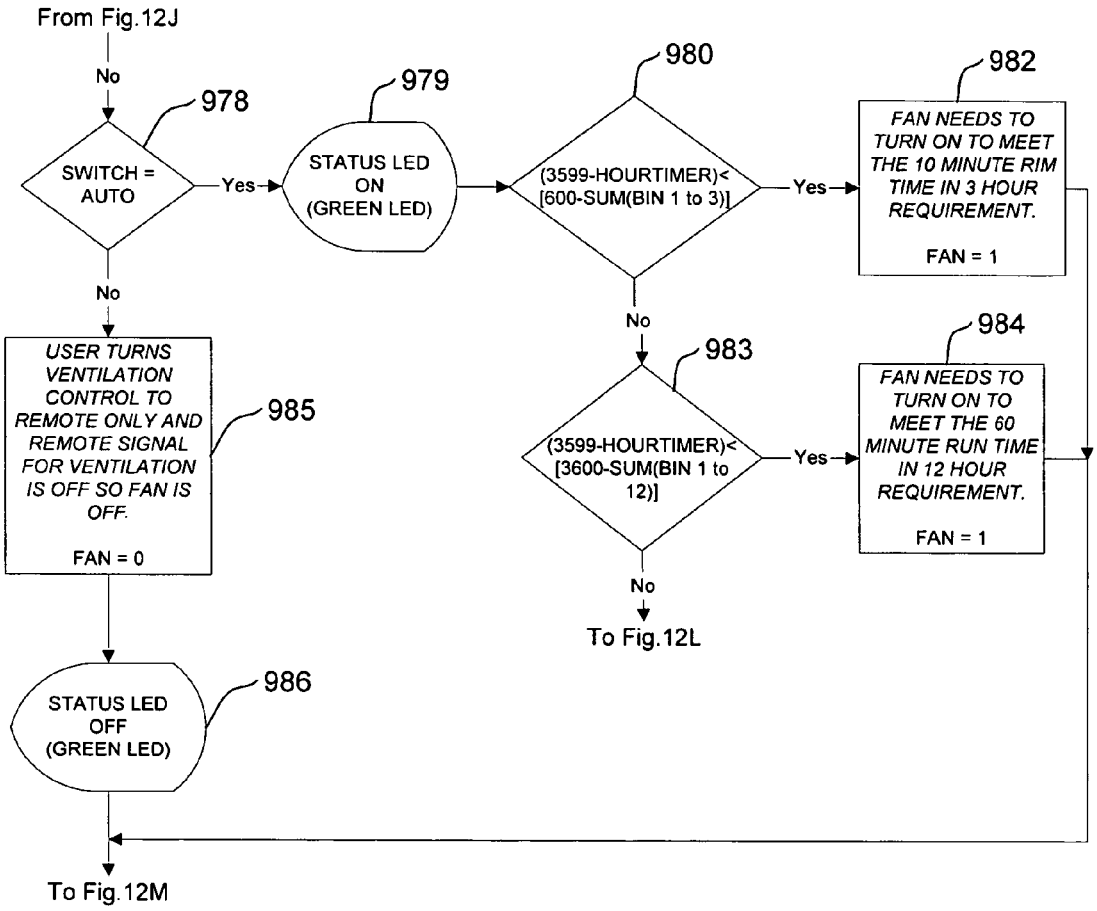

Looking now at FIG. 12K, coming from 972 in FIG. 12H, the method determines whether SWITCH is set to AUTO, as shown at 978. If so, then the green status LED is turned on as shown at 979. From 979, the method next determines whether the fan needs to turn on from the equation shown at 980:

$$(3599-\text{hourtimer})<\{600-\text{sum}(\text{bin1to3})\}$$

If the result is true, then the fan must be turned on to meet the ten-minutes-per-three-hours ventilation goal, so the variable "fan" is set to one, as shown at 982. From block 982 the method continues with block 992 in FIG. 12M. If the result from 980 is false, the method next checks whether a twelve hour ventilation goal has been met at 983. The equation this time is:

$$(3599-\text{hourtimer})<\{3600-\text{sum}(\text{bin1to12})\}$$

If the result is true, then the fan must be turned on to meet the one-hour-per-twelve-hours ventilation goal, so the variable "fan" is set to one, as shown at 984. From block 984, the method continues with block 992 in FIG. 12M. If the result from 983 is false, the method goes to block 987 in FIG. 12L.

Going back to 978 in FIG. 12K, if SWITCH is not set to AUTO, then the only choice left for the switch is REMOTE, having eliminated AUTO at 978 and CONTINUOUS at 970 (FIG. 12J). In order to reach step 978, the method had to determine that the remote terminal voltage was off at step 972 in FIG. 12J, so it can be concluded, as noted at 985, that the user has the switch set to REMOTE ONLY and the remote signal for ventilation is off. Therefore, as also shown at 985, the variable "fan" is set to zero and, as shown at 986, the green status LED is turned OFF. The method then continues with step 992 in FIG. 12M.

Figure 12L:
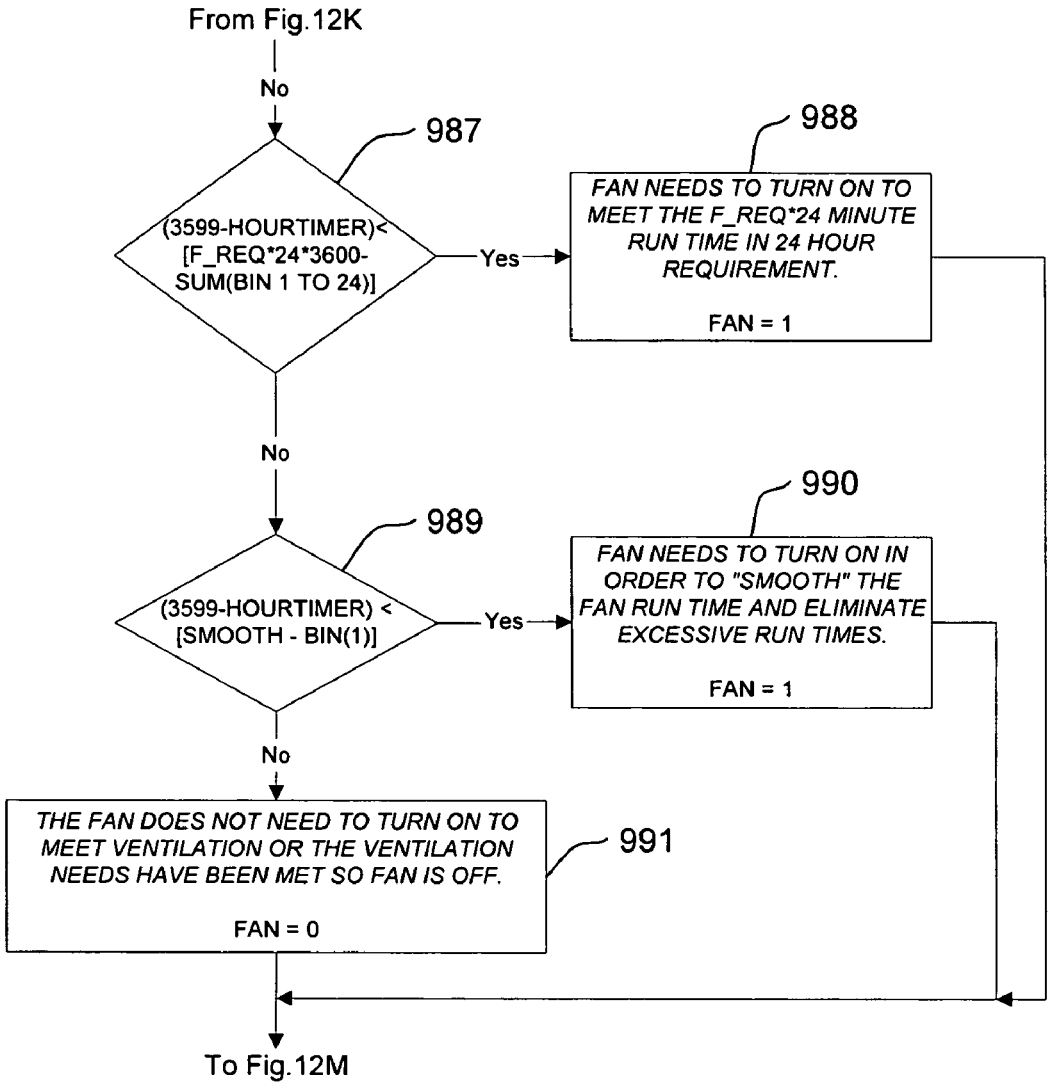

Turning now to FIG. 12L, as shown at block 987 the method next determines whether the fan needs to turn on to meet a twenty-four hour ventilation goal using the equation:

$$(3599-\text{hourtimer})<\{f_req*24*3600-\text{sum}(\text{bin1to24})\}$$

If the result is true, then the fan must be turned on to meet the twenty-four hour desired ventilation level, so the variable "fan" is set to one, as shown at 988. If the fan does not need to turn on to meet the twenty-four hour goal, then the method turns to the smoothing function. As shown in block 989, the method checks the following equation:

$$(3599-\text{hourtimer})<(\text{smooth}-\text{bin1})$$

If the time left in the present hour is less than the smooth function minus the fan ontime in the present hour, then the fan is activated as shown at 990. Otherwise, as noted at 991, the fan does not need to turn on to meet ventilation goals, or the ventilation goals have already been satisfied. The method then goes to step 992 in FIG. 12M.

Figure 12M:
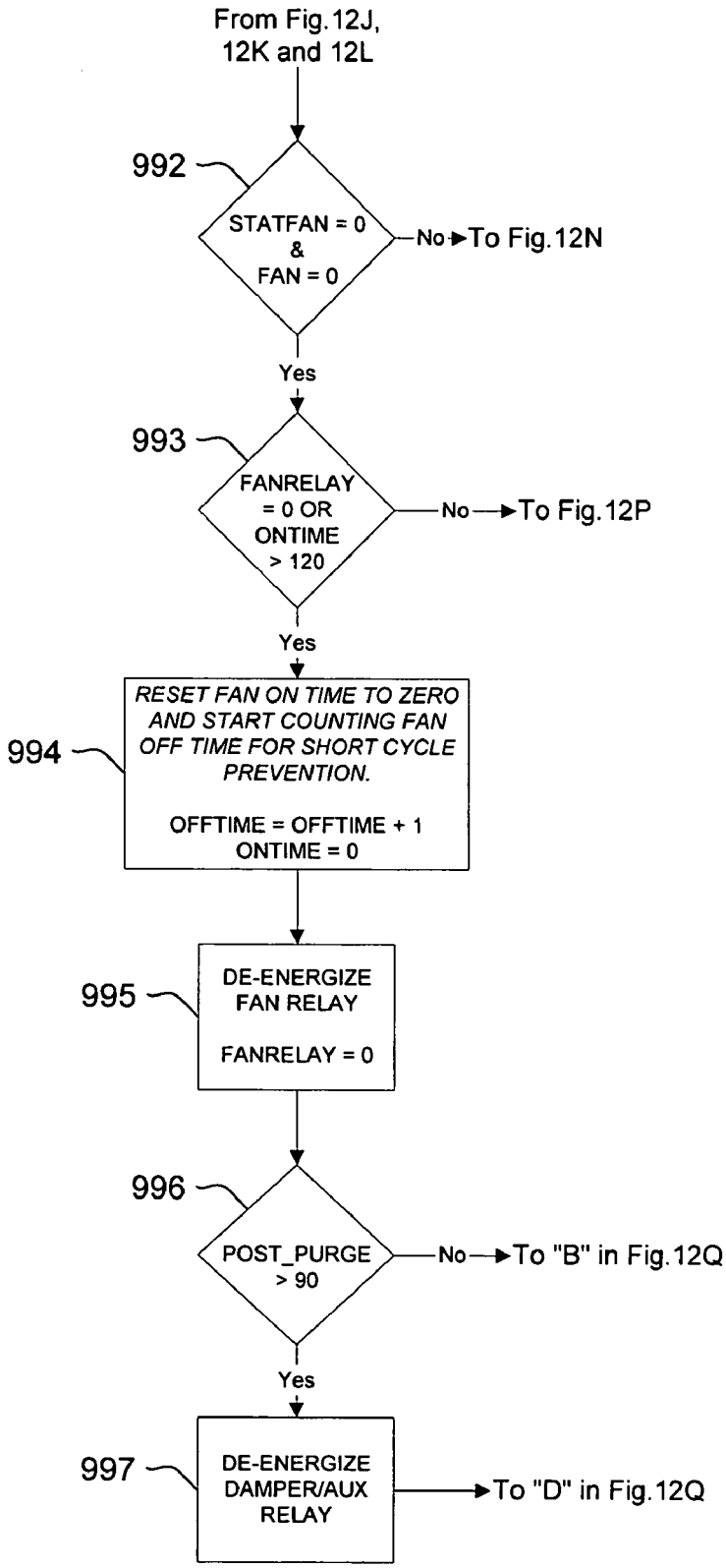

Looking now at FIG. 12M, the method continues by determining whether both statfan and fan are set to zero, as shown at 992. If not, then the method continues with step 998 in FIG. 12N. If, instead, both statfan and fan are zero at 992, the method next determines whether either fanrelay is zero or the ontime is greater than one-hundred-twenty seconds, as shown at 993. If not, the method continues at 1005 in FIG. 12P.

If either fanrelay is zero or the ontime is greater than one-hundred-twenty seconds at 993 then, because neither the program nor the thermostat are calling for fan operation (both fan=0 and statfan=0) and the minimum ontime has been met (ontime>120) or the controller is already not controlling fan operation (fanrelay=0), the method increments the offtime and sets the ontime to zero, as shown at 994, and reassures that the controller does not have fan control setting fanrelay=0 as shown at 995 (when fanrelay=0, the fan receives an input signal directly from the thermostat, and when fanrelay=1 the fan receives an input signal from the FAV controller).

After 995, the method determines whether post_purge is greater than ninety, as shown at 996. If not, then a call for heat from the thermostat has not been over long enough to get out of the furnace post-purge state where the circulation fan continues to operate, and so the method jumps to B, taking it to B in FIG. 12Q. If post_purge is greater than ninety, the method then de-energizes the damper or auxiliary relay, as shown at 997, because by this point the fan is now off, having completed the post-purge state. After step 997, the method continues to block 1013 in FIG. 12Q.

Figure 12N:
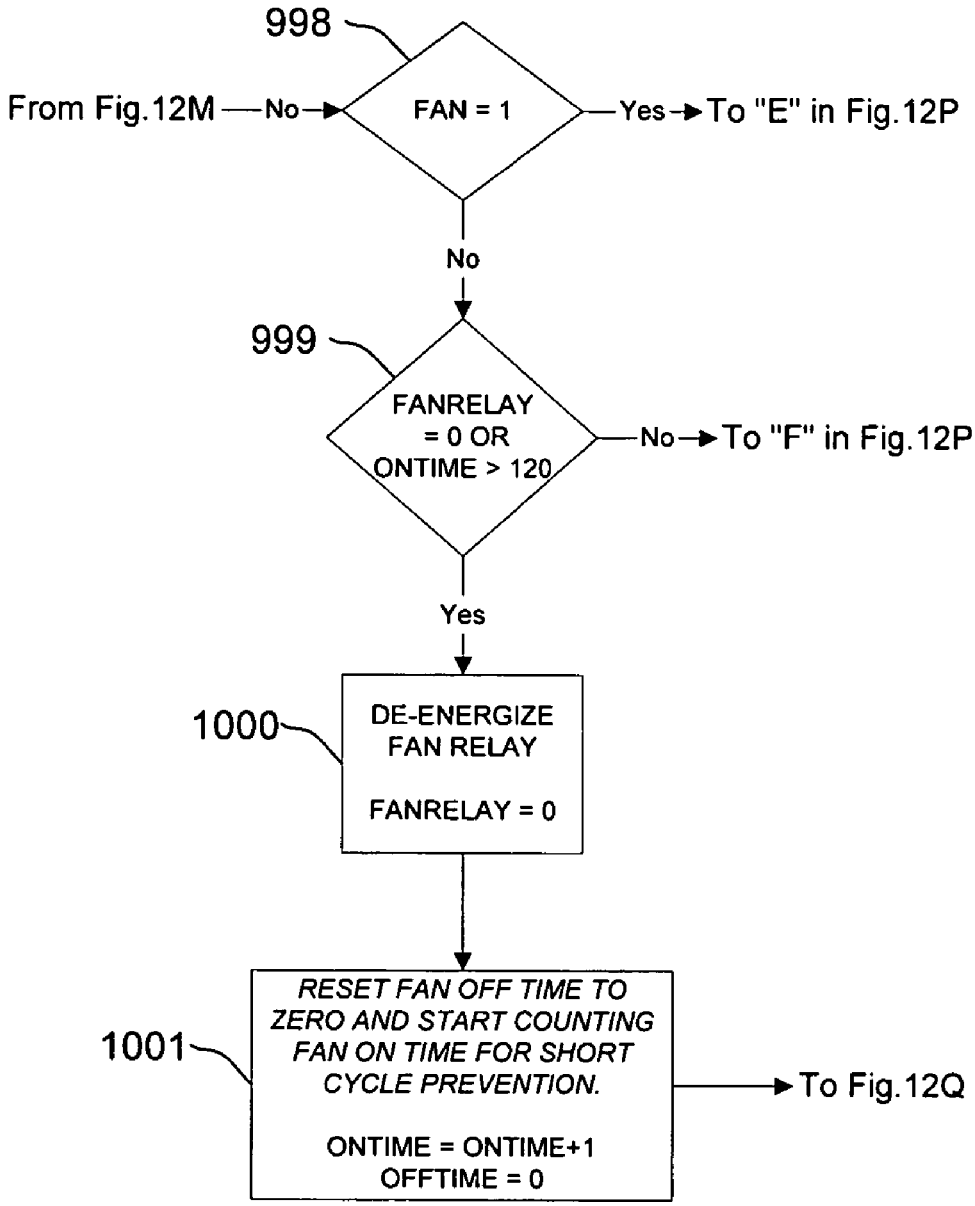

Going back to step 992, if one of statfan or fan is not zero, the method continues in FIG. 12N at 998. Turning to FIG. 12N, if fan equals one, as shown at 998, the method continues to step 1002 in FIG. 12P. Otherwise, the method continues by determining if either the fanrelay is zero or the ontime is greater than one-hundred-twenty seconds as shown at 999. If the fanrelay is not zero, then the controller is controlling fan operation. If the ontime is not greater than one-hundred-twenty seconds, then not enough time has passed since fan=1 (step 998) was a true condition, so the fan cannot be turned off yet in order to avoid short-cycling. If neither condition is true in step 999, then the fan must remain on and the method continues at step 1005 in FIG. 12P.

If either condition in 999 is true, then the method allows the fan relay to be turned off if it is not already off (which would be the case if, at 999, fanrelay=1 and ontime>120 seconds) as shown at 1000. With fanrelay off, the FAV controller incorporating the methods of FIGS. 11A–11P, 12A–12R, and 13A–13C relinquishes control over the fan to the thermostat. Since fan does not equal one (from 998), it can be determined from step 992 (FIG. 12M) that statfan=1, such that the fan is on due to a thermostat call. Therefore, as shown in step 1001, the fan ontime is incremented and the fan offtime is set to zero. From step 1001, the method continues at 1010 in FIG. 12Q.

Figure 12P:
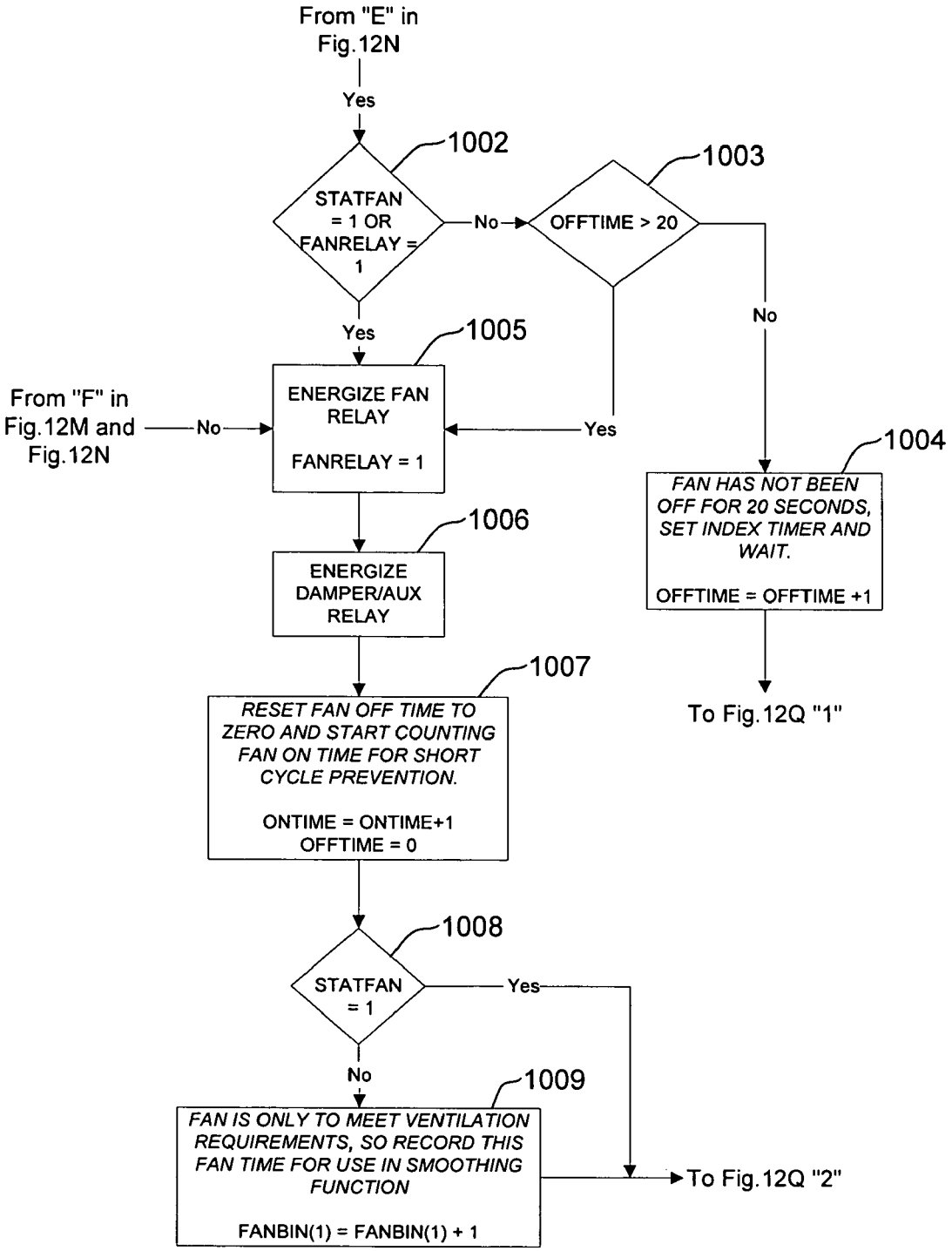

Returning to step 998, if fan=1, meaning that the controller program wants to turn the fan on, the method goes to step 1002 in FIG. 12P. Turning to FIG. 12P, the method determines at 1002 whether either statfan=1 or fanrelay=1. If not, then the method checks whether the offtime is greater than twenty seconds as shown at 1003. If not, then the fan has not been off long enough to be turned on again, so the fan remains off and the offtime is incremented, as indicated at 1004. From step 1004, the method continues with step 1013 in FIG. 12Q.

If the offtime is greater than twenty at step 1003, or if either statfan or the fanrelay are on at step 1002, then the fan relay can be energized at step 1005, allowing the controller to take control over the fan. Because fan=1 (from step 998 in FIG. 12N), indicating the control program has requested more ventilation, when fanrelay is set to one at step 1005, the fan is activated, and the damper (if provided) is opened at step 1006. With the fan activated and the damper open, the ontime is incremented and the offtime is reset to zero, as shown at 1007. Next the statfan variable is checked, as shown at 1008. If statfan is one, the method continues at step 1015 in FIG. 12Q. If statfan is zero at 1008, it would indicate that the fan is on only to meet ventilation requirements, so the method increments fanbin(1)), as shown at 1009. Incrementing the fanbin(1)) at 1009 enables the smoothing function by recording the ventilation only fan run times.

Figure 12Q:
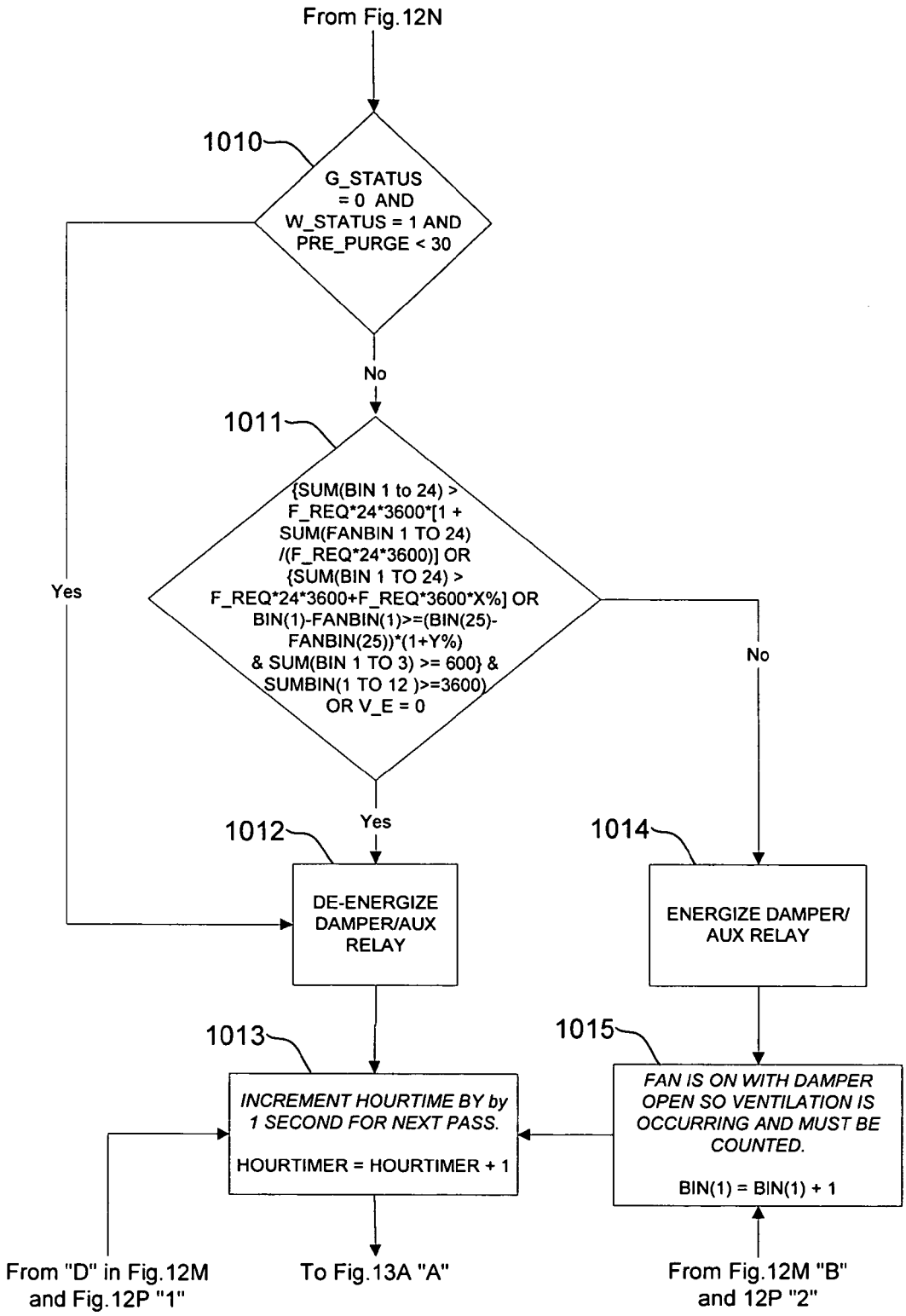

Now turning to FIG. 12Q, if control passes into FIG. 12Q from step 1001 in FIG. 12N, if G_status is zero, W_status is one, and pre_purge is less than thirty seconds, the method goes to step 1012. Otherwise the method performs the logical determination shown in 1011. A first portion of the logical determination includes the following three comparisons which are treated as an "OR". First:

$$\text{sum(bin1to24)} > f_req*24*3600*(1+\text{sum(fanbin1to24)}/f_req*24*3600)$$

Parsing this equation out, the query is whether the amount of ventilation in the present hour plus the last twenty-three hours is greater than the product of the desired twenty-four-hour ventilation and a first overvent factor. The first overvent factor is one plus the quotient of the total ventilation only fan operation for the last twenty four hours and the desired total ventilation for the last twenty four hours.

A second portion of the logical determination of 1011 is:

$$\text{sum(bin1to24)} > f_req*24*3600+f_req*3600*X$$

Parsing this equation out, the query is whether the amount of ventilation in the present hour plus the last twenty three hours is greater than the desired total ventilation for twenty-four hours plus a second overvent factor that is determined from a percentage number X that may be preselected and input into a controller. In an illustrative method, X may be about five percent, though another suitable value may be chosen.

A third part of the logical determination at 1011 is:

$$\text{bin}(\mathbf{1})-\text{fanbin}(\mathbf{1}) \geqq \{\text{bin}(25)-\text{fanbin}(25)\}*(1+Y)$$

Parsing this equation out, the difference between the present total ventilation and ventilation-only run time is compared to the difference between the total ventilation and ventilation-only run time for the corresponding hour from a day ago times an adjustment factor. This step limits the ventilation time of the present hour by comparing it to a corresponding hour for a day earlier.

If one of the above logical determinations of block 1011, this outcome is treated to a logical "AND" with queries regarding a three hour ventilation goal, (sum(bin1 to 3)>=600, and twelve hour ventilation goal, (sum(bin(1 to 3))>=3600. If each of these other queries is true, then the method moves to block 1012. Also, if V_E is zero, indicating the controller is not enabled, the method goes to block 1012.

If the method passes to step 1012, the damper/aux relay is de-energized. When the damper/aux relay is de-energized, the damper (if provided) is closed and no fresh air ventilation occurs. After either of step 1004 (FIG. 12P), step 997 (FIG. 12M), or step 1012, the method goes to step 1013 and increments the hourtimer by one to indicate that another second has passed. With the hourtimer having been incremented, the method returns to A. It should be noted that the entire method is to be performed once every second. With some processors, this may require a wait time at the end of step 1013 before iteration back to A.

If the conditions from step 1011 are not met, the method goes to step 1014 and energizes the damper/aux relay and continues to step 1015. Other steps leading to block 1015 include block 1007 in FIG. 12P and block 996 in FIG. 12M. Because the fan is on and the damper is open, the recorded ventilation time in bin(1)) is incremented, as shown at 1015. After step 1015, the method also goes to step 1013 where the hourtimer is incremented by one. Control loops to A as shown taking the method A in FIG. 13A.

In another embodiment, the steps 701, 702, 703 and 801, 802, 803 may be performed before going from FIG. 13A to FIG. 11E or 12D, before steps 730 or 930, respectively. This way a user could switch, during operation, from one type of ventilation to the other. For such a method, steps such as steps 707–710 shown in FIGS. 11A–11B may need to be repeated as well if the user makes such a switch. A change of selected method could also be performed, for example, using interrupts, flags, or any number of known subroutine forms that are initiated either through software checks on variables or hardware driven interrupts.

Figure 13B:
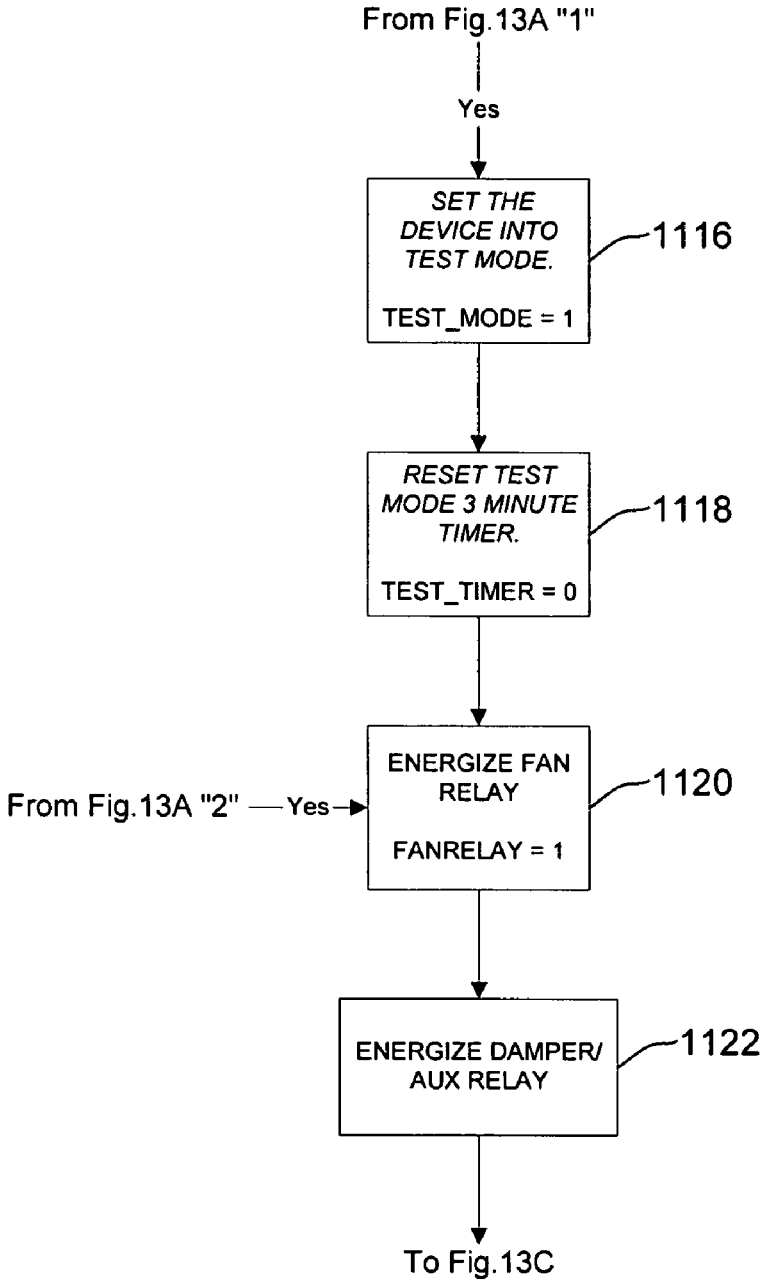
Figure 13C:
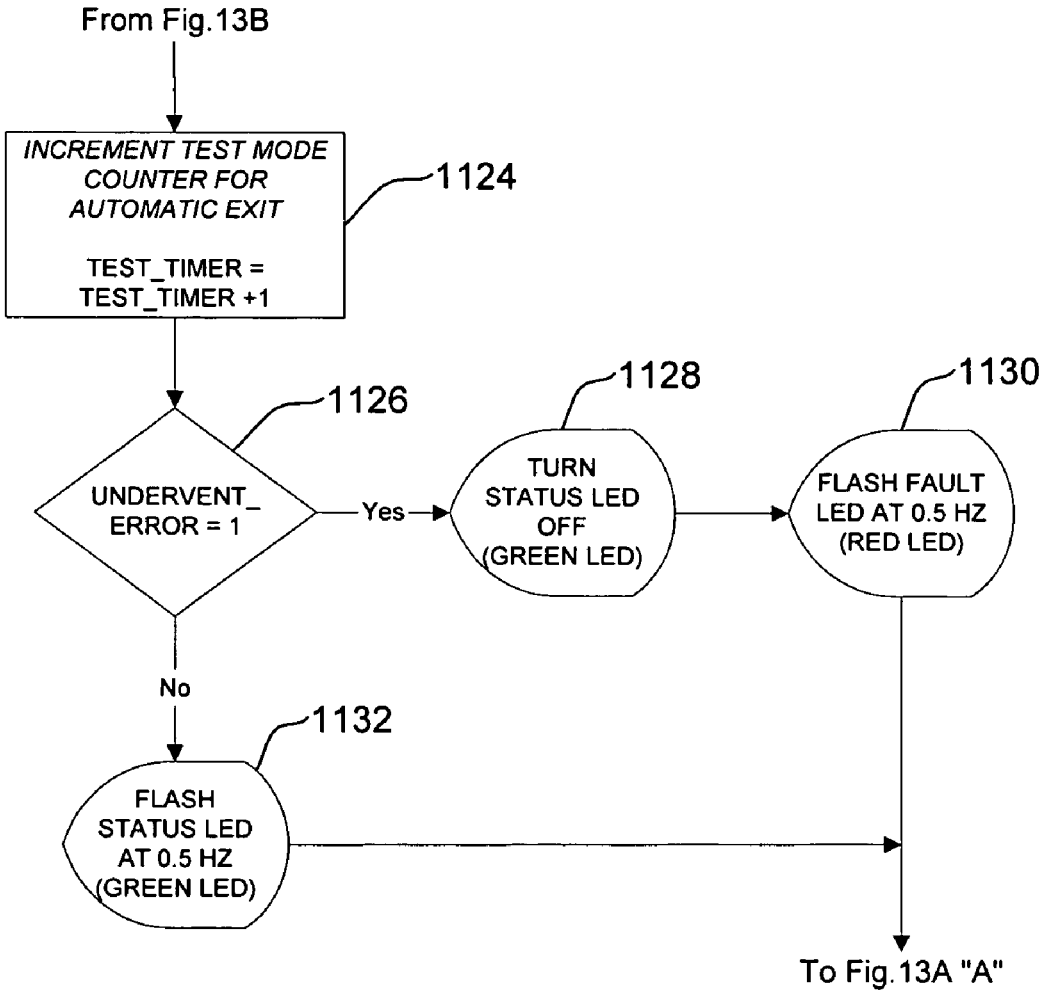

FIGS. 13A–13C illustrate a testing method for use with the method of FIGS. 11A–11P and 12A–12R. The illustrative testing method includes reading a test button that can be depressed at any time and, as noted, may be initiated either as a part of the cycle of steps taken at each iteration (as shown) or may be called as a subroutine through an interrupt, flag, or other sequence for stepping out of an ordinary program sequence.

FIG. 13A comes from A in FIGS. 11N, 12Q or 13C, to read the test button momentary switch (TEST) as shown at 1100. If TEST=1, as checked at 1102, the method continues to 1104 to determine whether TEST_MODE=0. If TEST_MODE=0 at 1104, this indicates the test button momentary switch has been newly depressed, since TEST=1 indicating the button is still being depressed but the TEST_MODE is not yet equal to 1 to indicate the system is in the test mode. If the check at 1104 yields a yes, then the method goes to FIG. 13B "1" as shown.

If the check at 1104 yields a no, then the system was already in the test mode when the button was depressed, indicating that the user wants to exit the test mode. Therefore, as shown at 1106, the method next sets TEST_MODE to zero to exit the test mode. Having exited the test mode, the method continues by de-energizing the fan relay, setting FANRELAY to zero, as shown at 1108, and then continues by de-energizing the damper/aux relay as shown at 1110. Having exited the test mode and de-energized the relevant relays, the method continues by going to either FIG. 11E or FIG. 12D, depending upon which side of the overall method (the side illustrated in FIGS. 11A–11P or the side in FIGS. 12A–12R) is being used.

Going back to step 1102, if TEST=0 (i.e. the button has not just been depressed or is not being depressed), the method next determines whether TEST_MODE is one (indicating the system is in test mode) and the TEST_TIMER is less than 180 (indicating the system has been in test mode less than three minutes), as shown at 1112. If so, the method continues at "2" in FIG. 13B. Otherwise, as shown at 1114, the method determines if the system is in test mode and the period for testing has expired (TEST_MODE=1 and TEST_TIMER=180). If the system is in test mode and has timed out, the method exits test mode by going through steps 1106, 1108 and 1110, as shown. In either event, the method next returns to either FIG. 1E or FIG. 12D, depending upon which side of the overall method is being used.

Turning next to FIG. 13B, "1" coming from FIG. 13A at 1104 goes to set the device into test mode as shown at 1116. Also, the test mode timer is reset as shown at 1118. Coming from either 1118 or "2" from FIG. 13A at 1112, the method energizes the fan relay as shown at 1120, taking control over the ventilation fan. Next the damper/aux relay is energized as shown at 1122, which causes the damper (if provided) to open as well as any auxiliary devices to activate and allow an installer/tester to determine whether the equipment is functioning. The method continues in FIG. 13C. Turning now to FIG. 13C, the method continues by incrementing the testing timer as shown at 1124. The method also checks whether UNDERVENT_ERROR is set to one, as shown at 1126, which refers to steps in FIGS. 11C and/or 12B. If UNDERVENT_ERROR is one, then the method turns off the status LED as shown at 1128 and flashes a fault LED at a set rate as shown at 1130, indicating the device is in test mode but will underventilate. The method next loops back to A in FIG. 13A to continue testing (unless the testing loop is exited as shown in FIG. 13A. If UNDERVENT_ERROR is not one, as shown at 1126, the method flashes the status LED at a set rate as shown at 1132 to indicate that the device is correctly set. The method then recycles to A in FIG. 13A.

In an alternative embodiment, a method using the steps for determining whether the HVAC system should be operated to meet an FAV standard may exclude steps for monitoring over-ventilation. Such a method may be used with a system lacking a controllable FAV damper, for example, a system using a fixed orifice fresh air vent. Alternatively, the over-ventilation monitoring steps may remain, but the damper control signals that are generated may not be connected to a damper controller.

In yet further embodiments, a method may make use of a flow rate sensor for determining the amount of FAV that has occurred. While the above embodiments make use of damper/system characteristics to estimate the amount of FAV that is occurring during a given time period, a method using a flow sensor coupled to a fresh air source may determine the amount of FAV that has occurred. The output of such a sensor could be added to a data element during the course of an hour by, for example, scaling the FAV flow sensor output and, with every pass through the method (i.e. each second) adding the scaled output to a data element. For example, if the flow sensor has an analog output, the flow sensor output could be received and passed through an analog-to-digital converter into, for example, an four bit number. This number could be added to a sixteen bit data element each second. Different data element sizes could of course be used. For each iteration during an hour, the following equation could be used to update the fresh air ventilation time:

$$\text{vent_time}=\text{vent_time}+\text{flow_sensor_output}$$

For such a system, if a maximum flow rate is known, the following equation could be used to determine whether fresh air ventilation must begin to meet a desired FAV goal:

$$\text{Max_output}*(3600-\text{hourtimer})\leqq\text{Goal}-\text{vent_time}$$

As long as the latter term is larger than or equal to the first term, the method does not call for ventilation-related fan operation and, if included, FAV damper actuation.

Another alternative embodiment may make use of known heating/cooling curves and sensed values to predict, before initiating FAV operation, whether the thermostat is about to call for heat. For example, certain thermostats can monitor the changing temperature in a controlled space. Extrapolating sensed temperature changes into the future and comparing the predicted future temperature to a setpoint, a thermostat can be used to predict when the HVAC system will next call for heating or cooling. Using this information, the method may include the following features. First, a minimum time lapse may be defined for example, of five minutes. Using data from the thermostat, if it is predicted that a heating or cooling call will occur within the minimum time lapse period, FAV operation that would otherwise occur may be delayed to conserve energy. The following pseudo code illustrates this method:

Does method determine FAV needed?

If yes, does the thermostat data suggest an HVAC call in less than five minutes?

If yes again, wait for thermostat call before beginning ventilation.

If no impending HVAC call, operate system to meet FAV goal.

Incorporation of these additional steps can further improve efficiency and reduce energy use.

Those skilled in the art will recognize that the present invention may be manifested in a variety of forms other than the specific embodiments described and contemplated herein. Accordingly, departures in form and detail may be made without departing from the scope and spirit of the present invention as described in the appended claims.

What is claimed is:

1. A method for ventilating an inside space using an HVAC system, the HVAC system adapted to respond to system calls for controlling one or more environmental conditions of the inside space, the HVAC system including a fan to distribute air to the inside space, and further including a fresh air intake that can be opened and closed, the method comprising:

determining a fraction of time that the fresh air intake must be open during anticipated future system calls of the HVAC system to meet a desired ventilation threshold for the inside space by the end of a predetermined time period; and opening the fresh air intake by the fraction determined in the determining step during one or more subsequent system calls of the HVAC system.

2. A method according to claim 1, further comprising the step of:

updating over time the fraction of time that the fresh air intake must be open during anticipated future system calls of the HVAC system to meet a desired ventilation threshold for the inside space.

3. A method according to claim 1, further Comprising the step of:

providing a fresh air ventilation call to the HVAC system, and opening the fresh air intake, if the fraction exceeds a predetermined value.

4. A method according to claim 3, further comprising the step of:

providing two or more fresh air ventilation calls over time to the HVAC system if the fraction exceeds the predetermined value two or more times over time.

5. A method according to claim 3 further comprising the step of smoothing out the two or more fresh air ventilation calls over time.

6. A method according to claim 5 wherein the smoothing step comprises increasing the fresh air ventilation at selected times and/or decreasing the fresh air ventilation at selected times.

* * * * *

UNITED STATES PATENT AND TRADEMARK OFFICE

CERTIFICATE OF CORRECTION

PATENT NO. : 7,044,397 B2
APPLICATION NO. : 10/758838
DATED : May 16, 2006
INVENTOR(S) : Charles E. Bartlett, Stephen J. Kemp and Leisha J. Rotering It is certified that error appears in the above-identified patent and that said Letters Patent is hereby corrected as shown below:

On the cover of the patent, please add the following:

Item (73) Assignee: Honeywell International Inc., 101 Columbia Road, Morristown, NJ 07962

Signed and Sealed this

Twenty-fifth Day of September, 2007

JON W. DUDAS
*Director of the United States Patent and Trademark Office*